US007190923B2

(12) United States Patent
Yamada et al.

(10) Patent No.: US 7,190,923 B2
(45) Date of Patent: Mar. 13, 2007

(54) IMAGE FORMING APPARATUS, METHOD FOR FORMING AN IMAGE, COMPUTER-READABLE STORAGE MEDIUM, AND COMPUTER SYSTEM

(75) Inventors: Yoichi Yamada, Nagano-ken (JP); Takayuki Shiraki, Nagano-ken (JP); Tatsuro Osawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

(21) Appl. No.: 10/717,204

(22) Filed: Nov. 20, 2003

(65) Prior Publication Data

US 2004/0146316 A1 Jul. 29, 2004

(30) Foreign Application Priority Data

Dec. 3, 2002 (JP) ..... 2002-351697
Jan. 24, 2003 (JP) ..... 2003-016647
Jan. 24, 2003 (JP) ..... 2003-016648

(51) Int. Cl.
*G03G 15/01* (2006.01)

(52) U.S. Cl. ..... 399/227

(58) Field of Classification Search ..... 399/24, 399/25, 27–30, 53, 226, 227
See application file for complete search history.

(56) References Cited

U.S. PATENT DOCUMENTS 6,349,183 B1 * 2/2002 Nagamine et al. ..... 399/27
6,701,110 B2 * 3/2004 Ono ..... 399/226
6,889,015 B2 * 5/2005 Shimura ..... 399/53

FOREIGN PATENT DOCUMENTS

| | | | |
|---|---|---|---|
| JP | 63-301960 | A1 | 12/1988 |
| JP | 02-269373 | A1 | 11/1990 |
| JP | 05-088500 | A1 | 4/1993 |
| JP | 5-107864 | A | 4/1993 |
| JP | 6-348100 | A | 12/1994 |
| JP | 09-106148 | A1 | 4/1997 |
| JP | 11-327302 | A1 | 11/1999 |
| JP | 2000-137351 | A1 | 5/2000 |
| JP | 2000-347499 | A | 12/2000 |
| JP | 2001-051465 | A1 | 2/2001 |
| JP | 2001-209232 | A1 | 8/2001 |
| JP | 2002-278143 | A1 | 9/2002 |
| JP | 2002-278159 | A1 | 9/2002 |
| JP | 2002-311669 | A1 | 10/2002 |

* cited by examiner

*Primary Examiner*—David M. Gray
*Assistant Examiner*—Ryan Gleitz
(74) *Attorney, Agent, or Firm*—Sughrue Mion, PLLC

(57) ABSTRACT

An image forming apparatus with an image bearing member on which a latent image is formed, with a plurality of developing devices for developing the latent image, each of the developing devices containing developer, and with a turnable turning member on which the plurality of developing devices are mounted. The turning member is caused to turn based on a turn history of the turning member.

16 Claims, 25 Drawing Sheets

HP position (standby position)

developing position

TYPE1

| JOB NO. | MODE | NUMBER OF OUTPUT SHEETS |
|---|---|---|
| JOB 1 | MONO-CHROME | 10 |
| JOB 2 | COLOR | 5 |
| JOB 3 | MONO-CHROME | 105 |
| JOB 4 | MONO-CHROME | 70 |
| JOB 5 | COLOR | 2 |
| JOB 6 | COLOR | 2 |
| JOB 7 | COLOR | 1 |
| JOB 8 | MONO-CHROME | 5 |
| TOTAL | | 200 |

TYPE2

| JOB NO. | MODE | NUMBER OF OUTPUT SHEETS |
|---|---|---|
| JOB 1 | MONO-CHROME | 40 |
| JOB 2 | MONO-CHROME | 160 |
| TOTAL | | 200 |

TYPE3

| JOB NO. | MODE | NUMBER OF OUTPUT SHEETS |
|---|---|---|
| JOB 1 | MONO-CHROME | 200 |
| TOTAL | | 200 |

FIG. 6

EXAMPLE OF DATA TABLE OF REFERENCE VALUES
(total number of times of rotations / total number of output sheets)

| | | remaining amount of toner | |
|---|---|---|---|
| | | 150～250g | 50～150g |
| amount of time driven | 0 - 3000 sheets | 0.03 | 0.03 |
| | 3000 - 6000 sheets | 0.05 | 0.04 |
| | 6000 - 9000 sheets | 0.07 | 0.05 |

FIG. 12

| order of development | 1 | 2 | 3 | 4 |
|---|---|---|---|---|
| toner color | Y | C | M | K |
| ratio in volume of fine toner (%) | 2.5 | 1.5 | 1 | 0.5 |
| charge amount ( μ C/g) | 25 | 20 | 15 | 14.8 |
| volume average particle diameter ( μ m) | 8.5 | 8.5 | 8.5 | 8.5 |

| order of development | 1 | 2 | 3 | 4 |
|---|---|---|---|---|
| toner color | C | C | C | C |
| degree of occurrence of hollow defects (initial state of usage) | 3.7 | 4.0 | 4.3 | 4.6 |
| degree of occurrence of hollow defects | 3.0 | 3.7 | 4.3 | 5.0 |

| order of development | 4 | 4 | 4 | 4 |
|---|---|---|---|---|
| toner color | Y | C | M | K |
| degree of occurrence of hollow defects | 4.7 | 4.6 | 4.7 | 4.8 |

| order of development | 1 | 2 | 3 | 4 |
|---|---|---|---|---|
| toner color | Y | C | M | K |
| ratio in volume of fine toner (%) | 2.5 | 0.5 | 1 | 2 |
| volume average particle diameter ($\mu$m) | 8.5 | 8.5 | 8.5 | 8.5 |

| order of development | 4 | 4 | 4 |
|---|---|---|---|
| toner color | C | C | C |
| ratio in volume of fine toner (%) | 0.5 | 1.5 | 2.5 |
| volume average particle diameter (μm) | 8.5 | 8.5 | 8.5 |
| degree of occurrence of hollow defects (initial state of usage) | 4.6 | 4.2 | 3.9 |
| degree of occurrence of hollow defects | 5.0 | 3.9 | 3.7 |

IMAGE FORMING APPARATUS, METHOD FOR FORMING AN IMAGE, COMPUTER-READABLE STORAGE MEDIUM, AND COMPUTER SYSTEM

CROSS-REFERENCE TO RELATED APPLICATIONS

The present application claims priority upon Japanese Patent Application No. 2002-351697 filed Dec. 3, 2002, Japanese Patent Application No. 2003-16647 filed Jan. 24, 2003, and Japanese Patent Application No. 2003-16648 filed Jan. 24, 2003, the contents of which are herein incorporated by reference.

BACKGROUND OF THE INVENTION

1. Field of the Invention

The present invention relates to an image forming apparatus, a method for forming an image, a computer-readable storage medium, and a computer system.

2. Description of the Related Art (1) Image forming apparatuses that use toner, for example, as the developer and that form images by developing latent images formed on a photoconductor, which serves as an image bearing member, are known as a type of image forming apparatus that has a turning member on which a plurality of developing devices are mounted and that causes the developer, which is contained in a container of each developing device, to move along with the turning movement of the turning member. In such image forming apparatuses, each of the developing devices contains different colors of toner, such as yellow toner, magenta toner, cyan toner, and black toner. Each of the developing devices are made to oppose the photoconductor one by one, and a latent image formed on the photoconductor is developed by supplying the toner in the developing device opposing the photoconductor, using a developer-supplying section provided in that developing device. The developed toner image is transferred onto an intermediate medium and then onto paper, for example, which serves as a medium. During these processes, the toner is charged by friction, for example, in order to make the toner adhere to the photoconductor.

When printing a color image, each of the developing devices is placed opposed to the photoconductor successively through the turning movement of the turning member in order to form single-color toner images in each color. The single-color toner images in four colors are transferred onto the intermediate medium in a superimposed manner, and then the superimposed color toner image is transferred onto paper. (Refer to, for example, Japanese Patent Application Laid-open Publication No. 2000-347499.)

However, if, for example, the image forming apparatus described above is used to continuously print single-color images, such as texts, on a multitude of sheets of paper using only black toner, the developing device containing black toner will be kept in the position opposing the photoconductor during the continuous printing. In other words, during the continuous printing, the turning member does not turn. As a result, in image forming apparatuses that cause the developer contained in the container of each developing device to move along with the turning movement of the turning member, the toner in the developing devices will not be stirred during the continuous printing using a single type of toner.

The toner on the side of the developer supplying section is charged and supplied to the photoconductor. However, particularly when printing monochrome images such as texts, a major portion of the charged toner is returned back into the developing device without adhering to the photoconductor. If the developing process continues without the toner in the developing device being stirred, only the toner on the side of the developer supplying section will deteriorate. That is, toners having significantly different characteristics will be contained in the developing device. When toners of different characteristics are mixed, problems such as fogging in images, scattering of toner, and toner spill tend to occur.

(2) A color image forming apparatus comprising a rotary-type developing unit that has a plurality of developing devices for developing a latent image formed on a photoconductor (which serves as an example of an image bearing member) using toner (as an example of developer) and in which these developing devices are arranged radially about the axis of rotation of the developing unit, is also known as another type of image forming apparatus. When image signals are sent from an external device, such as a host computer, to this kind of color image forming apparatus, the apparatus positions one of the developing devices in the developing position opposing the photoconductor by making the developing unit rotate about its rotation axis. In this position, the image forming apparatus develops a latent image formed on the photoconductor with the developing device to form a toner image, and transfers the toner image onto an intermediate transferring element, which serves as an example of a transferring medium. The above-mentioned developing and transferring processes are repeated while successively changing the positions of the developing devices, and a plurality of toner images are transferred onto the intermediate transferring element in a superimposing manner, forming a color image. Finally, the color image is transferred onto a transferring material such as paper. (Refer to, for example, Japanese Patent Application Laid-open Publication No. 6-348100 and Japanese Patent Application Laid-open Publication No. 5-107864.)

When forming a color image using such a color image forming apparatus by superimposing toner of several colors onto the intermediate transferring element, a phenomenon in which toner of one color inadvertently overlies toner of another color that has already been transferred onto the intermediate transferring element sometimes occurs. (This phenomenon is called "fogging" herein.) "Fogging" causes deterioration in the quality of the color image that is finally transferred onto the transferring material. For this reason, there has been a demand for a technique to reduce occurrence of "fogging".

Furthermore, when transferring toner onto the intermediate transferring element, a phenomenon called "hollow defects" sometimes occurs. Hollow defects cause deterioration in the quality of the color image that is finally transferred onto the transferring material. For this reason, there has also been a demand for a technique to reduce occurrence of hollow defects.

SUMMARY OF THE INVENTION

The present invention has been made in view of the problems described above, and an object thereof is to provide an image forming apparatus that is capable of reducing the occurrence of situations in which toners having significantly different characteristics exist in a developing device, a storage medium having a program recorded thereon for controlling such an image forming apparatus, a computer system comprising such an image forming apparatus, and a method for forming an image.

Another object of the present invention is to provide a color image forming apparatus that is capable of reducing the occurrence of "fogging", a method for forming a color image, and a computer system.

Another object of the present invention is to provide a color image forming apparatus that is capable of reducing the occurrence of hollow defects, a method for forming a color image, and a computer system.

One aspect of the present invention is an image forming apparatus comprising: an image bearing member on which a latent image is formed; a plurality of developing devices for developing the latent image, each of the developing devices containing developer; and a turnable turning member on which the plurality of developing devices are mounted. The turning member is caused to turn based on a turn history of the turning member.

Another aspect of the present invention is a color image forming apparatus comprising: a plurality of developing devices, each of the developing devices containing developer that includes a predetermined ratio in volume of developer particles having a diameter of a predetermined value or less, and being capable of developing a latent image using the developer contained therein. The image forming apparatus forms a color image by performing development successively with each of the plurality of developing devices to superimpose different kinds of developer. The plurality of developing devices include a first developing device whose ratio in volume of the developer particles is R1, and a second developing device whose ratio in volume of the developer particles is R2. The first developing device and the second developing device satisfy all of the following conditions (1) through (3):

(1) the order in which the first developing device and the second developing device perform development is other than first in order;

(2) the second developing device performs development later than the first developing device; and (3) R1 is larger than R2.

Another aspect of the present invention is a color image forming apparatus comprising: an image bearing member for bearing a latent image; a plurality of developing devices, each of the developing devices containing developer that includes a predetermined ratio in volume of developer particles having a diameter of a predetermined value or less, and being capable of developing the latent image using the developer contained therein; and a transferring medium that serves as a medium when transferring the developer on the image bearing member onto a transferring material. The image forming apparatus forms a color image by performing an operation of developing the latent image bore on the image bearing member with the developer using each of the developing devices, and transferring the developer on the image bearing member onto the transferring medium in a state in which the image bearing member and the transferring medium are in contact with each other, successively with each of the plurality of developing devices to superimpose different kinds of the developer onto the transferring medium. The plurality of developing devices include a first developing device whose ratio in volume of the developer particles is R1, and a second developing device whose ratio in volume of the developer particles is R2. The first developing device and the second developing device satisfy both of the following conditions (1) and (2):

(1) the second developing device performs development later than the first developing device; and (2) R2 is larger than R1.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 6 is a diagram showing the contents of print jobs for explaining the operations of the image forming apparatus;

FIG. 12 is a diagram showing an example of a data table provided in the apparatus-side memory;

DETAILED DESCRIPTION OF THE INVENTION

Figure 1:
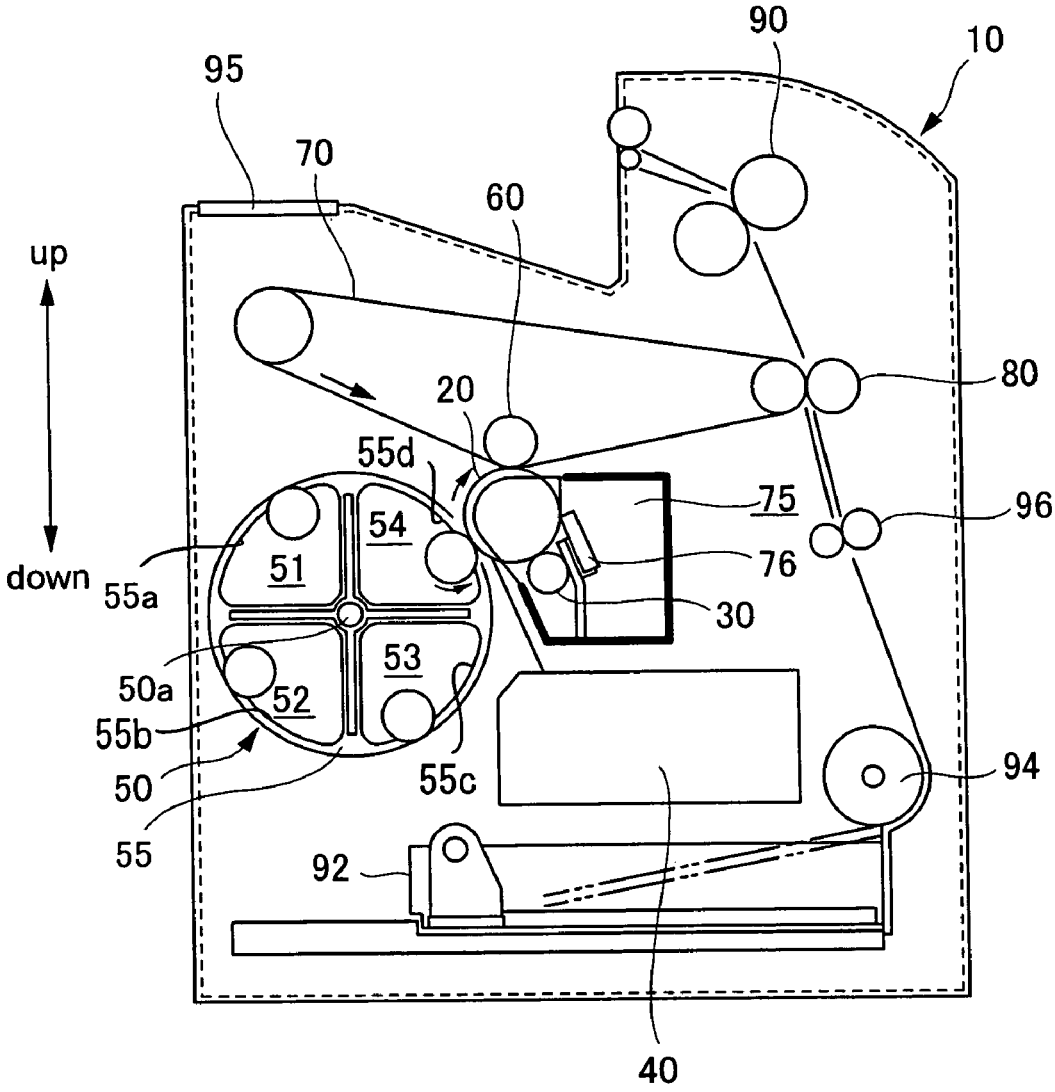
FIG. 1 is a diagram showing main structural components constructing an image forming apparatus according to one embodiment.

At least the following matters will be made clear by the description in the present specification and the description of the accompanying drawings.

An image forming apparatus comprises: an image bearing member on which a latent image is formed; a plurality of developing devices for developing the latent image, each of the developing devices containing developer; and a turnable turning member on which the plurality of developing devices are mounted, wherein the turning member is caused to turn based on a turn history of the turning member.

In a developing device, developer exists in both the side at which the developer is supplied to the image bearing member (i.e., the side closer to the image bearing member) and the side further therefrom. As described above, the developer closer to the image bearing member tends to deteriorate more easily. Therefore, if development is continued without the developer being moved, developer having significantly different characteristics will exist in the developing device. However, according to the image forming apparatus described above, it becomes possible to move the developing device by causing the turning member to turn and thereby move the developer contained in the developing device. In this way, the developer in the developing device does not remain only in a certain position, and it is possible to prevent developer having different characteristics from being generated in the developing device. Particularly, since the turning member is turned based on the turn history of the turning member, it becomes possible to move the developer certainly and efficiently.

In the image forming apparatus, it is preferable that each of the developing devices has two developer containers that contain the developer when the developing device is positioned in a developing position for developing the latent image; and when the turning member is caused to turn, the developer contained in each of the two developer containers is mixed.

According to such an image forming apparatus, since the developer that is contained in both of the two developer containers, when the developing device is in the developing position, is mixed by the turning movement of the turning member, it becomes possible to make the characteristics of the developer contained in both developer containers substantially uniform.

In the image forming apparatus, it is preferable that one of the two developer containers has a developer supplying section for supplying the developer to the image bearing member; and the developer supplying section of each developing device is at a lower portion of that developing device when that developing device is positioned in the developing position.

According to such an image forming apparatus, since the developer supplying section is at a lower portion of one of the developer containers when the developing device is in the developing position, it becomes possible to supply the developer, which has been mixed according to the turning movement, to the developer supplying section only with the developer's own weight.

In the image forming apparatus, it is preferable that each of the developing devices does not have a stirring member for stirring the developer.

According to such an image forming apparatus, since the developer in the developing device is stirred according to the turning movement of the turning member, there is no need to provide a separate stirring member. Therefore, it is possible to reduce the cost of the developing devices and the image forming apparatus, because they carry no unnecessary stirring members.

In the image forming apparatus, it is preferable that an image formed by developing the latent image is output by being transferred onto a medium; and the turn history is a history value according to a number of the medium that has been output, and a number of times of turns of the turning member.

According to such an image forming apparatus, since the turning member is turned according to the number of the medium that has been output and the number of times of turns of the turning member, the medium will not be continuously output for a long time without the turning member being turned. Therefore, it becomes possible to stir the developer in the developing device at appropriate intervals.

In the image forming apparatus, it is preferable that the image forming apparatus comprises a detector for detecting the turn of the turning member, and a counter for counting the output of the detector; and the number of times of turns of the turning member is a number counted by the counter.

According to such an image forming apparatus, since the number of times of turns for which the turning member has actually turned is detected, it becomes possible to turn the turning member based on an accurate number of times of turns of the turning member.

In the image forming apparatus, it is preferable that output of the image on the medium is executed according to an output command; and the number of times of turns of the turning member is estimated according to the output command.

According to such an image forming apparatus, since a detector for detecting the turns of the turning member is not necessary, it is possible to reduce the cost of the device. Further, it becomes possible to appropriately execute the turning movement for stirring the developer according to the output command.

In the image forming apparatus, it is preferable that the estimation is executed every time the medium is output.

According to such an image forming apparatus, since the number of times of turns of the turning member is estimated every time the medium is output, it becomes possible to carry out the turning movement at a suitable timing.

In the image forming apparatus, it is preferable that the estimation is executed every time a predetermined number of the medium is output.

According to such an image forming apparatus, since the number of times of estimation is smaller compared to the case where the number of times of turns of the turning member is estimated every time the medium is output, it becomes possible to suppress reduction in throughput of the image forming apparatus.

In the image forming apparatus, it is preferable that the estimation is executed for every output job by which the medium is output.

According to such an image forming apparatus, since the turning member is turned for every output job, the turning movement for making the developer move is not carried out during the output job. Accordingly, it becomes possible to suppress occurrence of a situation in which the characteristics of the developer in the container significantly differ, without causing any delay in the process speed of the output job.

In the image forming apparatus, it is preferable that the estimation is executed every time a predetermined number of the medium is output according to the output job using a certain one of the developing devices without the turning member being turned.

According to such an image forming apparatus, the estimation is executed every time the medium is continuously output using a certain developing device, where a situation in which the characteristics of the developer in the container significantly differ is extremely likely to occur. Therefore, it becomes possible to suppress, certainly and without any loss, occurrence of a situation in which the characteristics of the developer in the container significantly differ.

In the image forming apparatus, it is preferable that the plurality of developing devices each contains developer of a different color including black; and the certain one of developing devices is the developing device containing the black developer.

There is a high possibility that black developer is used for an output process in which the media is continuously output. According to the above-mentioned image forming apparatus, by executing the estimation after the medium has been continuously output using the developing device containing the black developer, it becomes possible to carry out the turning movement efficiently.

In the image forming apparatus, it is preferable that the history value is a turn value that indicates a ratio between the number of the medium that has been output, and the number of times of turns of the turning member.

According to such an image forming apparatus, since the turning movement is carried out based on the ratio between the number of the medium that has been output and the number of times of turns of the turning member, the turning member will be turned for a predetermined number of times when a predetermined amount of media is output. Therefore, it becomes possible to prevent occurrence of a situation in which developer having significantly different characteristics exists in the developing device.

In the image forming apparatus, it is preferable that the turning member is caused to turn when the turn value is smaller than a preset reference value as a result of comparison between the turn value and the reference value.

According to such an image forming apparatus, by setting the reference value to a value at which the turning movement is carried out within an extent that the characteristics of the developer in the developing device do not differ significantly, it becomes possible to certainly suppress, based on the reference value, occurrence of a situation in which developer having significantly different characteristics exists in the developing device.

In the image forming apparatus, it is preferable that the turning member is caused to turn every time a predetermined number of the medium is output.

According to such an image forming apparatus, since the developer in the developing device is stirred every time a predetermined number of the medium is output, it becomes possible to prevent occurrence of a situation in which the characteristics of the developer in the developing device extremely differ.

In the image forming apparatus, it is preferable that the image forming apparatus comprises a storage element capable of storing various kinds of information; and the reference value is changeable according to the information in the storage element.

According to such an image forming apparatus, by changing the reference value according to the information in the storage element, it becomes possible to carry out the turning movement at a timing appropriate for the various kinds of information.

In the image forming apparatus, it is preferable that the information is about a remaining amount of the developer contained in a container provided in each of the developing devices.

According to such an image forming apparatus, it becomes possible to carry out the turning movement at a frequency suiting the remaining amount of developer. For example, when the remaining amount of developer is small, that is, when the number of times of development is large and there is a high possibility that the developer has deteriorated, the reference value is set to a smaller value than for the initial period of usage where the remaining amount of toner is large. In this way, it becomes possible to prevent developer that has deteriorated significantly from being generated in the developing device.

In the image forming apparatus, it is preferable that the information is about an amount of the medium that is output using each of the developing devices.

According to such an image forming apparatus, it becomes possible to carry out the turning movement at a frequency suiting the amount of medium output using each developing device. For example, when the amount of medium having been output is large, that is, when the number of times of development is large and there is a high possibility that the developer has deteriorated, the reference value is set to a smaller value than for the initial period of usage where the amount of medium having been output is small. In this way, it becomes possible to prevent developer that has deteriorated significantly from being generated in the container.

In the image forming apparatus, it is preferable that the storage element is provided in/on each of the developing devices.

According to such an image forming apparatus, it becomes possible to carry out the turning movement at a frequency suiting the state of usage of each developing device.

Another image forming apparatus comprises:

an image bearing member on which a latent image is formed;

a plurality of developing devices for developing the latent image, each of the developing devices containing developer; and a turnable turning member on which the plurality of developing devices are mounted, wherein:

each of the developing devices has two developer containers that contain the developer when the developing device is positioned in a developing position for developing the latent image;

one of the two developer containers has a developer supplying section for supplying the developer to the image bearing member;

the developer supplying section of each developing device is at a lower portion of that developing device when that developing device is positioned in the developing position;

the developing device has a storage element capable of storing information about a remaining amount of the developer contained in the container, and information about an amount of medium that is output using each of the developing devices;

each of the developing devices does not have a stirring member for stirring the developer;

an image formed by developing the latent image is output by being transferred onto the medium;

the turning member is caused to turn every time a predetermined number of the medium is output;

the image forming apparatus further comprises a detector for detecting the turn of the turning member, and a counter for counting the output of the detector; and the turning member is caused to turn to mix the developer contained in each of the two developer containers when a turn value that indicates a ratio between the number of the medium that has been output, and the number counted by the counter is smaller than a preset reference value that is changeable according to the information in the storage element as a result of comparison between the turn value and the reference value.

According to such an image forming apparatus, since the turning member is turned according to the number of the medium that has been output and the number of times of turns of the turning member, the developer in the developing device does not remain only in a certain position, and it becomes possible to prevent developer having different characteristics from being generated in the developing device. Particularly, since the turning member is turned based on the turn history of the turning member, the medium will not be continuously output for a long time without the turning member being turned. Accordingly, it becomes possible to stir the developer in the developing device by moving the developer certainly and efficiently at appropriate intervals.

Another image forming apparatus comprises: an image bearing member on which a latent image is formed; a plurality of developing devices for developing the latent image, each of the developing devices containing developer; and a turnable turning member on which the plurality of developing devices are mounted, wherein, according to an output command, the image forming apparatus outputs an image formed by developing the latent image by transferring the image onto a medium; and wherein the turning member is caused to turn at least either at the beginning or the end of an output job for outputting the medium.

In an image forming apparatus, various operations of each of the mechanical portions, such as positioning of the medium, are synchronously carried out at the beginning and the end of an output job for outputting the medium. Therefore, according to the above-mentioned image forming apparatus, by carrying out the turning movement during those various operations, it becomes possible to prevent occurrence of a situation in which developer having different characteristics exists in the developing device, without any decrease in the throughput of the image forming apparatus.

It is also possible to provide a computer-readable storage medium having recorded thereon a program for making an image forming apparatus comprising:

an image bearing member on which a latent image is formed;

a plurality of developing devices for developing the latent image, each of the developing devices containing developer; and a turnable turning member on which the plurality of developing devices are mounted, achieve a function of causing the turning member to turn based on a turn history of the turning member.

It is also possible to provide a computer system comprising an image forming apparatus having:

an image bearing member on which a latent image is formed;

a plurality of developing devices for developing the latent image, each of the developing devices containing developer; and a turnable turning member on which the plurality of developing devices are mounted, wherein the turning member is caused to turn based on a turn history of the turning member.

It is also possible to provide a method for forming an image with an image forming apparatus having: an image bearing member on which a latent image is formed; a plurality of developing devices for developing the latent image, each of the developing devices containing developer; and a turnable turning member on which the plurality of developing devices are mounted, the method comprising the step of causing the turning member to turn based on a turn history of the turning member.

It is also possible to provide a computer-readable storage medium having recorded thereon a program for making an image forming apparatus comprising:

an image bearing member on which a latent image is formed;

a plurality of developing devices for developing the latent image, each of the developing devices containing developer; and a turnable turning member on which the plurality of developing devices are mounted;

the image forming apparatus outputting, according to an output command, an image formed by developing the latent image by transferring the image onto a medium, achieve a function of causing the turning member to turn at least either at the beginning or the end of an output job for outputting the medium.

It is also possible to provide a computer system comprising an image forming apparatus having:

an image bearing member on which a latent image is formed;

a plurality of developing devices for developing the latent image, each of the developing devices containing developer; and a turnable turning member on which the plurality of developing devices are mounted, wherein, according to an output command, the image forming apparatus outputs an image formed by developing the latent image by transferring the image onto a medium; and wherein the turning member is caused to turn at least either at the beginning or the end of an output job for outputting the medium.

It is also possible to provide a method for forming an image with an image forming apparatus having: an image bearing member on which a latent image is formed; a plurality of developing devices for developing the latent image, each of the developing devices containing developer; and a turnable turning member on which the plurality of developing devices are mounted; the image forming apparatus outputting, according to an output command, an image formed by developing the latent image by transferring the image onto a medium, the method comprising the step of causing the turning member to turn at least either at the beginning or the end of an output job for outputting the medium.

Another aspect of the present invention is a color image forming apparatus comprising: a plurality of developing devices, each of the developing devices containing developer that includes a predetermined ratio in volume of developer particles having a diameter of a predetermined value or less, and being capable of developing a latent image using the developer contained therein, wherein the image forming apparatus forms a color image by performing development successively with each of the plurality of developing devices to superimpose different kinds of the developer;

wherein the plurality of developing devices include a first developing device whose ratio in volume of the developer particles is R1, and a second developing device whose ratio in volume of the developer particles is R2; and wherein the first developing device and the second developing device satisfy all of the following conditions (1) through (3):

(1) the order in which the first developing device and the second developing device perform development is other than first in order;

(2) the second developing device performs development later than the first developing device; and (3) R1 is larger than R2.

By using the first developing device, whose ratio in volume is R1, and the second developing device, whose ratio in volume is R2, that satisfy all of the above-mentioned conditions (1) through (3), it becomes possible to reduce the occurrence of "fogging".

Further, it is possible that the developing devices, among the plurality of developing devices other than the developing device that performs development first, perform development according to an order in which a developing device having a smaller ratio in volume performs development later in order.

In this way, it becomes possible to achieve the above-mentioned effect of reducing the occurrence of "fogging" more effectively.

Further, it is possible that the predetermined value is 5 μm.

Considering the intensity in charge characteristics of fine developer, it is preferable to set the value to 5 μm.

Further, it is possible that the ratio in volume for the developing device that performs development first among the plurality of developing devices is larger than the ratio in volume for each of the other developing devices.

This configuration is more rational since "fogging" according to the mechanism described below does not occur for the first development and transferring.

Further, it is possible that the developer includes conductive metal oxide as an external additive.

In this way, the occurrence of "fogging" is further reduced because the inversely-charged developer becomes difficult to be transferred onto the transferring medium.

Further, it is possible that when assuming that a charge amount of the developer contained in the first developing device is E1, and a charge amount of the developer contained in the second developing device is E2, E1 is larger than E2.

In this way, the carrying of developer on the developer bearing member is stabilized.

Further, it is possible that the developer includes a core particle, and conductive metal oxide as an external additive associated on the core particle; and when assuming that an amount of the external additive of the developer in the first developing device is A1, and an amount of the external additive of the developer in the second developing device is A2, A1 is larger than A2.

In this way, the charge amount of the developer in the second developing device can be made smaller than the charge amount of the developer in the first developing device most easily.

Further, it is possible that the developer includes a core particle, and conductive metal oxide as an external additive associated on the core particle; and when assuming that a charge amount of the core particle of the developer in the first developing device is M1, and a charge amount of the core particle of the developer in the second developing device is M2, M1 is larger than M2.

In this way, it is possible to maintain the relationship "E2 (the charge amount of the developer in the second developing device)<E1 (the charge amount of the developer in the first developing device)" even when the charge-amount adjusting effect of the external additive decreases.

Further, it is possible that a volume average particle diameter of the developer in the first developing device is equal to a volume average particle diameter of the developer in the second developing device.

In this way, it becomes possible to enjoy various advantages achieved by making the volume average particle diameter of the developer equal, such as the effect of preventing unevenness in the developer carry amount and the effect of making the relationship between the amount of developer adhering to the transferring material and the appearance of darkness uniform.

Further, it is possible that the image forming apparatus further comprises: an image bearing member for bearing the latent image; and a transferring medium that serves as a medium when transferring a developer image made visible on the image bearing member onto a transferring material, wherein the image forming apparatus forms the color image by performing an operation of making the latent image bore on the image bearing member visible as the developer image using each of the developing devices, placing the image bearing member and the transferring medium in contact with each other, and transferring the developer image onto the transferring medium, successively with each of the plurality of developing devices to superimpose different kinds of the developer onto the transferring medium.

In this way, not only is it possible to prevent developer of other colors from getting mixed in the developing device, but the above-mentioned effect of the present invention, that is, the effect of enabling reduction in the occurrence of "fogging" is achieved more advantageously.

It is also possible to provide a color image forming apparatus comprising: a plurality of developing devices, each of the developing devices containing developer that includes a predetermined ratio in volume of developer particles having a diameter of a predetermined value or less, and being capable of developing a latent image using the developer contained therein, wherein:

the image forming apparatus forms a color image by performing development successively with each of the plurality of developing devices to superimpose different kinds of the developer;

the plurality of developing devices include a first developing device whose ratio in volume of the developer particles is R1, and a second developing device whose ratio in volume of the developer particles is R2;

the first developing device and the second developing device satisfy all of the following conditions (1) through (3):

(1) the order in which the first developing device and the second developing device perform development is other than first in order;

(2) the second developing device performs development later than the first developing device; and (3) R1 is larger than R2;

the developing devices, among the plurality of developing devices other than the developing device that performs development first, perform development according to an order in which a developing device having a smaller ratio in volume performs development later in order;

the predetermined value is 5 μm;

the ratio in volume for the developing device that performs development first among the plurality of developing devices is larger than the ratio in volume for each of the other developing devices;

when assuming that a charge amount of the developer contained in the first developing device is E1, and a charge amount of the developer contained in the second developing device is E2, E1 is larger than E2;

the developer includes a core particle, and conductive metal oxide as an external additive associated on the core particle;

when assuming that an amount of the external additive of the developer in the first developing device is A1, and an amount of the external additive of the developer in the second developing device is A2, A1 is larger than A2;

when assuming that a charge amount of the core particle of the developer in the first developing device is M1, and a charge amount of the core particle of the developer in the second developing device is M2, M1 is larger than M2;

a volume average particle diameter of the developer in the first developing device is equal to a volume average particle diameter of the developer in the second developing device;

the image forming apparatus further comprises: an image bearing member for bearing the latent image; and a transferring medium that serves as a medium when transferring a developer image made visible on the image bearing member onto a transferring material; and the image forming apparatus forms the color image by performing an operation of making the latent image bore on the image bearing member visible as the developer image using each of the developing devices, placing the image bearing member and the transferring medium in contact with each other, and transferring the developer image onto the transferring medium successively with each of the plurality of developing devices to superimpose different kinds of the developer onto the transferring medium.

In this way, the object of the present invention is achieved more advantageously, because all of the effects described above are obtained.

It is also possible to provide a method of forming a color image comprising: a step of performing development successively with each of a plurality of developing devices to superimpose different kinds of developer to form a color image, each of the developing devices containing developer that includes a predetermined ratio in volume of developer particles having a diameter of at most a predetermined value, and being capable of developing a latent image using the developer contained therein, wherein the plurality of developing devices include a first developing device whose ratio in volume of the developer particles is R1, and a second developing device whose ratio in volume of the developer particles is R2; and wherein the first developing device and the second developing device satisfy all of the following conditions (1) through (3):

(1) the order in which the first developing device and the second developing device perform development is other than first in order;

(2) the second developing device performs development later than the first developing device; and (3) R1 is larger than R2.

The occurrence of "fogging" is reduced with such an image forming method.

It is also possible to provide a computer system comprising: a computer; a display device that is connectable to the computer; and a color image forming apparatus that is connectable to the computer and that has a plurality of developing devices, each of the developing devices containing developer that includes a predetermined ratio in volume of developer particles having a diameter of a predetermined value or less, and being capable of developing a latent image using the developer contained therein;

the image forming apparatus forming a color image by performing development successively with each of the plurality of developing devices to superimpose different kinds of the developer;

the plurality of developing devices including a first developing device whose ratio in volume of the developer particles is R1, and a second developing device whose ratio in volume of the developer particles is R2; and the first developing device and the second developing device satisfying all of the following conditions (1) through (3):

(1) the order in which the first developing device and the second developing device perform development is other than first in order;

(2) the second developing device performs development later than the first developing device; and (3) R1 is larger than R2.

A computer system configured as above will be superior to a conventional computer system as a whole.

Another aspect of the present invention is a color image forming apparatus comprising: an image bearing member for bearing a latent image; a plurality of developing devices, each of the developing devices containing developer that includes a predetermined ratio in volume of developer particles having a diameter of a predetermined value or less, and being capable of developing the latent image using the developer contained therein; and a transferring medium that serves as a medium when transferring the developer on the image bearing member onto a transferring material, wherein the image forming apparatus forms a color image by performing an operation of developing the latent image bore on the image bearing member with the developer using each of the developing devices, and transferring the developer on the image bearing member onto the transferring medium in a state in which the image bearing member and the transferring medium are in contact with each other, successively with each of the plurality of developing devices to superimpose different kinds of the developer onto the transferring medium;

wherein the plurality of developing devices include a first developing device whose ratio in volume of the developer particles is R1, and a second developing device whose ratio in volume of the developer particles is R2; and wherein the first developing device and the second developing device satisfy both of the following conditions (1) and (2):

(1) the second developing device performs development later than the first developing device; and (2) R2 is larger than R1.

By using the first developing device, whose ratio in volume is R1, and the second developing device, whose ratio in volume is R2, that satisfy both of the above-mentioned conditions (1) and (2), it becomes possible to reduce the occurrence of hollow defects.

Further, it is possible that the plurality of developing devices perform development according to an order in which a developing device having a smaller ratio in volume performs development earlier in order.

In this way, it becomes possible to achieve the above-mentioned effect of reducing the occurrence of hollow defects more effectively.

Further, it is possible that, among the plurality of developing devices, the developing device performing development first in order contains yellow developer.

Since yellow is a color that does not stand out so much, it is preferable to use yellow for the first development and transferring process in which occurrence of hollow defects tends to be most significant.

Further, it is possible that among the plurality of developing devices, the developing device performing development last in order contains black developer.

Since black is a color that stands out and that is frequently used, it is preferable to use black for the last development and transferring process in which occurrence of hollow defects tends to be least significant.

Further, it is possible that the predetermined value is 5 μm.

Considering the high packing density and the intensity in charge characteristics of fine developer, it is preferable to set the value to 5 μm.

Further, it is possible that a coefficient of static friction of the surface of the image bearing member is larger than a coefficient of static friction of the surface of the transferring medium.

In this case, the above-mentioned effect of the present invention, that is, the effect of enabling reduction in the occurrence of hollow defects is achieved more advantageously, because in such cases not-transferred developer and inversely-charged developer are generated more easily.

Further, it is possible that the developer includes conductive metal oxide as an external additive.

In this way, the occurrence of hollow defects is further reduced because agglomeration of fine developer becomes difficult to occur.

Further, it is possible that, when assuming that a charge amount of the developer contained in the first developing device is E1, and a charge amount of the developer contained in the second developing device is E2, E2 is larger than E1.

In this way, the carrying of developer on the developer roller is stabilized.

Further, it is possible that the developer includes a core particle, and conductive metal oxide as an external additive associated on the core particle; and when assuming that an amount of the external additive of the developer in the first developing device is A1, and an amount of the external additive of the developer in the second developing device is A2, A2 is larger than A1.

In this way, the charge amount of the developer in the first developing device can be made smaller than the charge amount of the developer in the second developing device most easily.

Further, it is possible that the developer includes a core particle, and conductive metal oxide as an external additive associated on the core particle; and when assuming that a charge amount of the core particle of the developer in the first developing device is M1, and a charge amount of the core particle of the developer in the second developing device is M2, M2 is larger than M1.

In this way, it is possible to maintain the relationship "E1 (the charge amount of the developer in the first developing device)<E2 (the charge amount of the developer in the second developing device)" even when the charge-amount adjusting effect of the external additive decreases.

Further, it is possible that a volume average particle diameter of the developer in the first developing device is equal to a volume average particle diameter of the developer in the second developing device.

In this way, it becomes possible to enjoy various advantages achieved by making the volume average particle diameter of the developer equal, such as the effect of preventing unevenness in the developer carry amount and the effect of making the relationship between the amount of developer adhering to the transferring material and the appearance of darkness uniform.

Further, it is also possible to provide a color image forming apparatus comprising: an image bearing member for bearing a latent image; a plurality of developing devices, each of the developing devices containing developer that includes a predetermined ratio in volume of developer particles having a diameter of a predetermined value or less, and being capable of developing the latent image using the developer contained therein; and a transferring medium that serves as a medium when transferring the developer on the image bearing member onto a transferring material, wherein:

the image forming apparatus forms a color image by performing an operation of developing the latent image bore on the image bearing member with the developer using each of the developing devices, and transferring the developer on the image bearing member onto the transferring medium in a state in which the image bearing member and the transferring medium are in contact with each other, successively with each of the plurality of developing devices to superimpose different kinds of the developer onto the transferring medium;

the plurality of developing devices include a first developing device whose ratio in volume of the developer particles is R1, and a second developing device whose ratio in volume of the developer particles is R2;

the first developing device and the second developing device satisfy both of the following conditions (1) and (2):

(1) the second developing device performs development later than the first developing device; and (2) R2 is larger than R1;

the plurality of developing devices perform development according to an order in which a developing device having a smaller ratio in volume performs development earlier in order;

among the plurality of developing devices, the developing device performing development first in order contains yellow developer;

among the plurality of developing devices, the developing device performing development last in order contains black developer;

the predetermined value is 5 μm;

a coefficient of static friction of the surface of the image bearing member is larger than a coefficient of static friction of the surface of the transferring medium;

when assuming that a charge amount of the developer contained in the first developing device is E1, and a charge amount of the developer contained in the second developing device is E2, E2 is larger than E1;

the developer includes a core particle, and conductive metal oxide as an external additive associated on the core particle;

when assuming that an amount of the external additive of the developer in the first developing device is A1, and an amount of the external additive of the developer in the second developing device is A2, A2 is larger than A1;

when assuming that a charge amount of the core particle of the developer in the first developing device is M1, and a charge amount of the core particle of the developer in the second developing device is M2, M2 is larger than M1; and a volume average particle diameter of the developer in the first developing device is equal to a volume average particle diameter of the developer in the second developing device.

In this way, the object of the present invention is achieved more advantageously, because all of the effects described above are obtained.

It is also possible to provide a method for forming a color image with a color image forming apparatus having:

an image bearing member for bearing a latent image;

a plurality of developing devices, each of the developing devices containing developer that includes a predetermined ratio in volume of developer particles having a diameter of a predetermined value or less, and being capable of developing the latent image using the developer contained therein; and a transferring medium that serves as a medium when transferring the developer on the image bearing member onto a transferring material, wherein the plurality of developing devices includes a first developing device whose ratio in volume of the developer particles is R1, and a second developing device whose ratio in volume of the developer particles is R2, and wherein the first developing device and the second developing device satisfy both of the following conditions (1) and (2):

(1) the second developing device performs development later than the first developing device; and (2) R2 is larger than R1, the method comprising the step of: performing an operation of developing the latent image bore on the image bearing member with the developer using each of the developing devices, and transferring the developer on the image bearing member onto the transferring medium in a state in which the image bearing member and the transferring medium are in contact with each other, successively with each of the plurality of developing devices to superimpose different kinds of the developer onto the transferring medium.

The occurrence of hollow defects is reduced with such an image forming method.

It is also possible to provide a computer system comprising: a computer; a display device that is connectable to the computer; and a color image forming apparatus that is connectable to the computer and that has:

an image bearing member for bearing a latent image;

a plurality of developing devices, each of the developing devices containing developer that includes a predetermined ratio in volume of developer particles having a diameter of a predetermined value or less, and being capable of developing the latent image using the developer contained therein; and a transferring medium that serves as a medium when transferring the developer on the image bearing member onto a transferring material, the image forming apparatus forming a color image by performing an operation of developing the latent image bore on the image bearing member with the developer using each of the developing devices, and transferring the developer on the image bearing member onto the transferring medium in a state in which the image bearing member and the transferring medium are in contact with each other, successively with each of the plurality of developing devices to superimpose different kinds of the developer onto the transferring medium;

the plurality of developing devices including a first developing device whose ratio in volume of the developer particles is R1, and a second developing device whose ratio in volume of the developer particles is R2; and the first developing device and the second developing device satisfying both of the following conditions (1) and (2):

(1) the second developing device performs development later than the first developing device; and (2) R2 is larger than R1.

A computer system configured as above will be superior to a conventional computer system as a whole.

Detailed description will be made below with reference to the drawings.

(I) FIRST EMBODIMENT OF IMAGE FORMING APPARATUS

===Overview of Image Forming Apparatus (Laser-beam Printer) ===

Next, with reference to FIG. 1, an outline of an image forming apparatus will be described, taking a laser-beam printer 10 (hereinafter referred to as "printer") as an example. FIG. 1 is a diagram showing main structural components constructing the printer 10. Note that in FIG. 1, the vertical direction is shown by the arrow; for example, a paper supply tray 92 is arranged at a lower section of the printer 10, and a fusing unit 90 is arranged at an upper section of the printer 10.

As shown in FIG. 1, the printer 10 according to the present embodiment has the following components in the direction of rotation of a photoconductor 20, which serves as an image bearing member that bears a latent image: a charging unit 30; an exposing unit 40; a YMCK developing unit 50; a first transferring unit 60; an intermediate transferring element 70; and a cleaning unit 75. The printer 10 further has: a second transferring unit 80; a fusing unit 90; a displaying unit 95 comprising a liquid-crystal display and serving as notifying means to a user; and a control unit 100 (FIG. 2) for controlling each of these units and managing the operations as a printer.

The photoconductor 20 has a cylindrical conductive base and a photoconductive layer formed on the outer peripheral surface of the conductive base, and it is rotatable about a central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates modulated laser onto the charged photoconductor 20 according to image signals having been input from a not-shown host computer device such as a personal computer or a word processor.

The YMCK developing unit 50 is a device for developing the latent image formed on the photoconductor 20 using yellow (Y) toner, magenta (M) toner, cyan (C) toner, and black (K) toner, which serve as the developer.

The YMCK developing unit 50 has a holding frame 55, which serves as a turning member, having four holding sections 55*a*, 55*b*, 55*c*, 55*d* that hold a black developing device 51 containing the black (K) toner, a magenta developing device 52 containing the magenta (M) toner, a cyan developing device 53 containing the cyan (C) toner, and a yellow developing device 54 containing the yellow (Y) toner, respectively. The four developing devices 51, 52, 53, 54 can be rotated in one direction about a rotating shaft 50*a* of the holding frame 55 while maintaining their relative positions. Since the "turning movement" or "turn" (i.e., movement of more than 0° in either the forward or reverse rotational direction) of the YMCK developing unit 50 in the present embodiment signifies "rotating movement" or "rotation" (i.e., movement of equal to or more than 360° in one rotational direction), the movement of the YMCK developing unit 50 will be referred to simply as "rotating movement" or "rotation" below. By making each of the developing devices 51, 52, 53, 54 that corresponds to the latent image formed on the photoconductor 20 oppose the photoconductor 20 one by one, the latent image on the photoconductor 20 is developed by the toner contained in each of the developing devices 51, 52, 53, 54. Note that details on the developing devices will be described later.

The first transferring unit 60 is a device for transferring a single-color toner image formed on the photoconductor 20 onto the intermediate transferring element 70. When the toners of all four colors are successively transferred in a superimposing manner, a full-color toner image will be formed on the intermediate transferring element 70. The intermediate transferring element 70 is an endless belt that is driven to rotate at substantially the same circumferential speed as the photoconductor 20. The second transferring unit 80 is a device for transferring the single-color toner image or the full-color toner image formed on the intermediate transferring element 70 onto a medium such as paper, film, cloth, and the like.

The fusing unit 90 is a device for fusing the single-color toner image or the full-color toner image, which has been transferred onto the intermediate transferring element 70, onto the medium such as paper to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it off with the cleaning blade 76 after the toner image has been transferred onto the intermediate transferring element 70 by the first transferring unit 60.

Figure 2:
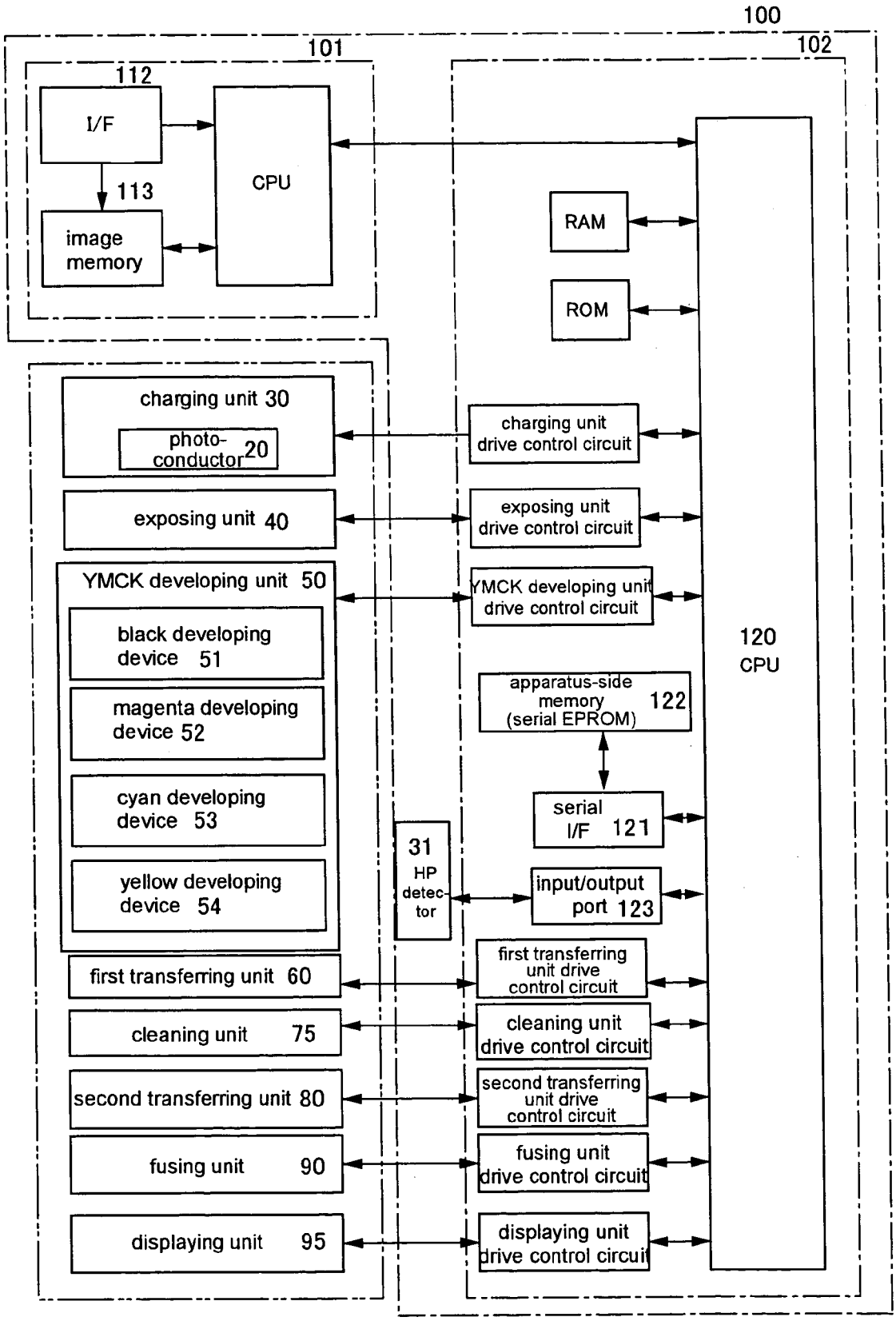
FIG. 2 is a block diagram showing a control unit in the image forming apparatus of FIG. 1.

The control unit 100 comprises a main controller 101 and a unit controller 102 as shown in FIG. 2. An image signal is input to the main controller 101. According to output commands based on the image signal, the unit controller 102 controls each of the above-mentioned units, and a medium onto which an image has been transferred is output.

Next, operations of the printer 10 structured as above will be described with reference to other structural components.

First, when an image signal is input from the not-shown host computer device to the main controller 101 of the printer 10 through an interface (I/F) 112, the photoconductor 20, a developing roller for supplying toner contained in the developing device to the photoconductor 20, and the intermediate transferring element 70 rotate under the control of the unit controller 102 based on the output commands from the main controller 101. While being rotated, the photoconductor 20 is successively charged by the charging unit 30 at a charging position.

With the rotation of the photoconductor 20, the charged area of the photoconductor 20 reaches an exposure position. A latent image that corresponds to the image information about the first color, for example yellow Y, is formed in that area by the exposing unit 40. Further, the YMCK developing unit 50 locates the yellow developing device 54, which contains yellow (Y) toner, in the developing position where the developing roller of the yellow developing device 54 opposes the photoconductor 20.

With the rotation of the photoconductor 20, the latent image formed on the photoconductor 20 reaches the developing position, and is developed with the yellow toner supplied by the developing roller of the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring unit 60. At this time, a first transferring voltage, which is in an opposite polarity to the polarity to which the toner is charged, is applied to the first transferring unit 60. It should be noted that, during the above-mentioned processes, the second transferring unit 80 is kept separated from the intermediate transferring element 70.

By repeating the above-mentioned processes for the second, the third, and the fourth colors, toner images in four colors corresponding to the respective image signals are transferred to the intermediate transferring element 70 in a superimposed manner. As a result, a full-color toner image is formed on the intermediate transferring element 70.

With the rotation of the intermediate transferring element 70, the full-color toner image formed on the intermediate transferring element 70 reaches a second transferring position, and is transferred onto paper, serving as a medium, by the second transferring unit 80. It should be noted that the paper is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring element 70.

The full-color toner image transferred onto the paper is heated and pressurized by the fusing unit 90 and fused to the paper.

On the other hand, after the photoconductor 20 passes the first transferring position, the toner adhering to the surface of the photoconductor 20 is scraped off by the cleaning blade 76 that is supported on the cleaning unit 75, and the photoconductor 20 is prepared for charging for forming a next latent image. The scraped-off toner is collected in a remaining-toner collector that the cleaning unit 75 comprises.

It should be noted that the photoconductor 20 is made into a unit along with the charging unit 30 and the cleaning unit 75 and can be attached to and detached from the printer 10 as a unit. Further, each of the black developing device 51, the magenta developing device 52, the cyan developing device 53, and the yellow developing device 54 is structured so that it can be attached to and detached from the printer 10 individually.

===Overview of Developing Device ===

Figure 3:
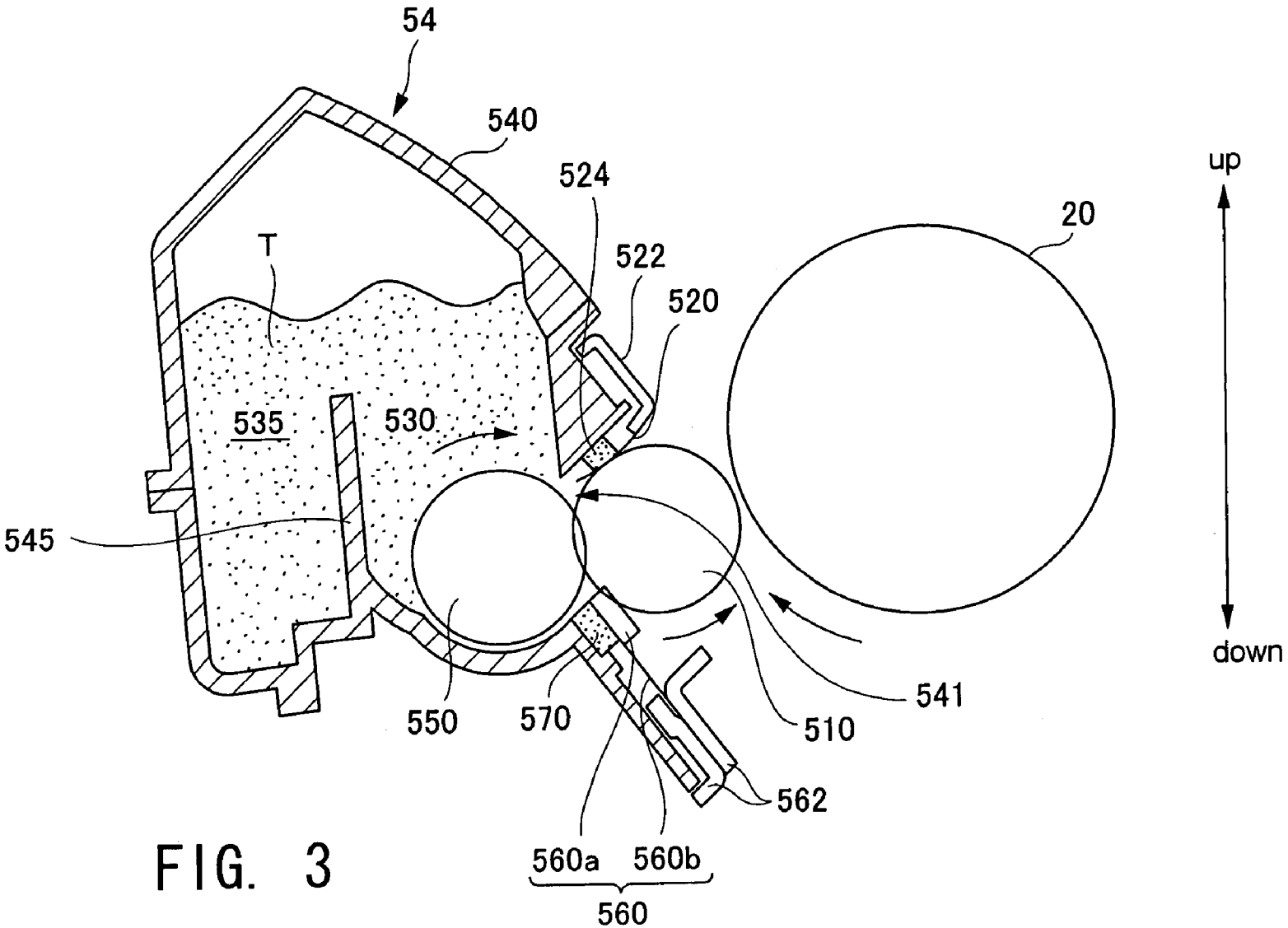
FIG. 3 is a diagram for describing the structure of a developing device.

Next, with reference to FIG. 3, an overview of the developing device will be described. FIG. 3 is a section view showing main structural components of the developing device. It should be noted that, in FIG. 3, the arrow indicates the vertical direction at the developing position as in FIG. 1; for example, the central axis of the developing roller 510 is located below the central axis of the photoconductor 20. Further, FIG. 1 shows a state in which the yellow developing device 54 is located in the developing position opposing the photoconductor 20.

The YMCK developing unit 50 comprises: the black developing device 51 containing black (K) toner; the magenta developing device 52.containing magenta (M) toner; the cyan developing device 53 containing cyan (C) toner; and the yellow developing device 54 containing yellow (Y) toner. Since the configuration of each of the developing devices is the same, below, explanation will be made only of the yellow developing device 54.

The yellow developing device 54 has, in a housing 540 containing yellow toner T as the developer, a developing roller 510 for supplying the developer to the photoconductor 20, a toner-supplying roller 550 for supplying the toner T to the developing roller 510, a restriction blade 560 for restricting the thickness of the layer of toner T bore by the developing roller 510, and a sealing member 520 for preventing the toner T from escaping from the housing 540. The developing roller 510 and the toner-supplying roller 550 together form a developer supplying section for supplying the toner inside the developing device to the photoconductor 20.

The housing 540 is made by welding together, for example, an upper housing and a lower housing that are each integrally molded. The interior of the housing 540 is divided into a first developer container 530 and a second developer container 535 by a restriction wall 545 that extends upward (the vertical direction in FIG. 3) from the bottom portion of the housing 540. The upper portions of the first container 530 and the second container 535 are connected, and the restriction wall 545 restricts the movement of the toner T. Each of the developing devices makes one revolution along with the rotation of the YMCK developing unit 50. During this process, all of the toner, including the toner contained in the first container 530 and the second container 535 when the developing device is in the developing position, is gathered in the area where the containers 530 and 535 are connected (i.e., the upper portion when the developing device is in the developing position), and the toner will be mixed and returned either to the first container 530 or the second container 535 when the developing device returns to the developing position. That is, the toner in the developing device is stirred by the rotation of the YMCK developing unit 50; the toner that is in the first container 530 and that has caused deterioration is mixed with the toner that is in the second container 535 and that has not caused much deterioration, and thereby characteristics of the toner in the developing device is made uniform.

For this reason, no stirring member is provided in the first developer container 530 and the second developer container 535 in the present embodiment. However, it is possible to provide a stirring member for stirring the toner T contained in the first developer container 530 and the second developer container 535.

An opening 541 that opens toward the outside of the housing 540 is provided at the lower portion of the first developer container 530. The toner-supplying roller 550 is provided in the first developer container 530 in such a manner that its periphery faces the opening 541 and that it is rotatably supported on the housing 540. From the outside of the housing 540 is provided the developing roller 510 in such a manner that its periphery faces the opening 541 and that the developing roller 510 abuts and presses against the toner-supplying roller 550. It should be noted that the sealing member 520 is provided in the opening 541 so as to prevent the toner from escaping from between the developing roller 510 and the housing 540 that forms the opening 541.

The developing roller 510 bears toner T and delivers it to a developing position opposing the photoconductor 20. The developing roller 510 is made of, for example, aluminum, stainless steel, or iron. If necessary, the roller 510 is plated with, for example, nickel plating or chromium plating, and the toner bearing region of the roller 510 is subjected to sandblasting. Further, the developing roller 510 is rotatable about its central axis, and as shown in FIG. 3, the developing roller 510 rotates in the opposite direction (counterclockwise in FIG. 3) to the rotating direction of the photoconductor 20 (clockwise in FIG. 3). The central axis of the roller 510 is located below the central axis of the photoconductor 20.

Further, as shown in FIG. 3, in the state where the yellow developing device 54 opposes the photoconductor 20, there is a gap between the developing roller 510 and the photoconductor 20. That is, the yellow developing device 54 develops the latent image formed on the photoconductor 20 in a non-contacting state. Note that an alternating field is generated between the developing roller 510 and the photoconductor 20 upon developing the latent image formed on the photoconductor 20.

The toner-supplying roller 550 supplies the toner T contained in the first developer container 530 to the developing roller 510. The toner-supplying roller 550 is made of, for example, polyurethane foam, and is made to abut against the developing roller 510 in an elastically deformed state. The toner-supplying roller 550 is arranged at a lower section of the toner container 530. The toner T contained in the toner container 530 is supplied to the developing roller 510 by the toner-supplying roller 550 at the lower section of the toner container 530. The toner-supplying roller 550 is rotatable about a central axis. The central axis of the toner-supplying roller 550 is situated below the central axis of rotation of the developing roller 510. Further, the toner-supplying roller 550 rotates in the opposite direction (clockwise in FIG. 3) to the rotating direction of the developing roller 510 (counter-clockwise in FIG. 3). Note that the toner-supplying roller 550 has the function of supplying the toner T contained in the toner container 530 to the developing roller 510 as well as the function of stripping the toner remaining on the developing roller 510 after development off from the developing roller 510.

The restriction blade 560 restricts the thickness of the layer of the toner T bore by the developing roller 510 and also gives charge to the toner T bore by the developing roller 510. This restriction blade 560 has a rubber portion 560*a* and a rubber-supporting portion 560*b*. The rubber portion 560*a* is made of, for example, silicone rubber or urethane rubber. The rubber-supporting portion 560*b* is a thin plate that is made of, for example, phosphor bronze or stainless steel, and that has a springy characteristic. The rubber portion 560*a* is supported by the rubber-supporting portion 560*b*. The rubber-supporting portion 560*b* is attached to the housing 540 via a pair of blade-supporting metal plates 562 in a state that one end of the rubber-supporting portion 560*b* is pinched between and supported by the blade-supporting metal plates 562. Further, a blade-backing member 570 made of, for example, Moltoprene is provided on one side of the restriction blade 560 opposite to the side of the developing roller 510.

The rubber portion 560*a* is pressed against the developing roller 510 by the elastic force caused by the flexure of the rubber-supporting portion 560*b*. Further, the blade-backing member 570 prevents the toner from entering between the rubber-supporting portion 560*b* and the housing 540, stabilizes the elastic force caused by the flexure of the rubber-supporting portion 560*b*, and also, applies force to the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly.

The end, i.e., the tip end of the restricting blade 560 opposite to the end that is being supported by the blade-supporting metal plates 562 is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces towards the upper stream of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner-supplying roller 550.

As described above, the housing 540 is made by welding together a plurality of housings (an upper housing, a lower housing, etc.) that are each integrally molded, and has an opening 541 at its lower portion. The developing roller 510 is arranged in the opening 541 such that a portion of it is exposed to the outside.

In the yellow developing device 54 thus structured, the toner-supplying roller 550 supplies the toner T contained in the first developer container 530 to the developing roller 510. With the rotation of the developing roller 510, the toner T, which has been supplied to the developing roller 510, reaches the abutting position of the restriction blade 560; then, as the toner T passes the abutting position, the toner is charged and its thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. When passing by the sealing member 520, the toner T on the developing roller 510, which has passed the developing position with further rotation of the developing roller 510, is collected into the developing device by the sealing member 520 without being scraped off.

===Overview of the YMCK Developing Unit and Relative Position with Respect to Image Forming Apparatus ===

Next, with reference to FIG. 1 and FIG. 4, an overview of the YMCK developing unit 50 will be described.

The YMCK developing unit 50 has a rotating shaft 50*a* that is positioned in the center of the unit 50. The rotating shaft 50*a* is provided on the holding frame 55 for holding the developing devices. Both ends of the shaft 50*a* are supported so that the shaft 50*a* extends between two frame side plates (not shown) that form a housing of the printer 10.

In the holding frame 55, the four holding sections 55*a*, 55*b*, 55*c*, 55*d* in which the developing devices 51, 52, 53, 54 for the four colors are removably held are arranged radially about the rotating shaft 50*a* at 90° intervals in the circumferential direction.

A pulse motor (not shown) is connected to the rotating shaft 50*a* via a clutch. Driving the pulse motor makes the holding frame 55 rotate to allow the four developing devices 51, 52, 53, 54 to be located in predetermined positions.

Figure 4A:
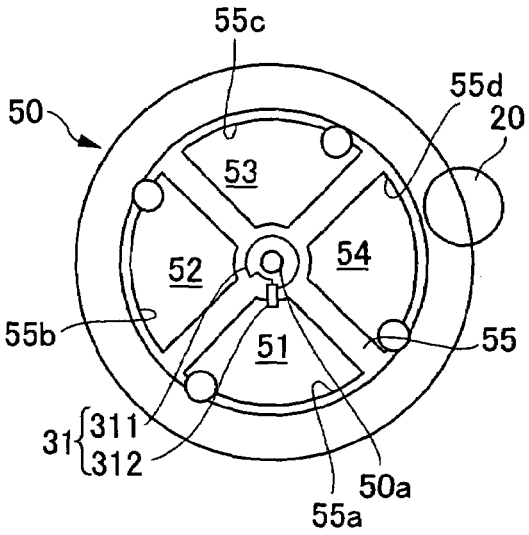
FIG. 4A is a diagram for describing the standby position of a YMCK developing unit 50.
Figure 4B:
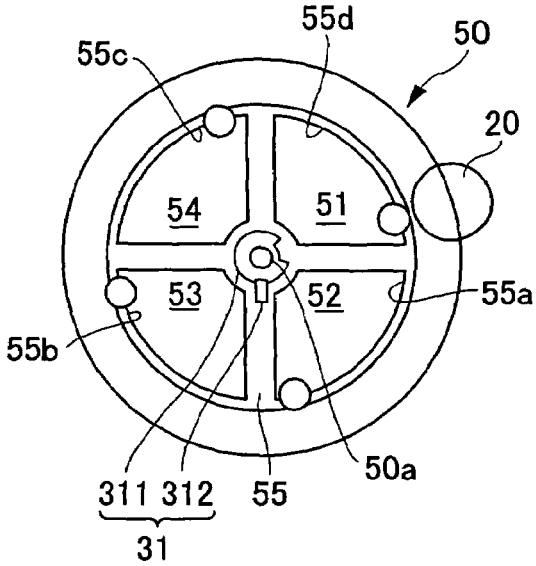
FIG. 4B is a diagram for describing the developing position of a black developing device.

FIG. 4A and FIG. 4B are diagrams showing the stopping positions of the rotating YMCK developing unit 50. FIG. 4A shows the home position (referred to as "HP position" herein) that is the reference position in the rotating direction of the YMCK developing unit 50, and FIG. 4B shows the developing position when the black developing device 51 is used for development. The position shown in FIG. 4B is the developing position for the black developing device 51; however, by successively rotating the YMCK developing unit 50 at 90° intervals, the position shown in FIG. 4B becomes the developing position for the other developing devices.

As shown in FIG. 4A, an HP detector 31 for detecting the HP position is provided on one end of the rotating shaft 50*a* of the YMCK developing unit 50. The HP detector 31 is structured of a disk 311 that is for generating signals and that is fixed to one end of the rotating shaft 50*a*, and an HP sensor 312 that comprises, for example, a photointerrupter having a light emitting section and a light receiving section.

The circumference of the disk 311 is arranged so that it is positioned between the light emitting section and the light receiving section of the HP sensor 312. When the slit formed in the disk 311 comes into the detecting position of the HP sensor 312, the signal output from the HP sensor 312 changes from "L" to "H". The HP position of the YMCK developing unit 50 is detected based on this change in the signal level, and also, the unit controller 102, which also functions as a counter, counts the number of times of changes in the signal to count the number of times of rotations of the holding frame 55. When performing color printing, the holding frame 55 of the YMCK developing unit 50 rotates once in order to make each of the four developing devices 51, 52, 53, 54 oppose the photoconductor 20 for printing on one sheet of paper; at this time, "1" is added to the count value of the number of times of rotations. On the other hand, for example, when performing single-color printing using black toner, the position of the developing devices does not move; therefore, the holding frame 55 may not necessarily rotate once for printing on one sheet of paper. That is, when continuously printing on several sheets of paper using black toner, the holding frame 55 rotates only once for one print job, regardless of the number of sheets that are output.

It should be noted that a locking mechanism (not shown) is provided in order to reliably position and fix the YMCK developing unit 50 in the developing position.

===Overview of Control Unit ===

Next, with reference to FIG. 2, the configuration of the control unit 100 will be described. The main controller 101 of the control unit 100 is connected to a host computer device (not shown) through the interface (I/F) 112 and comprises an image memory 113 for storing image signals that have been input from the host computer device. The unit controller 102 controls each of the units of the main apparatus (i.e., the charging unit 30, the exposing unit 40, the YMCK developing unit 50, the first transferring unit 60, the cleaning unit 75, the second transferring unit 80, the fusing unit 90, and the displaying unit 95) according to the signals input from the main controller 101.

Further, the CPU 120 of the unit controller 102 is connected to a nonvolatile storage element 122 (referred to as "apparatus-side memory" below) such as a serial EEPROM used for an electronic counter via a serial interface (I/F) 121. The CPU 120 is also connected to the HP detector 31 via an input/output port 123.

The apparatus-side memory 122 stores developing device information about the developing device that is to be attached to each holding section and data that is necessary for controlling the apparatus. Further, the apparatus-side memory 122 has a "number-of-rotations storage area" for storing the number of times of rotations of the holding frame 55, a "number-of-output-sheets storage area" for storing the number of sheets of paper output by the printer, and a "number-of-sheets-to-print storage area" for counting the number of sheets to print during execution of one print job.

===Operation of Image Forming Apparatus ===

Figure 5:
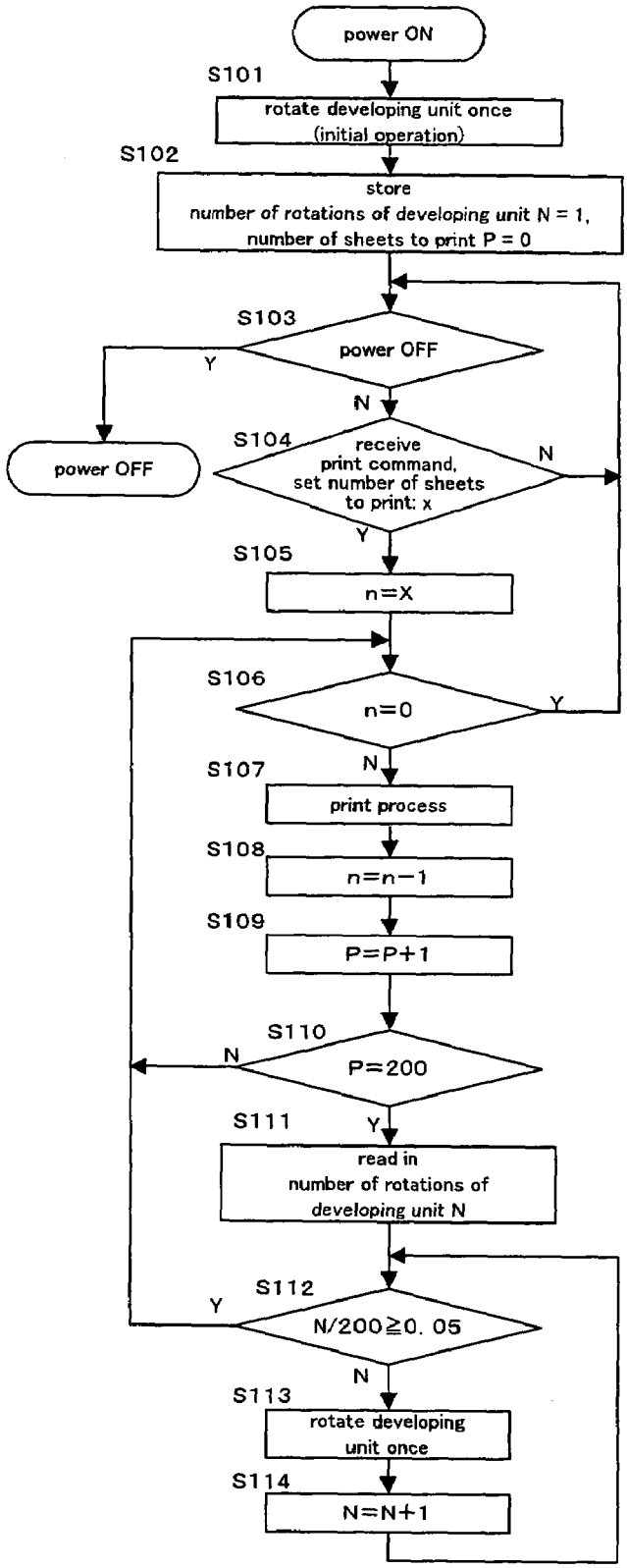
FIG. 5 is a flowchart showing an embodiment in a process of the image forming apparatus.

FIG. 5 is a flowchart showing an embodiment in a process of the image forming apparatus.

In the present embodiment, description will be made of an example in which, when the total number of sheets of paper output from the time when the printer 10 is turned ON reaches "200", the number of times of rotations of the YMCK developing unit 50 for the total number of output sheets is compared with a reference value, and the YMCK developing unit 50 is rotated if necessary. In the present embodiment, the reference value is set to 0.05 (rotations/sheet), and shortage in the number of times of rotations is adjusted when the total number of output sheets reaches two hundred (200) so that the number of times of rotations of the YMCK developing unit 50 for twenty (20) output sheets is at least once.

When the power of the printer 10 is turned ON, the YMCK developing unit 50 carries out its initial operation, that is, it rotates once and stops at the HP position (S101). At this time, each of the units in the printer 10 executes its initial operation, "1" is stored in the number-of-rotations storage area of the apparatus-side memory 122 since the HP detector 31 detects the rotating operation of the YMCK developing unit 50, and "0" is stored in the number-of-output-sheets storage area (S102). Then the printer enters a standby state, or a so-called "READY" state, in which it waits for print commands that instruct the printer to form images and output paper. Further, after entering this READY state, "1" is added to the value in the number-of-rotations storage area every time the HP detector 31 detects a rotating operation of the YMCK developing unit 50, and the number of times of rotations is stored as a turn history.

For example, when the printer 10 receives, from an external computer connected thereto, a print command instructing the number of sheets to print x which indicates the number of sheets to be printed (S104), the unit controller 102 stores the number of sheets to print x in the number-of-sheets-to-print storage area that is set in the apparatus-side memory 122 and that is for counting the number of sheets to print (S105). The value stored in the number-of-sheets-to-print storage area is decremented by "1" and rewritten every time a print process is executed. That is, as for the print job instructed by the print command to print x sheets, the print process is repeated until the value in the number-of-sheets-to-print storage area reaches "0".

When the first print process is executed (S107), the value in the number-of-sheets-to-print storage area is rewritten to a value "x−1" (S108), and "1" is stored in the number-of-output-sheets storage area that is set in the apparatus-side memory 122 (S109). Then, the value stored in the number-of-output-sheets storage area is compared with the value "200", which is set as the threshold for determining whether or not to rotate the YMCK developing unit 50 (S110). If the value is less than "200", the print process is repeated (S107), and the value in the number-of-sheets-to-print storage area and the value in the number-of-output-sheets storage area are rewritten according to the print processes (S108, S109).

If the value in the number-of-sheets-to-print storage area becomes "0" before the value in the number-of-output-sheets storage area reaches "200", then the printer stands-by in the READY state. On the other hand, if the value in the number-of-output-sheets storage area reaches "200" before the value in the number-of-sheets-to-print storage area becomes "0", that is, in the middle of a print job, the unit controller 102 reads in the value N in the number-of-rotations storage area of the apparatus-side memory 122 (S111). Then, the unit controller 102 calculates a turn value of the YMCK developing unit 50 with respect to the total number of output sheets "200" (i.e., N/200), and the calculated turn value is compared with the preset reference value "0.05" (S112). If the calculated value is smaller than the reference value "0.05", the YMCK developing unit 50 is rotated once and "1" is added to the value in the number-of-rotations storage area. Then the turn value of the YMCK developing unit 50 with respect to the total number of output sheets "200" (i.e., N/200) is calculated using the value in the number-of-rotations storage area after addition, and the calculated value is compared with the reference value "0.05" (S112). This process is repeated until the calculation result becomes equal to or larger than "0.05". When the calculation result becomes equal to or larger than "0.05", the flow returns to the print process, and the interrupted print job is restarted (S107 through S109). On the other hand, if the value in the number-of-sheets-to-print storage area becomes "0" when the calculation result becomes equal to or larger than "0.05", the printer stands-by in the READY state (S106).

FIG. 6 is a diagram showing the contents of print jobs for explaining the operations described above. Here, three examples TYPE 1 through TYPE 3 are shown. FIG. 6 show tables that indicate print jobs that are received as print commands. Here, it is assumed that the print jobs are received in the order of the job numbers. In the figure, "mode: mono", "number of sheets: 10" in JOB 1 indicates a print command instructing to continuously print ten sheets of paper according to the monochrome printing mode using only the black developing device. During this job, the YMCK developing unit 50 does not rotate, except for the operation for positioning the developing devices. Further, in the figure, "mode: color", "number of sheets: 5" in JOB 2 indicates a print command instructing to continuously print five sheets of paper according to the color printing mode using each of the developing devices. During this job, other than the operation for positioning the developing devices, the YMCK developing unit 50 rotates once every time paper is output. The characteristic parts during execution of these jobs will be described below.

TYPE 1

In the READY state, "0" is stored in the number-of-output-sheets storage area, and "1" is stored in the number-of-rotations storage area. When JOB 1 is executed, the number of output sheets "10", is added to the value in the number-of-output-sheets storage area, and "1" is added to the value in the number-of-rotations storage area because the HP detector 31 detects the rotation of the YMCK developing unit 50 caused by the positioning operation. That is, at the end of JOB 1, "10" is stored in the number-of-output-sheets storage area, and "2" is stored in the number-of-rotations storage area. Since the value in the number-of-output-sheets storage area has not reached "200", the printer returns to the READY state and executes JOB 2.

In JOB 2, the number of output sheets "5" is added to the value in the number-of-output-sheets storage area, and "5" is added to the value in the number-of-rotations storage area because the HP detector 31 detects the rotation of the YMCK developing unit 50 caused by the print processes. That is, at the end of JOB 2, "15" is stored in the number-of-output-sheets storage area, and "7" is stored in the number-of-rotations storage area. Since the value in the number-of-output-sheets storage area has not reached "200", the printer returns to the READY state and executes JOB 3.

As the jobs are executed in this way, the value in the number-of-output-sheets storage area reaches "200" at the end of JOB 8. Then, the value "15", stored in the number-of-rotations storage area is read in, the turn value (i.e., 15/200), which is indicative of the number of times of rotations of the YMCK developing unit 50 with respect to the total number of output sheets "200", is calculated, and the calculated value is compared with the reference value "0.05". As a result, since the calculated turn value (15/200) is larger than the reference value "0.05", the printer returns to the READY state without rotating the YMCK developing unit 50.

TYPE 2

In the READY state, "0" is stored in the number-of-output-sheets storage area, and "1" is stored in the number-of-rotations storage area. When JOB 1 is executed, the number of output sheets "40", is added to the value in the number-of-output-sheets storage area, and "1" is added to the value in the number-of-rotations storage area because the HP detector 31 detects the rotation of the YMCK developing unit 50 caused by the positioning operation. That is, at the end of JOB 1, "40" is stored in the number-of-output-sheets storage area, and "2" is stored in the number-of-rotations storage area. Since the value in the number-of-output-sheets storage area has not reached "200", the printer returns to the READY state and executes JOB 2.

In JOB 2, the number of output sheets "160", is added to the value in the number-of-output-sheets storage area, and "1" is added to the value in the number-of-rotations storage area because the HP detector 31 detects the rotation of the YMCK developing unit 50 caused by the positioning operation. That is, at the end of JOB 2, "200" is stored in the number-of-output-sheets storage area, and "3" is stored in the number-of-rotations storage area. Since the value in the number-of-output-sheets storage area has reached "200", the value "3" stored in the number-of-rotations storage area is read in, the turn value (3/200) is calculated, and the calculated value is compared with the reference value "0.05". As a result, since the turn value (3/200) is smaller than the reference value "0.05", the YMCK developing unit 50 is rotated once, and "4", is stored in the number-of-rotations storage area. Then, the value "4" stored in the number-of-rotations storage area is read in, the turn value (4/200) is calculated, and the calculated value is compared with the reference value "0.05". As a result, since the turn value (4/200) is smaller than the reference value "0.05", the YMCK developing unit 50 is rotated once, and "5" is stored in the number-of-rotations storage area. In this way, the comparison between the turn value and the reference value, the rotating operation of the YMCK developing unit 50, and the rewriting of the value in the number-of-rotations storage area are repeated until the turn value becomes equal to or larger than the reference value. It should be noted that, since TYPE 3 is similar to TYPE 2, explanation thereof is omitted.

FIRST MODIFIED EXAMPLE

In order to reduce the number of times for which the rotating operation of the YMCK developing unit 50 is repeated as in TYPE 2 and TYPE 3, it is possible to execute a process of making the YMCK developing unit 50 rotate once at least either at the beginning or the end of each job. Below, an example in which the process of making the YMCK developing unit 50 rotate once is added at the beginning and the end of each job is described, taking TYPE 2 as the example.

TYPE 2

In the READY state, "0" is stored in the number-of-output-sheets storage area, and "1" is stored in the number-of-rotations storage area. When JOB 1 is executed, the number of output sheets "40" is added to the value in the number-of-output-sheets storage area, and "3" is added to the value in the number-of-rotations storage area because the HP-detector 31 detects the rotations of the YMCK developing unit 50 caused by the positioning operation and the rotations at the beginning and the end of JOB 1. That is, at the end of JOB 1, "40" is stored in the number-of-output-sheets storage area, and "4" is stored in the number-of-rotations storage area. Since the value in the number-of-output-sheets storage area has not reached "200", the printer returns to the READY state and executes JOB 2.

In JOB 2, the number of output sheets "160", is added to the value in the number-of-output-sheets storage area, and "3" is added to the value in the number-of-rotations storage area because the HP detector 31 detects the rotations of the YMCK developing unit 50 caused by the positioning operation and the rotations at the beginning and the end of JOB 2. That is, at the end of JOB 2, "200" is stored in the number-of-output-sheets storage area, and "7" is stored in the number-of-rotations storage area. Since the value in the number-of-output-sheets storage area has reached "200", the value "7" stored in the number-of-rotations storage area is read in, the turn value (7/200) is calculated, and the calculated value is compared with the reference value "0.05". As a result, since the turn value (7/200) is smaller than the reference value "0.05", the YMCK developing unit 50 is rotated once, and "8" is stored in the number-of-rotations storage area. Then, the value "8" stored in the number-of-rotations storage area is read in, the turn value (8/200) is calculated, and the calculated value is compared with the reference value "0.05". As a result, since the turn value (8/200) is smaller than the reference value "0.05", the YMCK developing unit 50 is rotated once, and "9" is stored in the number-of-rotations storage area. In this way, the comparison between the turn value and the reference value, the rotating operation of the YMCK developing unit 50, and the rewriting of the value in the number-of-rotations storage area are repeated until the turn value becomes equal to or larger than the reference value, that is, until the turn value reaches "10".

SECOND MODIFIED EXAMPLE

In order to further reduce the number of times for which the rotating operation of the YMCK developing unit 50 is repeated, in addition to the First Modified Example in which the YMCK developing unit 50 is rotated once at least either at the beginning or the end of each job, it is possible to execute the rotating operation of the YMCK developing unit 50 when print processes using the black developing device 51 are continuously executed for a predetermined number of sheets. Below, an example in which the process of making the YMCK developing unit 50 rotate once is added every time print processes using the black developing device 51 are continuously executed for fifty (50) sheets, taking TYPE 2 and TYPE 3 as examples.

TYPE 2

In the READY state, "0" is stored in the number-of-output-sheets storage area, and "1" is stored in the number-of-rotations storage area. When JOB 1 is executed, the number of output sheets of paper "40" is added to the value in the number-of-output-sheets storage area, and "3" is added to the value in the number-of-rotations storage area because the HP detector 31 detects the rotations of the YMCK developing unit 50 caused by the positioning operation and the rotations at the beginning and the end of JOB 1. That is, at the end of JOB 1, "40" is stored in the number-of-output-sheets storage area, and "4" is stored in the number-of-rotations storage area. In JOB 1, print processes using the black developing device 51 is continuously executed for forty (40) sheets, but the number of sheets has not reached the preset number of sheets "50"; therefore, the YMCK developing unit 50 is not additionally rotated. Further, since the value in the number-of-output-sheets storage area has not reached "200", the printer returns to the READY state and executes JOB 2.

In JOB 2, the number of output sheets "160", is added to the value in the number-of-output-sheets storage area. In the number-of-rotations storage area, "6", is added because the HP detector 31 detects the rotating operations of the YMCK developing unit 50 caused by the positioning operation, the rotations of the YMCK developing unit 50 at the beginning and the end of JOB 2, and the rotations executed when fifty (50) sheets have been printed, when a hundred (100) sheets have been printed, and when a hundred and fifty (150) sheets have been printed. Therefore, at the end of JOB 2, "200" is stored in the number-of-output-sheets storage area, and "10" is stored in the number-of-rotations storage area. Since the value in the number-of-output-sheets storage area has reached "200", the value "10" stored in the number-of-rotations storage area is read in, the turn value (10/200) is calculated, and the calculated value is compared with the reference value "0.05". As a result, since the turn value (10/200) is equal to the reference value "0.05", the printer returns to the READY state without rotating the YMCK developing unit 50.

TYPE 3

In the READY state, "0" is stored in the number-of-output-sheets storage area, and "1" is stored in the number-of-rotations storage area. When JOB 1 is executed, the number of output sheets "200" is added to the value in the number-of-output-sheets storage area. In the number-of-rotations storage area, "6" is added because the HP detector 31 detects the rotating operations of the YMCK developing unit 50 caused by the positioning operation, the rotations of the YMCK developing unit 50 at the beginning and the end of JOB 1, and the rotations executed when fifty (50) sheets have been printed, when a hundred (100) sheets have been printed, when a hundred and fifty (150) sheets have been printed, and when two hundred (200) sheets have been printed. Therefore, at the end of JOB 1, "200" is stored in the number-of-output-sheets storage area, and "7" is stored in the number-of-rotations storage area. Since the value in the number-of-output-sheets storage area has reached "200", the value "7", stored in the number-of-rotations storage area is read in, the turn value (7/200) is calculated, and the calculated value is compared with the reference value "0.05" (S112). As a result, since the turn value (7/200) is smaller than the reference value "0.05", the YMCK developing unit 50 is rotated once, and "8" is stored in the number-of-rotations storage area. Then, the value "8" stored in the number-of-rotations storage area is read in, the turn value (8/200) is calculated, and the calculated value is compared with the reference value "0.05". As a result, since the turn value (8/200) is smaller than the reference value "0.05", the YMCK developing unit 50 is rotated once, and "9" is stored in the number-of-rotations storage area. In this way, the comparison between the turn value and the reference value, the rotating operation of the YMCK developing unit 50, and the rewriting of the value in the number-of-rotations storage area are repeated until the turn value becomes equal to or larger than the reference value, that is, until the turn value reaches "10".

THIRD MODIFIED EXAMPLE

Figure 7:
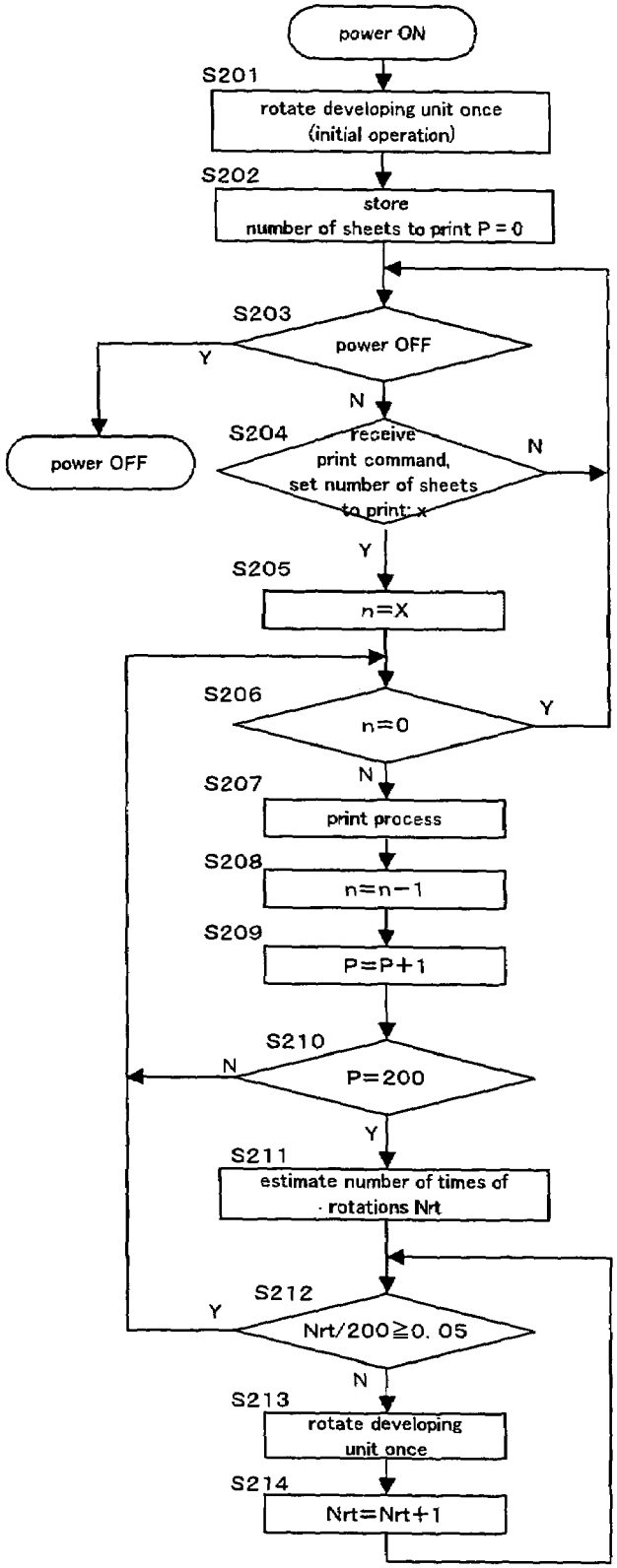
FIG. 7 is a flowchart showing a third modified example in a process of the image forming apparatus.

FIG. 7 is a flowchart showing a third modified example in a process of the image forming apparatus.

In the example above, the number of times of rotations of the YMCK developing unit 50 is counted using the HP detector 31. However, in the present third modified example, an HP detector 31 is not used, and instead, the number of times of rotations of the YMCK developing unit 50 is estimated based on the print command. That is, description will be made of an example in which, when the total number of sheets of paper output from the time when the printer 10 is turned ON reaches "200", the turn value is calculated based on an estimated number of times of rotations of the YMCK developing unit 50 for the total number of output sheets, the turn value is compared with a reference value, and the YMCK developing unit 50 is rotated if necessary. In the present example, shortage in the number of times of rotations is adjusted by setting the reference value to 0.05 (rotations/sheet) so that, when the total number of output sheets reaches "200", the estimated number of times of rotations of the YMCK developing unit 50 for 20 output sheets is at least once.

When the power of the printer 10 is turned ON, the YMCK developing unit 50 carries out its initial operation, that is, it rotates once and stops at the HP position (S201). At this time, each of the units in the printer 10 executes its initial operation, and "0" is stored in the storage area for storing the number of sheets of paper to be output (S202). Then the printer enters a standby state, or a so-called "READY" state, in which it waits for print commands that instruct the printer to form images and output paper.

For example, when the printer 10 receives, from an external computer connected thereto, a print command along with information about the number of sheets to print x, which indicates the number of sheets to be printed, and information about which of the color printing mode or the monochrome printing mode is to be used (S204), the unit controller 102 stores the number of sheets to print x in the number-of-sheets-to-print storage area that is set in the apparatus-side memory 122 and that is for counting the number of sheets to print (S205). The value stored in the number-of-sheets-to-print storage area is decremented by "1" and rewritten every time a print process is executed. That is, as for the print job instructed by the print command to print x sheets, the print process is repeated until the value in the number-of-sheets-to-print storage area reaches "0".

When the first print process is executed (S207), the value in the number-of-sheets-to-print storage area is rewritten to a value "x−1" (S208), and "1" is stored in the number-of-output-sheets storage area that is set in the apparatus-side memory 122 (S209). Then, the value stored in the number-of-output-sheets storage area is compared with the value "200", which is set as the threshold for determining whether or not to rotate the YMCK developing unit 50 (S210). If the value is less than "200", the print process is repeated (S207), and the value in the number-of-sheets-to-print storage area and the value in the number-of-output-sheets storage area are rewritten (S208, S209).

If the value in the number-of-sheets-to-print storage area becomes "0" before the value in the number-of-output-sheets storage area reaches "200", then the printer stands-by in the READY state. On the other hand, if the value in the number-of-output-sheets storage area reaches "200" before the value in the number-of-sheets-to-print storage area becomes "0", that is, in the middle of a print job, the unit controller 102 estimates, as a turn history, the estimated number of times of rotations Nrt of the YMCK developing unit 50 based on the print history (S211). The method by which the number of times of rotations is estimated will be described later. Based on the estimated number of times of rotations Nrt, the number of times of rotations of the YMCK developing unit 50 with respect to the total number of output sheets "200" (i.e., Nrt/200) is calculated, and the calculated value is compared with the preset reference value "0.05" (S212). If the calculated value is smaller than the reference value "0.05", then the YMCK developing unit 50 is rotated once (S213), and "1" is added to the estimated number of times of rotations Nrt to obtain a new estimated number of times of rotations Nrt (S214). Then, the number of times of rotations of the YMCK developing unit 50 with respect to the total number of output sheets "200" (i.e., Nrt/200) is calculated using the new estimated number of times of rotations Nrt after addition, and the calculated value is compared with the reference value "0.05" (S212). This process is repeated until the calculation result becomes equal to or larger than "0.05". When the calculation result becomes equal to or larger than "0.05", the flow returns to the print process. If the value in the number-of-sheets-to-print storage area is not "0", this indicates that the printer is in the middle of a print job, and therefore this job is continued (S207 through S209). On the other hand, if the value in the number-of-sheets-to-print storage area is "0", the printer stands-by in the READY state (S206).

Estimation of Number of Times of Rotations

First, description will be made of an example in which estimation is carried out when the total number of output sheets becomes "200", regardless of whether the print mode is the monochrome printing mode or the color printing mode.

For example, assuming that the YMCK developing unit 50 rotates once during the initial operation, and the number of times of one full rotation executed according to a monochrome printing job is Nm and the number of times of one full rotation executed according to a color printing job is Nc (=number of output sheets) until two hundred (200) sheets are output after the initial operation, calculation according to the following equation (equation 1) is performed for the estimated number of times of rotations Nrt of the YMCK developing unit 50:

$$Nrt=Nm+Nc+1 \quad \text{(equation 1)}$$

Here, if Pm sheets are output according to the monochrome printing mode until, for example, two hundred (200) sheets are output, and the YMCK developing unit 50 is rotated once every time S sheets are output according to monochrome printing, calculation according to the following equation (equation 2) is performed for the estimated number of times of rotations Nrt of the YMCK developing unit 50:

$$Nrt=(Pm/S)+Nc+1 \quad \text{(equation 2)}$$

Further, if Jm jobs (each job outputting Pmj sheets) for executing monochrome printing are received and Pmj sheets (j being a variable) are output during each job until, for example, two hundred (200) sheets are output, and if a process of rotating the YMCK developing unit 50 once at the beginning and the end of each monochrome printing job is added, calculation according to the following equation (equation 3) is performed for the estimated number of times of rotations Nrt. Note that the total number of sheets output according to the color printing mode is Pc. Further, note that the number of times of rotations by which the YMCK developing unit 50 is rotated at the beginning and the end of each monochrome printing job is three times: that is, once at the beginning, once at the end, and once for positioning the developing devices.

$$Nrt=1+3\times Jm+Pc+Pm1/S+Pm2/S+\ldots+Pmj/S \quad \text{(equation 3)}$$

The number of times of rotations is estimated according to equation 3, using the three examples shown in FIG. 6 described above. Note that the YMCK developing unit 50 is rotated once every time fifty (50) sheets are continuously printed according to monochrome printing.

TYPE 1

In TYPE 1, the number of jobs according to monochrome printing is four (4), and the YMCK developing unit 50 makes a full rotation twice during JOB 3 and once during JOB 4. Further, the total number of sheets output according to the color printing mode is ten (10). Therefore:

$$Nrt=1+3\times 4+10+2+1=26$$

According to equation 3, it is estimated that the YMCK developing unit 50 rotates twenty six (26) times until it prints two hundred (200) sheets.

TYPE 2

In TYPE 2, the number of jobs according to monochrome printing is two (2), and the YMCK developing unit 50 makes a full rotation three times during JOB 2. No job according to color printing is included. Therefore:

$$Nrt=1+3\times 2+3=10$$

According to equation 3, it is estimated that the YMCK developing unit 50 rotates ten (10) times until it prints two hundred (200) sheets.

TYPE 3

In TYPE 3, the number of jobs according to monochrome printing is one (1), and the YMCK developing unit 50 makes a full rotation four times during JOB 1. No job according to color printing is included. Therefore:

$$Nrt=1+3\times 1+4=8$$

According to equation 3, it is estimated that the YMCK developing unit 50 rotates eight (8) times until it prints two hundred (200) sheets.

Figure 8:
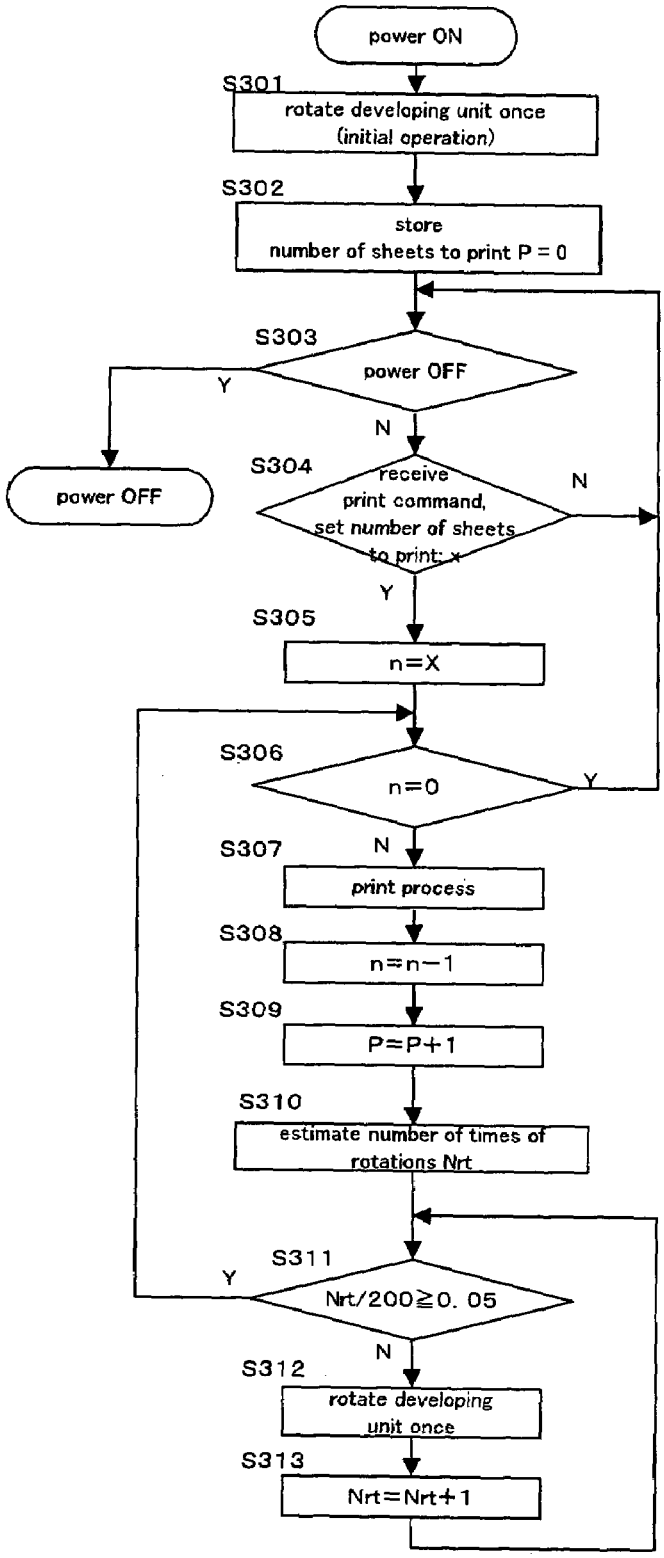
FIG. 8 is a flowchart for explaining a process in which the number of times of rotations is estimated every time a sheet is output.
Figure 9:
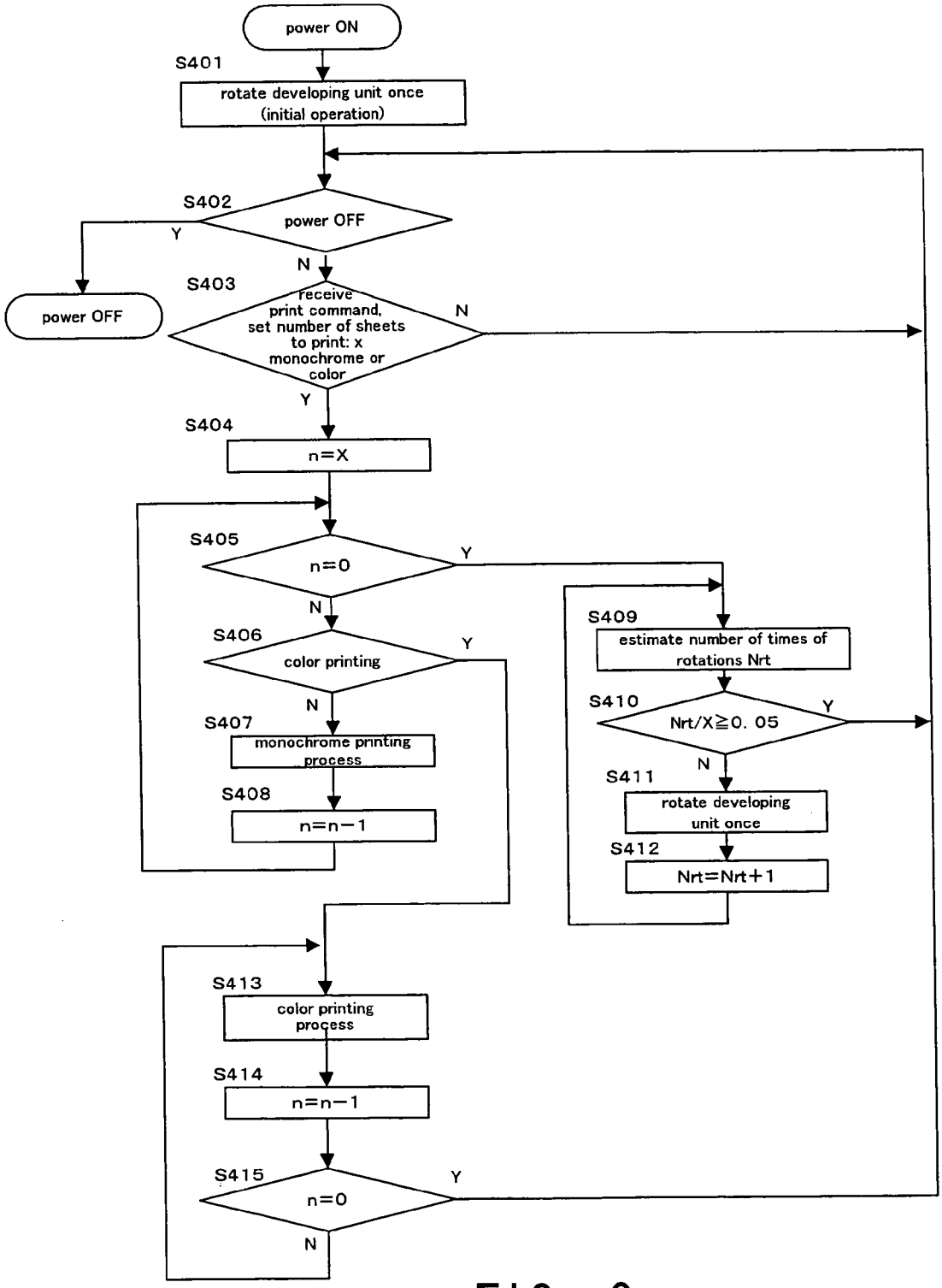
FIG. 9 is a flowchart for explaining a process in which the number of times of rotations is estimated per job by which continuous output is performed according to monochrome printing.
Figure 10:
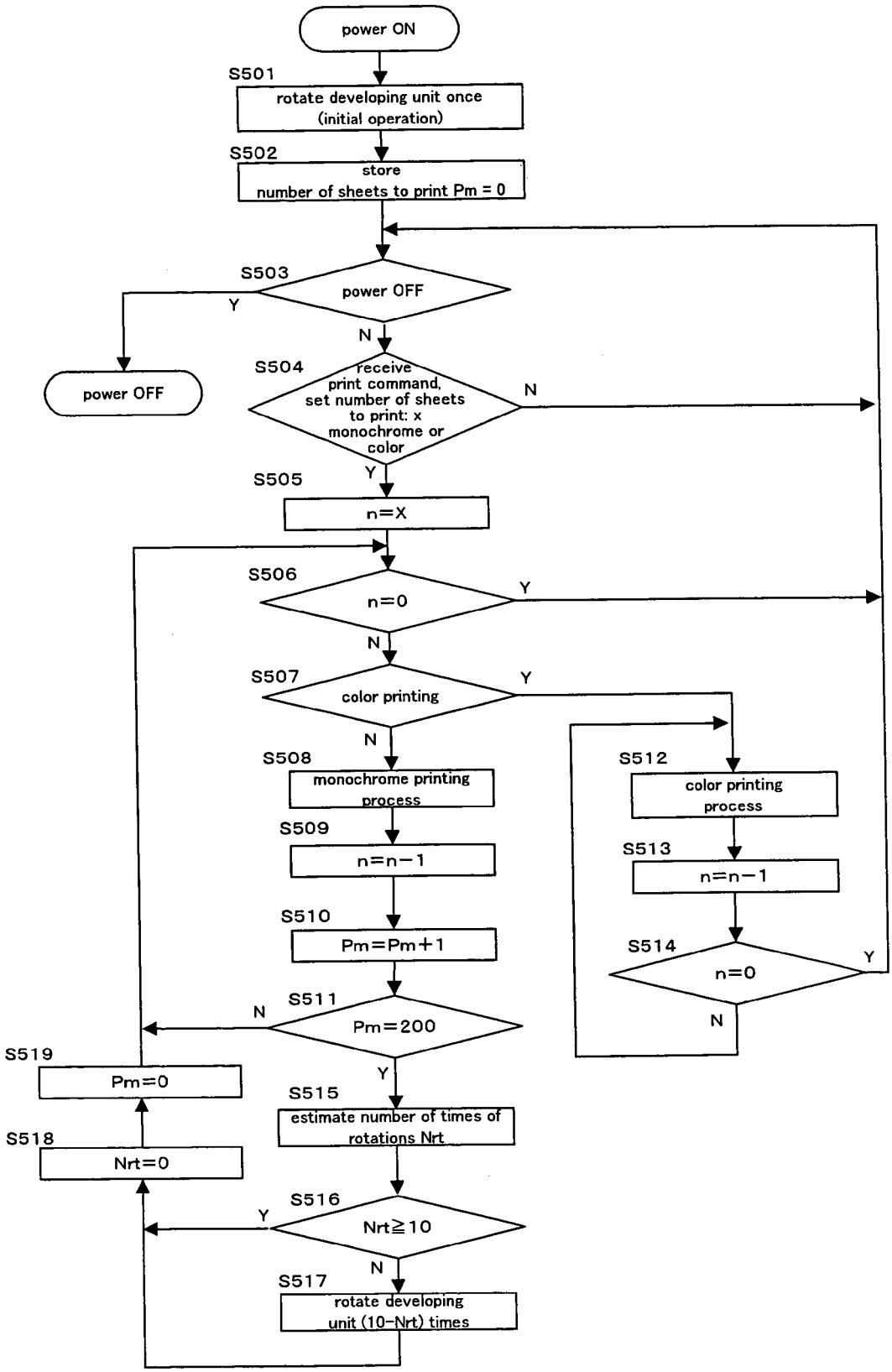
FIG. 10 is a flowchart for explaining a process in which the number of times of rotations is estimated every time two hundred (200) sheets are continuously output according to monochrome printing.

FIG. 8 through FIG. 10 are flowcharts showing other examples in the processes of the image forming apparatus.

In the example above, shortage in the number of times of rotations is adjusted in such a manner that, when the total number of output sheets reaches "200", the estimated number of times of rotations of the YMCK developing unit 50 for 20 output sheets is at least once. Instead, the shortage in the number of times of rotations may be adjusted by estimating the number of times of rotations of the YMCK developing unit 50 with respect to the total number of output sheets every time a print process is executed and a sheet is output, as shown in FIG. 8. In this case, every time printing is performed and a sheet is output, the number of times of rotations of the YMCK developing unit 50 is estimated according to the above-mentioned method to determine whether or not the number of times of rotations is appropriate. Therefore, it becomes possible to perform the rotating operation at an appropriate timing and appropriately stir the toner in the developing devices.

FIG. 9 is a flowchart showing a process in which the shortage in the number of times of rotations is adjusted per job in which monochrome printing is continuously performed according to one print command. In this case, the process for color printing and the process for monochrome printing differ according to the information received with the print commands. That is, when information instructing color printing is received with the print commands (S407), a color printing process is executed (S414 through S416), but the number of times of rotations is not estimated. On the other hand, when information instructing monochrome printing is received with the print commands (S407), a monochrome printing process is executed (S408, S409), and after monochrome printing for a designated number of sheets has finished (S406), the number of times of rotations of the YMCK developing unit 50 is estimated according to the estimation method described above (S410). If the turn value, which indicates the ratio of the estimated number of times of rotations Nrt to the number of sheets X output according to the monochrome printing job, is smaller than the reference value "0.05" (S411), the YMCK developing unit 50 is rotated once (S412) and "1" is added to the estimated number of times of rotations Nrt to obtain a new estimated number of times of rotations Nrt (S413). A new turn value (Nrt/X) is calculated based on the new estimated number of times of rotations Nrt obtained by addition, and the calculated value is compared with the reference value "0.05" (S411 through S413). These processes are repeated until the calculation result becomes equal to or larger than "0.05".

FIG. 10 is a flowchart showing a process in which the shortage in the number of times of rotations is adjusted every time two hundred (200) sheets are continuously output according to monochrome printing. Also in this case, the process for color printing and the process for monochrome printing differ, as with the case in which the shortage in the number of times of rotations is adjusted per job for continuously performing monochrome printing. That is, when information instructing color printing is received with the print commands (S507), a color printing process is executed (S512 through S514), but the number of times of rotations is not estimated. On the other hand, when information instructing monochrome printing is received with the print commands (S507), a monochrome printing process is executed (S508 through S510), and when two hundred (200) sheets have been output according to monochrome printing (S511), the number of times of rotations of the YMCK developing unit 50 is estimated according to the estimation method described above (S515). If the estimated number of times of rotations Nrt is smaller than the reference value "10" (S516), then the number of additional rotations (10−Nrt) is obtained through calculation, and the YMCK developing unit 50 is rotated for the number of additional rotations obtained (S517).

In the above-mentioned embodiment, examples in which the shortage in the number of times of rotations of the YMCK developing unit 50 is adjusted based on the number of sheets printed from when the power of the printer has been turned ON and on the number of times of rotations of the YMCK developing unit 50 have been described. However, the shortage in the number of times of rotations of the YMCK developing unit 50 may be adjusted according to the state of usage of the developing devices.

For example, it is possible to provide, in the apparatus-side memory 122 of the unit controller 102, a storage area that is reset when a developing device is mounted and that stores, for example, the total number of sheets output according to a job executed by that developing device and/or the usage amount or the remaining amount of that developing device. In this configuration, it is possible to rewrite the data in the storage area every time a print job is executed, and to adjust the shortage in the number of times of rotations of the YMCK developing unit 50 based on the information about the developing devices.

Further, the printer may be configured so that each of the developing devices has a storage element having an antenna that can achieve non-contact communication, for example, and that the printer apparatus is equipped with an antenna that enables the unit controller 102 to communicate with those storage elements of the developing devices. According to this configuration, the shortage in the number of times of rotations of the YMCK developing unit 50 may be adjusted based on the information about the developing devices stored in the storage elements of each developing device.

For example, each of the developing devices 51, 52, 53, 54 comprises, as the storage element, a nonvolatile storage memory (referred to as a "developing-device-side memory" below) that has an antenna for sending/receiving signals in a non-contact state and that stores data such as developing-device information about the developing device, such as color information about the color of the toner contained in each developing device, remaining-amount information about the remaining amount of toner, and printing-amount information about the number of sheets printed with each developing device. The developing-device-side memories are capable of communicating with the unit controller 102 of the control unit 100 in the main apparatus, using the antenna of the printer apparatus. The unit controller 102 is configured to be able to read out information from, or write information into, each of the developing-device-side memories when each of the developing devices is positioned in the developing position.

Figure 11:
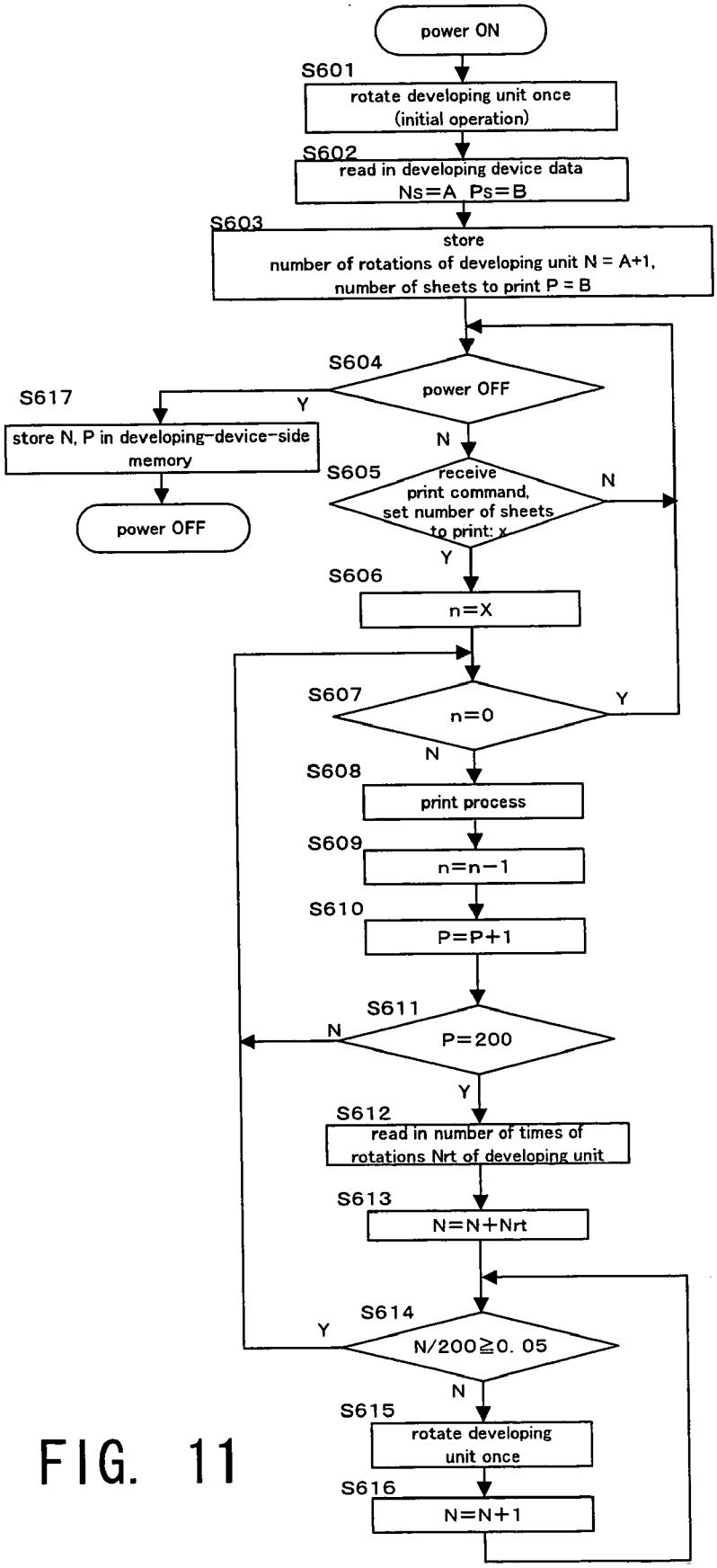
FIG. 11 is a flowchart showing an embodiment in a process of the image forming apparatus on which developing devices having storage elements are mounted.

FIG. 11 is a flowchart showing an embodiment of a process in the image forming apparatus on which developing devices having storage elements are mounted.

Below, description will be made of an example in which, when the total number of sheets of paper output from the time when a developing device was exchanged reaches "200", the number of times of rotations of the YMCK developing unit 50 for the total number of output sheets is compared with a reference value, and the YMCK developing unit 50 is rotated if necessary. Here, the reference value is also 0.05 (rotations/sheet). Explanation that is in common with the above-mentioned examples is omitted where permitted.

When the power of the printer 10 is turned ON, the YMCK developing unit 50 carries out its initial operation, that is, it rotates once and stops at the HP position (S601). At this time, "1" is stored in the number-of-rotations storage area of the apparatus-side memory since the HP detector 31 detects the rotating operation of the YMCK developing unit 50, and "0" is stored in the number-of-output-sheets storage area for storing the number of sheets of paper having been output (S602). The unit controller 102 reads out the number of times of rotations A for which the YMCK developing unit 50 has rotated after the black developing device 51 was mounted and the printing-amount information B that indicates the number of sheets printed after the black developing device 51 was mounted, which are stored in the storage element 51*a* of the black developing device 51 as the developing-device information. Also, the unit controller 102 stores "A+1" in the number-of-rotations storage area and "B" in the number-of-output-sheets storage area (S603). Then the printer enters the READY state.

For example, when the printer 10 receives, from an external computer connected thereto, a print command instructing the number of sheets to print x which indicates the number of sheets to be printed (S605), the unit controller 102 stores the number of sheets to print x in the number-of-sheets-to-print storage area (S606), and the print process is repeated until the value in the number-of-sheets-to-print storage area reaches "0" (S608 through S610).

When the value in the number-of-output-sheets storage area reaches "200" (S611), the unit controller 102 reads in the value N in the number-of-rotations storage area of the apparatus-side memory 122 (S613). Then, the unit controller 102 calculates a turn value of the YMCK developing unit 50 with respect to the total number of output sheets "200" (i.e., N/200), and the calculated turn value is compared with the preset reference value "0.05" (S614). If the calculated value is smaller than the reference value "0.05", the YMCK developing unit 50 is rotated, and if the calculated value is equal to or larger than "0.05", the printer either prints or stands-by in the READY state (S607).

When the power of the printer 10 is turned OFF, the values stored in the number-of-rotations storage area and the number-of-output-sheets storage area of the apparatus-side memory are written into the developing-device-side memory (S617).

When the developing devices have storage elements for storing information, it becomes possible to change the reference value for each developing device based on the information stored. That is, when information on the remaining amount of toner, as information about the developer in the developing device, and/or information about the number of sheets printed by the developing device is stored in the developing-device-side memory, it becomes possible to change the reference value based on such information and to stir the toner at a more suitable timing. For example, by providing in the apparatus-side memory a data table for the various reference values, and changing the reference value according to this data table, it becomes possible to stir the toner in the developing device more suitably.

FIG. 12 is a diagram showing an example of a data table provided in the apparatus-side memory.

As shown in the figure, the data in the table is set so that the reference value becomes larger when the remaining amount of toner becomes small and when the number of output sheets becomes large. That is, a state in which the remaining amount of toner is small, or a state in which the number of output sheets is large, means that the amount of time for which the developing device has been used is long, and it is likely that the toner inside has deteriorated. By setting the reference value for such circumstances high, it becomes possible to increase the frequency of rotation of the YMCK developing unit 50 with respect to the number of printed sheets, and prevent occurrence of a state in which toners having significantly different characteristics due to toner deterioration are contained in the developing device.

In the present embodiment, description was made of examples in which the number of output sheets is set to "200" for cases where the timing for determining whether or not the number of times of rotations is appropriate and the timing for estimating the number of times of rotations of the YMCK developing unit 50 are set according to the number of output sheets. However, this is not a limitation. Further, the timing for rotating the YMCK developing unit 50 when continuously outputting sheets according to monochrome printing was set to a timing when fifty (50) sheets were output. However, this is not a limitation. Further, the number of times for rotating the YMCK developing unit 50 at the beginning and the end of a monochrome printing job is not limited to one (1).

===Other Considerations ===

Above, a developing device etc. according to the present invention was described based on an embodiment thereof. However, the above-mentioned embodiment of the invention is merely given for facilitating understanding of the present invention, and are not to limit the scope of the present invention. It is without saying that the present invention may be altered and/or modified without departing from the scope thereof, and that the present invention includes its equivalents.

The present invention is particularly advantageous in a developing device that has a toner container for containing toner, that has a toner supplying member arranged at the lower portion of the toner container, and in which the toner supplying member supplies the toner, which is contained in the toner container, at the lower portion of the toner container to the developer bearing roller. However, the present invention is applicable to a developing device in which the toner supplying member is arranged at the upper portion of the toner container, and in which the toner supplying member supplies the toner, which is contained in the toner container, at the upper portion of the toner container to the developer bearing roller.

Further, in the embodiment described above, a full-color laser-beam printer of the intermediate-transferring type was described as an example of an image forming apparatus. However, the present invention is applicable to various image forming apparatuses such as full-color laser-beam printers other than the intermediate-transferring type, monochrome laser-beam printers, photocopiers, and facsimile machines.

Further, in the embodiment described above, it is possible to use, for example, any kind of material that is capable of configuring the developer bearing roller, such as magnetic material, nonmagnetic material, conductive material, insulating material, metal, rubber, and resin. For example, as kinds of material, it is possible to use: metal such as aluminum, nickel, stainless steel, and iron; rubber such as natural rubber, silicone rubber, polyurethane rubber, butadiene rubber, chloroprene rubber, neoprene rubber, and NBR; and resin such as polystyrene resin, vinyl chloride resin, polyurethane resin, polyethylene resin, methacrylate resin, and nylon resin. It is without saying that the upper layer of these materials can be coated. In this case, as the coating material, it is possible to use, for example: polyethylene, polystyrene, polyurethane, polyester, nylon, or acrylic resin. Further, the developer bearing member can be formed into any shape/structure such as an inelastic body, an elastic body, a single-layer structure, a multi-layer structure, a film, and a roller. Further, the developer is not limited only to toner, but other kinds of developer such as two component developer in which a carrier is mixed can be used.

Further, the same goes true also for the toner-supplying member, and, other than polyurethane foam described above, it is possible to use, for example, polystyrene foam, polyethylene foam, polyester foam, ethylene propylene foam, nylon foam, or silicone foam as the material thereof. Note that the foam cells of the toner-supplying means can either be open-cell foams or closed-cell foams. Note that, other than foam material, it is possible to use rubber material having elasticity. More specifically, it is possible to use a material in which rubber such as silicone rubber, polyurethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, and acrylic rubber is dispersed with conductive agents, such as carbon, and molded.

(II) SECOND EMBODIMENT OF IMAGE FORMING APPARATUS

===Overall Configuration Example of Color Image Forming Apparatus ===

Figure 13:
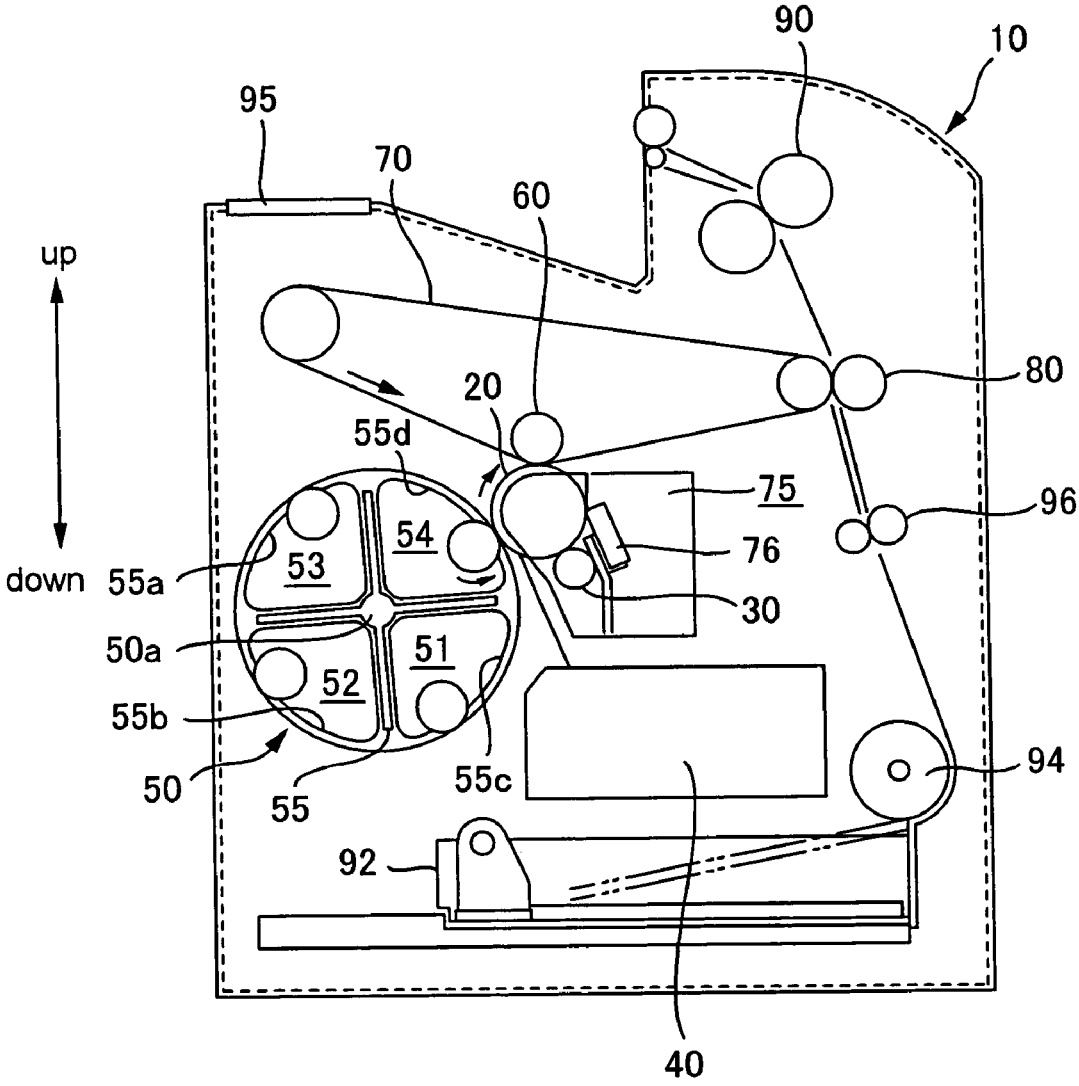
FIG. 13 is a diagram showing main structural components constructing a color image forming apparatus according to another embodiment.

Next, using FIG. 13, an outline of a color image forming apparatus will be described, taking a color laser-beam printer 10 (hereinafter referred to also as "printer") as an example. FIG. 13 is a diagram showing main structural components constructing the printer 10. Note that in FIG. 13, the vertical direction is shown by the arrow; for example, a paper supply tray 92 is arranged at a lower section of the printer 10, and a fusing unit 90 is arranged at an upper section of the printer 10.

It should be noted that the same reference numbers and letters are used for the components same as those in the First Embodiment.

As shown in FIG. 13, the printer 10 according to the present embodiment has the following components in the direction of rotation of a photoconductor 20, which is an example of an image bearing member for bearing a latent image: a charging unit 30; an exposing unit 40; a YMCK developing unit 50; a first transferring unit 60; an intermediate transferring element 70 as an example of a transferring medium that serves as a medium when transferring a developer image, which has been made visible on the image bearing member, onto a transferring material; and a cleaning unit 75. The printer 10 further has: a second transferring unit 80; a fusing unit 90; a displaying unit 95 comprising a liquid-crystal display and serving as notifying means to a user; and a control unit (FIG. 14) for controlling these units etc. and managing the operations as a printer.

The photoconductor 20 has a cylindrical conductive base and a photoconductive layer formed on the outer peripheral surface of the conductive base, and it is rotatable about a central axis. In the present embodiment, the photoconductor 20 rotates clockwise, as shown by the arrow in FIG. 13.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates modulated laser onto the charged photoconductor 20 according to image information having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54. The toner T is an example of developer contained in each of the developing devices.

In the present embodiment, the YMCK developing unit 50 can move the positions of the four developing devices 51, 52, 53, 54 by making them rotate. More specifically, the YMCK developing unit 50 holds the four developing devices 51, 52, 53, 54 with four holding sections 55*a*, 55*b*, 55*c*, 55*d*. The four developing devices 51, 52, 53, 54 can be rotated about a rotating shaft 50*a* while maintaining their relative positions. As the photoconductor 20 makes one revolution, each of the developing devices selectively opposes the photoconductor 20. The latent image formed on the photoconductor 20 is successively developed by the toner T contained in each of the developing devices 51, 52, 53, 54. Note that details on the developing devices will be described later.

The first transferring unit 60 is a device for transferring a single-color toner image formed on the photoconductor 20 onto the intermediate transferring element 70. When the toners of all four colors are successively transferred in a superimposing manner, a full-color toner image will be formed on the intermediate transferring element 70.

The intermediate transferring element 70 is a laminated endless belt that is made by providing an aluminum layer on the surface of a PET film by vapor deposition, and then further applying semiconducting coating on the outer layer thereof. The intermediate transferring element 70 is driven to rotate at substantially the same circumferential speed as the photoconductor 20.

The second transferring unit 80 is a device for transferring the single-color toner image or the full-color toner image formed on the intermediate transferring element 70 onto a recording medium such as paper, film, cloth, and the like, which serves as an example of the transferring material.

The fusing unit 90 is a device for fusing the single-color toner image or the full-color toner image, which has been transferred onto the recording medium, onto the recording medium such as paper to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring element 70 by the first transferring unit 60.

Figure 14:
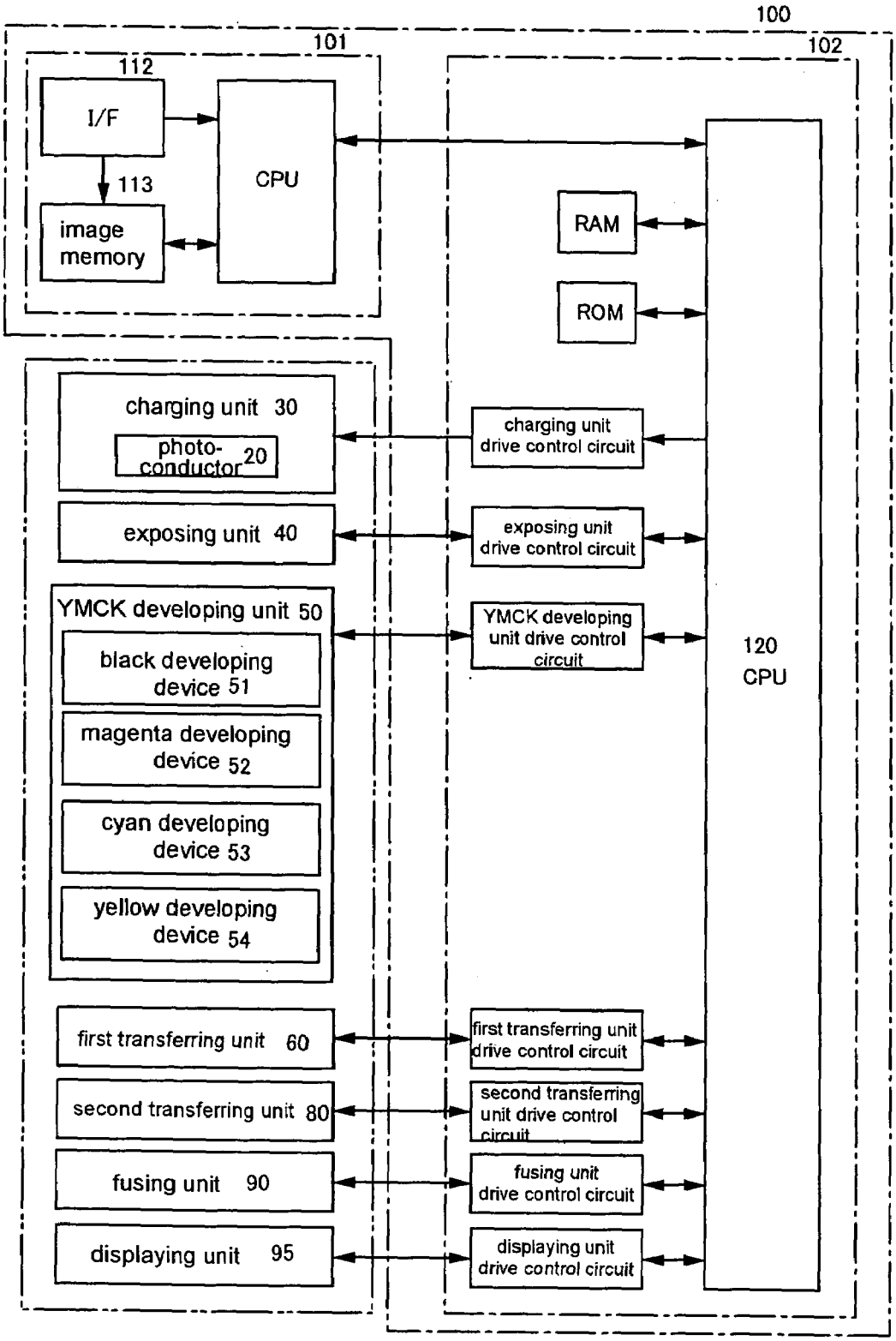
FIG. 14 is a block diagram showing a control unit in the color image forming apparatus of FIG. 13.

The control unit 100 comprises a main controller 101 and a unit controller 102 as shown in FIG. 14. An image signal is input to the main controller 101, and according to instructions based on the image signal, the unit controller 102 controls each of the above-mentioned units and the like to form an image.

Next, operations of the printer 10 structured as above will be described with reference to other structural components.

First, when an image signal is input from the not-shown host computer to the main controller 101 of the printer 10 through an interface (I/F) 112, the photoconductor 20, a developing roller as an example of a developer bearing member, and the intermediate transferring element 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposure position. A latent image that corresponds to the image information about the first color, for example yellow Y, is formed in that area by the exposing unit 40. Further, the YMCK developing unit 50 locates the yellow developing device 54, which contains yellow (Y) toner, in the developing position opposing the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring unit 60. At this time, a first transferring voltage, which is in an opposite polarity to the polarity to which the toner T is charged, is applied to the first transferring unit 60. It should be noted that, during the above-mentioned processes, the photoconductor 20 and the intermediate transferring element 70 are placed in contact with each other in order to achieve appropriate transferring, and the second transferring unit 80 is kept separated from the intermediate transferring element 70.

By subsequently performing the above-mentioned processes for the second, the third, and the fourth colors for each of the developing devices, toner images in four colors corresponding to the respective image signals are transferred to the intermediate transferring element 70 in a superimposed manner. As a result, a full-color toner image is formed on the intermediate transferring element 70.

With the rotation of the intermediate transferring element 70, the full-color toner image formed on the intermediate transferring element 70 reaches a second transferring position, and is transferred onto a recording medium by the second transferring unit 80. It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring element 70.

The full-color toner image transferred onto the recording medium is heated and pressurized by the fusing unit 90 and fused to the recording medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming a next latent image. The scraped-off toner T is collected in a remaining-toner collector that the cleaning unit 75 comprises.

===Overview of Control Unit ===

Next, with reference to FIG. 14, the configuration of the control unit 100 will be described. The main controller 101 of the control unit 100 is connected to the host computer through the interface (I/F) 112 and comprises an image memory 113 for storing image signals that have been input from the host computer. The unit controller 102 is electrically connected to each of the units of the main apparatus (i.e., the charging unit 30, the exposing unit 40, the YMCK developing unit 50, the first transferring unit 60, the cleaning unit 75, the second transferring unit 80, the fusing unit 90, and the displaying unit 95). By receiving signals from sensors provided on each of the units, the unit controller 102 detects the state of each unit and controls each unit according to the signals input from the main controller 101.

===Configuration Example of Developing Device ===

Figure 15:
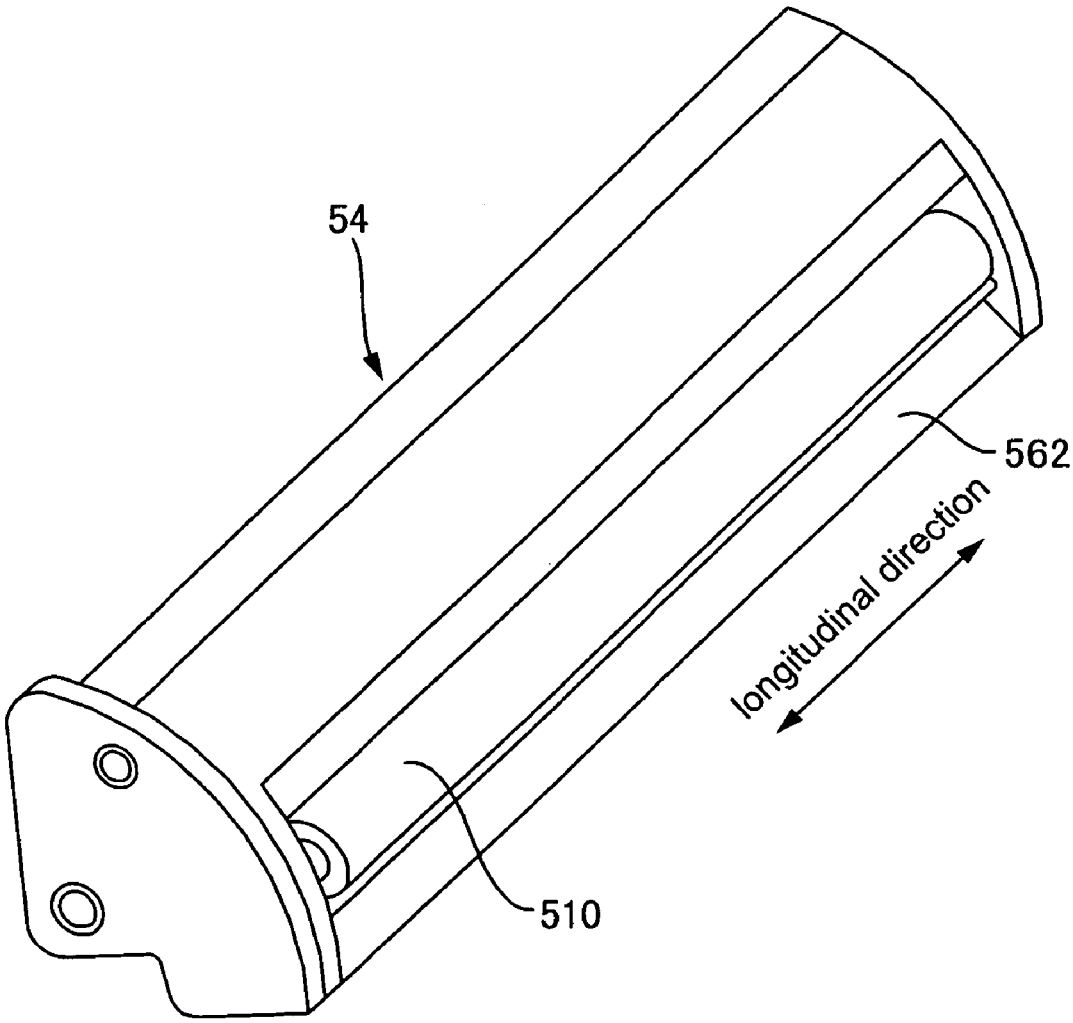
FIG. 15 is a conceptual diagram of a developing device.
Figure 16:
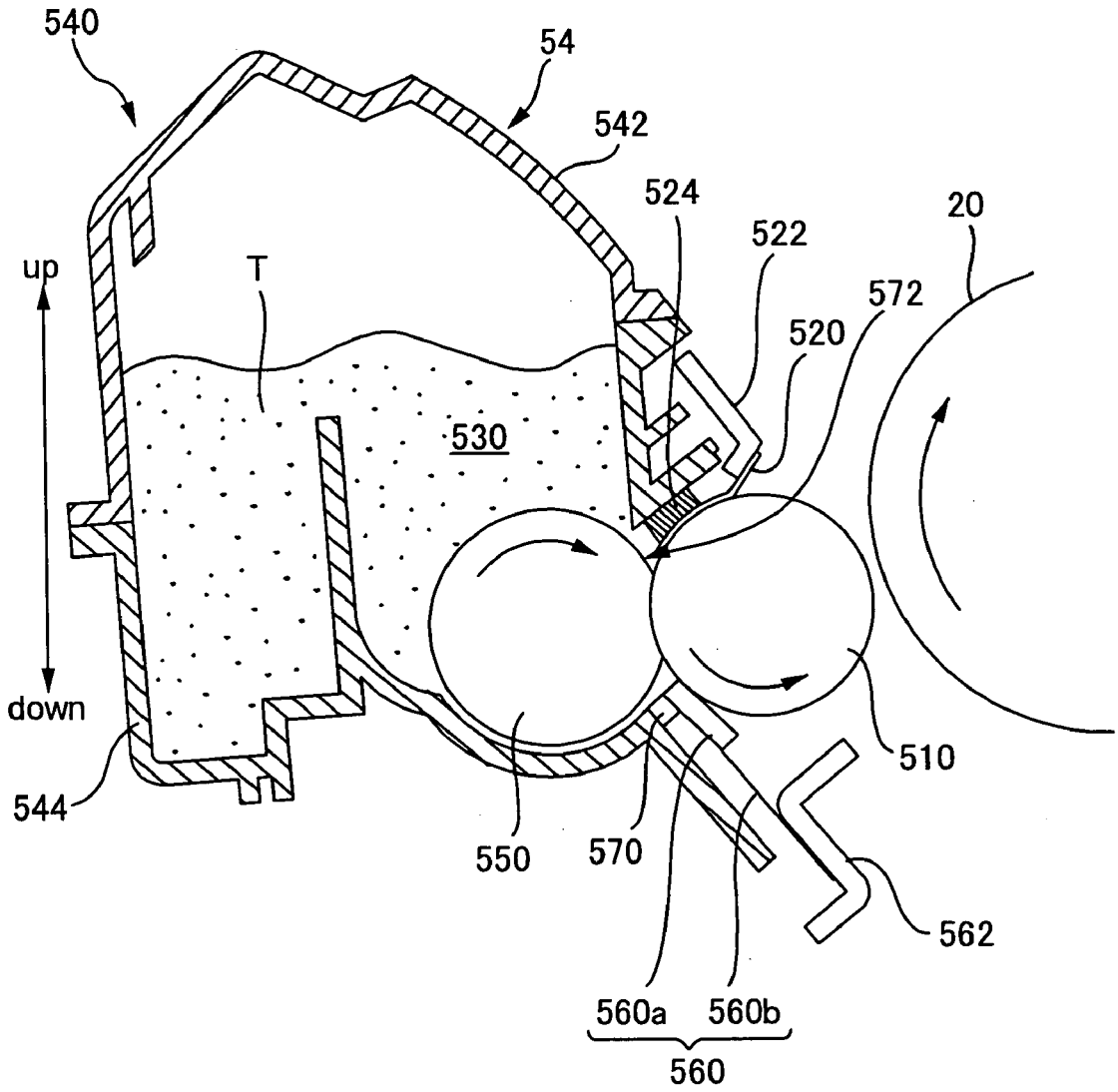
FIG. 16 is a section view showing main structural components of the developing device.

Next, with reference to FIG. 15 and FIG. 16, an example of a configuration of the developing device will be described. FIG. 15 is a conceptual diagram of the developing device. FIG. 16 is a section view showing main structural components of the developing device. Note that the section view shown in FIG. 16 is a section of the developing device bisected by a plane perpendicular to the longitudinal direction shown in FIG. 15. Further, in FIG. 16, the arrow indicates the vertical direction as in FIG. 13; for example, the central axis of the developing roller 510 is located below the central axis of the photoconductor 20. Further, in FIG.

16, the yellow developing device 54 is shown to be in a state in which it is located in the developing position opposing the photoconductor 20.

The YMCK developing unit 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, below, explanation will be made only of the yellow developing device 54.

The yellow developing device 54 has, for example, the developing roller 510, a sealing member 520, a housing 540, a toner-supplying roller 550, and a restriction blade 560.

The developing roller 510 bears toner T and delivers it to a developing position opposing the photoconductor 20. The developing roller 510 is made of metal and manufactured from, for example, aluminum alloy such as aluminum alloy 5056 or aluminum alloy 6063, or iron alloy such as STKM, and the roller 510 is plated with, for example, nickel plating or chromium plating, as necessary.

Further, as shown in FIG. 15, the developing roller 510 is supported at both ends in its longitudinal direction and is rotatable about its central axis. As shown in FIG. 16, the developing roller 510 rotates in the opposite direction (counterclockwise in FIG. 16) to the rotating direction of the photoconductor 20 (clockwise in FIG. 16). The central axis of the roller 510 is located below the central axis of the photoconductor 20. Further, as shown in FIG. 16, in the state where the yellow developing device 54 opposes the photoconductor 20, there is a gap between the developing roller 510 and the photoconductor 20. That is, the yellow developing device 54 develops the latent image formed on the photoconductor 20 in a non-contacting state. Note that an alternating field is generated between the developing roller 510 and the photoconductor 20 upon developing the latent image formed on the photoconductor 20.

The sealing member 520 prevents the toner T in the yellow developing device 54 from spilling out therefrom, and also collects the toner T, which is on the developing roller 510 that has passed the developing position, into the developing device without scraping. The sealing member 520 is a seal made of, for example, polyethylene film. The sealing member 520 is supported by a seal-supporting metal plate 522, and is attached to the housing 540 via the seal-supporting metal plate 522. A seal-impelling member 524 made of, for example, Moltoprene is provided on one side of the sealing member 520 opposite to the side of the developing roller 510. The sealing member 520 is pressed against the developing roller 510 by the elastic force of the seal-impelling member 524. Note that the abutting position at which the sealing member 520 abuts against the developing roller 510 is situated above the central axis of the developing roller 510.

The housing 540 is made by welding together a plurality of housing portions, that is, an upper housing portion 542 and a lower housing portion 544 that are each integrally molded. As shown in FIG. 16, the housing 540 has an opening 572 at its lower section. The developing roller 510 is arranged in this opening 572 in such a state that a part of the roller 510 is exposed to the outside.

Further, the housing 540 forms a toner container 530 that is capable of containing the toner T. A stirring member for stirring the toner T may be provided in the toner container 530. However, in the present embodiment, each of the developing devices (the black developing device 51, the magenta developing device 52, the cyan developing device 53, and the yellow developing device 54) rotates with the rotation of the YMCK developing unit 50, and the toner T contained in each developing device is stirred therewith. Therefore, the toner container 530 is not provided with a stirring member.

The toner-supplying roller 550 supplies the toner T contained in the toner container 530 to the developing roller 510. The toner-supplying roller 550 is made of, for example, polyurethane foam, and is made to abut against the developing roller 510 in an elastically deformed state. The toner-supplying roller 550 is arranged at a lower section of the toner container 530. The toner T contained in the toner container 530 is supplied to the developing roller 510 by the toner-supplying roller 550 at the lower section of the toner container 530. The toner-supplying roller 550 is rotatable about a central axis. The central axis of the toner-supplying roller 550 is situated below the central axis of rotation of the developing roller 510. Further, the toner-supplying roller 550 rotates in the opposite direction (clockwise in FIG. 16) to the rotating direction of the developing roller 510 (counterclockwise in FIG. 16). Note that the toner-supplying roller 550 has the function of supplying the toner T contained in the toner container 530 to the developing roller 510 as well as the function of stripping the toner T remaining on the developing roller 510 after development off from the developing roller 510.

The restriction blade 560 restricts the thickness of the layer of the toner T bore by the developing roller 510 and also gives charge to the toner T bore by the developing roller 510. This restriction blade 560 has a rubber portion **560*a* and a rubber-supporting portion 560*b*. The rubber portion 560*a* is made of, for example, silicone rubber or urethane rubber. The rubber-supporting portion 560*b* is a thin plate that is made of, for example, phosphor bronze or stainless steel, and that has a springy characteristic. The rubber portion 560*a* is supported by the rubber-supporting portion 560*b*. The rubber-supporting portion 560*b* is attached to the housing 540 via a pair of blade-supporting metal plates 562 in a state that one end of the rubber-supporting portion 560*b* is pinched between and supported by the blade-supporting metal plates 562. Further, a blade-backing member 570 made of, for example, Moltoprene is provided on one side of the restriction blade 560 opposite to the side of the developing roller 510**.

The rubber portion **560*a* is pressed against the developing roller 510 by the elastic force caused by the flexure of the rubber-supporting portion 560*b*. Further, the blade-backing member 570 prevents the toner T from entering between the rubber-supporting portion 560*b* and the housing 540, stabilizes the elastic force caused by the flexure of the rubber-supporting portion 560*b*, and also, applies force to the rubber portion 560*a* from the back thereof towards the developing roller 510 to press the rubber portion 560*a* against the developing roller 510. In this way, the blade-backing member 570 makes the rubber portion 560*a* abut against the developing roller 510** more evenly.

The end, i.e., the tip end of the restricting blade 560 opposite to the end that is being supported by the blade-supporting metal plates 562 is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces towards the upper stream of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner-supplying roller 550.

In the yellow developing device 54 thus structured, the toner-supplying roller 550 supplies the toner T contained in the toner container 530 to the developing roller 510. With the rotation of the developing roller 510, the toner T, which has been supplied to the developing roller 510, reaches the abutting position of the restriction blade 560; then, as the toner T passes the abutting position, the toner is charged and its thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing device by the sealing member 520 without being scraped off. Then, the toner that is still remaining on the developing roller 510 can be stripped off by the toner-supplying roller 550.

===Toner Structure ===

Next, the structure of the toner T according to the present embodiment will be described. The toner T includes a core particle and external additives that are applied on the core particle. The core particle and external additives are made to adhere to each other by dry mixing using, for example, mixers adopting mechanochemical methods or high-speed fluid mixers such as a Henschel mixer and a Papenmeier mixer. As for the polarity of the toner T, although toner T having negative polarity is used in the present embodiment, the toner T may either have negative or positive polarity.

The core particle includes materials such as coloring agents, charge control agents, lubricants (WAX), and resin. The core particle is made according to, for example, the kneading-and-grinding method, the spray-dry method, or the polymerization method, which are known in the art, using the above materials. Note that the core particle can further include, for example, dispersing agents, magnetic materials, and other additives.

It is possible to use one kind, or two or more kinds blended, of the following materials, for example, as the core particle: polystyrene and copolymers thereof, such as hydrogenated styrene resin, styrene isobutylene copolymer, ABS resin, ASA resin, AS resin, AAS resin, ACS resin, AES resin, styrene p-chlorostyrene copolymer, styrene propylene copolymer, styrene butadiene crosslinked polymer, styrene butadiene chlorinated-paraffin copolymer, styrene allylalcohol copolymer, styrene butadiene rubber emulsion, styrene maleate copolymer, styrene isobutylene copolymer, and styrene maleic anhydride copolymer; acrylate resins, methacrylate resins, and copolymers thereof; styrene acrylic resins and copolymers thereof, such as styrene acryl copolymer, styrene diethylaminoethyl methacrylate copolymer, styrene butadiene acrylate copolymer, styrene methyl methacrylate copolymer, styrene n-butyl methacrylate copolymer, styrene methyl methacrylate n-butyl acrylate copolymer, styrene methyl methacrylate butyl acrylate N-(ethoxymethyl) acrylamide copolymer, styrene glycidyl methacrylate copolymer, styrene butadiene dimethyl aminoethyl methacrylate copolymer, styrene acrylate maleate copolymer, styrene methyl methacrylate 2-ethylhexyl acrylate copolymer, styrene n-butyl acrylate ethylglycol methacrylate copolymer, styrene n-butyl methacrylate acrylic acid copolymer, styrene n-butyl methacrylate maleic anhydride copolymer, and styrene butyl acrylate isobutyl maleic acid half-ester divinylbenzene copolymer; polyesters and copolymers thereof; polyethylene and copolymers thereof; epoxy resins; silicone resins; polypropylene and copolymers thereof; fluorocarbon resins; polyamide resins; polyvinyl alcohol resins; polyurethane resins; and polyvinyl butyral resins.

It is possible to use the following materials, for example, as coloring agents: carbon black; spirit black; nigrosine; rhodamines; triaminotriphenylmethane; cations; dioxazine; copper phthalocyanine pigments; perylene; azo dyes; metal-containing azo pigments; azo chromium complex; carmines; benzidines; solar pure yellow 8G; quinacridon; poly-tungstophosphoric acid; indanthrene blue; and sulfonamide derivatives.

It is possible to use the following materials, for example, as charge control agents: electron acceptor organic complexes; chlorinated polyethers; nitrohumic acid; quaternary ammonium salts; and pyridinyl salts.

The following materials are preferably used as the lubricants (WAX): low molecular-weight polypropylene; low molecular-weight polyethylene; ethylene bis-amide; and paraffin-based waxes such as microcrystalline wax, carnauba wax, and bees wax. However, it is not particularly limited to the above as long as it is not miscible to the core particle of the toner and stays separate therefrom. Note that, in the present embodiment, "not miscible" indicates a state in which, when melted and mixed, the wax disperses in the core particle like islands without being taken into the molecular chain of the resin.

It should be noted that, in order to prevent the toner T from adhering to the fusing roller during the fusing process, there are cases in which oil is coated on the fusing roller. In the present embodiment, however, the core particle is made to contain a large amount of the lubricant in order to omit oil coating. The content of the lubricant is 3–10 wt % with respect to the amount of resin.

It is possible to use, for example, metallic soaps and polyethylene glycol as dispersing agents. As other additives, it is possible to use, for example, zinc stearate, zinc oxide, and ceric oxide.

It is possible to use the following materials, for example, as magnetic materials: metal powder such as Fe, Co, Ni, Cr, Mn, and Zn; metal oxides such as $Fe_3O_4$, $Fe_2O_3$, $Cr_2O_3$, and ferrites; and alloys that display ferromagnetism by treating, for example, alloys containing manganese and acid with heat. The magnetic material may be pretreated in advance with, for example, a coupling agent.

It is possible to use, as the external additives, various materials whose surface has been treated to have hydrophobic characteristics. Titanium oxide, which is a conductive metal oxide, is used as the external additive of the toner T according to the present embodiment. However, other than titanium oxide, it is possible to use inorganic particles such as: silica; particles of metal oxides, such as aluminum oxide, strontium titanate, ceric oxide, magnesium oxide, and chromium oxide; particles of nitrides, such as silicon nitride; particles of carbides, such as silicon carbide; particles of metal salts, such as calcium sulfate, barium sulfate, and calcium carbonate; and materials obtained by combining the above, and also organic particles such as particles of acrylic resin. Further, it is possible to use, for example, silane coupling agents, titanate coupling agents, fluorine-containing silane coupling agents, and silicone oil as surface treatment agents for treating the external additives. It is preferable that the hydrophobic ratio of the external additives having been treated with the above-mentioned treatment agents is 60% or higher, according to a conventional methanol method. If the ratio is lower than this value, deterioration in the charging characteristic and fluidity will easily occur in a hot and wet environment due to adsorption of moisture, and therefore it is not preferable. It is preferable for the particle size of the external additives to be 0.001 to 1 μm from the viewpoint of carrying performance and charging characteristics. Further, the number of kinds of the external additives is not limited to one, but a blend containing two or more kinds of external additives can be used.

===Mechanism by which "Fogging" Occurs ===

Figure 17:
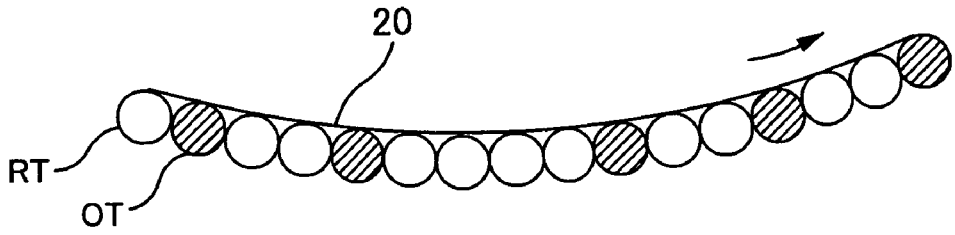
FIG. 17 is a conceptual diagram showing a state in which both normally-charged toner RT and inversely-charged toner OT exist on a photoconductor 20.
Figure 18:
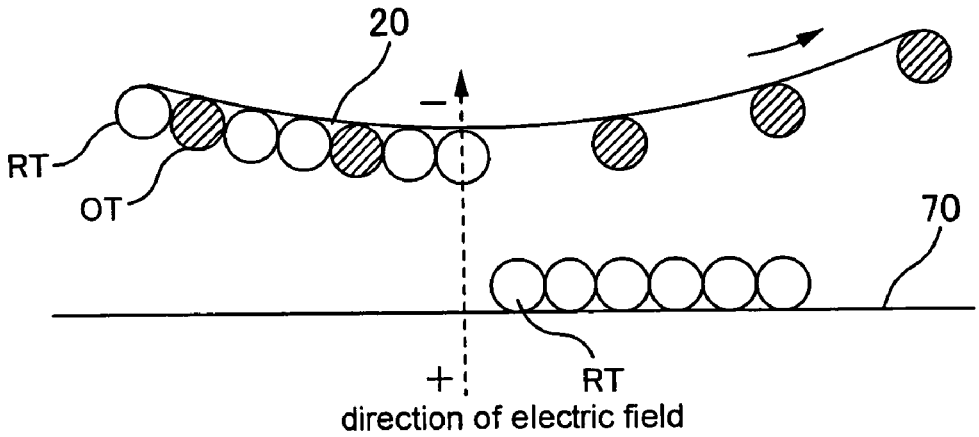
FIG. 18 is a conceptual diagram showing how the normally-charged toner RT is transferred onto an intermediate transferring element 70.
Figure 19:
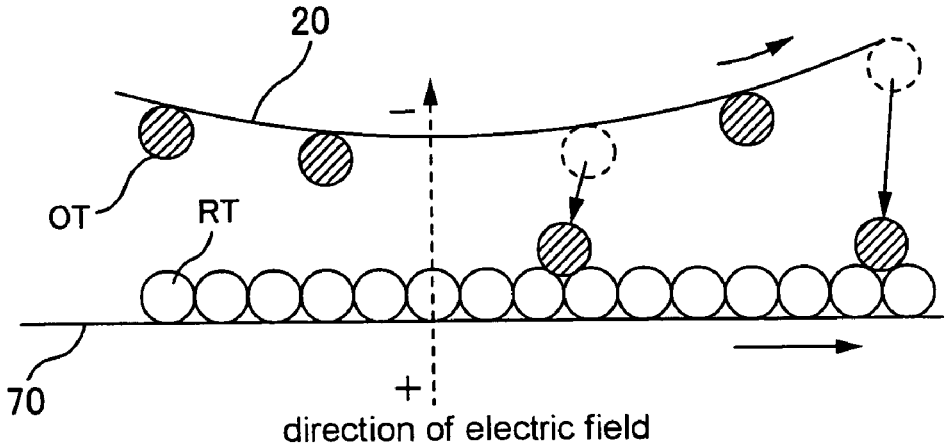
FIG. 19 is a conceptual diagram showing how the inversely-charged toner OT is transferred onto the intermediate transferring element 70.

As described in the "Description of the Related Art", when forming a color image by superimposing toner of several colors onto the intermediate transferring element, a phenomenon in which toner of one color inadvertently overlies toner of another color that has already been transferred onto the intermediate transferring element sometimes occurs. (This phenomenon is called "fogging" herein.) The mechanism by which "fogging" occurs will be described below with reference to FIG. 17 through FIG. 19. FIG. 17 is a conceptual diagram showing a state in which both normally-charged toner RT and inversely-charged toner OT exist on a photoconductor 20. FIG. 18 is a conceptual diagram showing how the normally-charged toner. RT is transferred onto an intermediate transferring element 70. FIG. 19 is a conceptual diagram showing how the inversely-charged toner OT is transferred onto the intermediate transferring element 70.

As described above, when image signals from a host computer are input to the main controller 101, the photoconductor 20, the developing roller, and the intermediate transferring element 70 rotate. While rotating, the photoconductor 20 is successively charged at the charging position.

With the rotation of the photoconductor 20, the area of the photoconductor 20 that has been charged (the charged area) reaches the exposure position, and a latent image according to image information for the first color (for example, yellow Y in the present embodiment) is formed in the charged area. With the rotation of the photoconductor 20, the latent image formed on the photoconductor 20 reaches the developing position and is developed by the yellow developing device 54 using yellow toner. Accordingly, a yellow toner image is formed on the photoconductor 20.

It is known that toner T (referred to also as "inversely-charged toner OT" herein) that is charged to have an opposite polarity to the charge polarity of normal toner T (referred to also as "normally-charged toner RT" herein) is generated during, for example, charging of the toner T, and that the inversely-charged toner OT adheres to the photoconductor 20. Further, it is known that the inversely-charged toner OT may adhere to any region of the photoconductor 20, regardless of whether or not it is a region of the photoconductor 20 in which a latent image has been formed (that is, regardless of whether it is a solid print region or a solid non-print region).

As shown in FIG. 17, both the normally-charged toner RT (indicated by the white circles in FIG. 17) and the inversely-charged toner OT (indicated by the hatched circles in FIG. 17) are present in the region on the photoconductor 20 in which a latent image has been formed (i.e., the solid print region). It should be noted that, since negative charge toner T is adopted as the normally-charged toner RT in the present embodiment, the polarity of the inversely-charged toner OT is positive, as described above.

With the rotation of the photoconductor 20, the yellow toner image formed on the photoconductor 20 reaches the first transferring position and is transferred onto the intermediate transferring element 70 by the first transferring unit 60. As described above, a first transferring voltage, which is in an opposite polarity to the charge polarity of the normally-charged toner RT, is applied to the first transferring unit 60. Therefore, as shown in FIG. 18, the normally-charged toner RT (indicated by the white circles in FIG. 18) is transferred onto the intermediate transferring element 70, whereas the inversely-charged toner OT (indicated by the hatched circles in FIG. 18) remains on the photoconductor 20 without being transferred onto the intermediate transferring element 70.

Next, the processes described above are carried out for the second color (for example, cyan C in the present embodiment). That is, with the rotation of the photoconductor 20, the charged area of the photoconductor 20 reaches the exposure position, and a latent image according to image information for the second color is formed in the charged area. With the rotation of the photoconductor 20, the latent image formed on the photoconductor 20 reaches the developing position and is developed by the cyan developing device 53 using cyan toner. Accordingly, a cyan toner image is formed on the photoconductor 20.

Attention should be paid to the region on the photoconductor 20 in which a latent image has not been formed (i.e., the solid non-print region) in FIG. 19. As shown in FIG. 19, although the normally-charged toner RT does not adhere to the photoconductor 20, the inversely-charged toner OT (indicated by the hatched circles in FIG. 19) may adhere to the photoconductor 20.

As with the example for the first color, a first transferring voltage, which is in an opposite polarity to the charge polarity of the normally-charged toner RT, is applied to the first transferring unit 60. Therefore, the applied voltage will not cause any electric force that would attract the inversely-charged toner OT toward the intermediate transferring element 70. However, different from the example for the first color, the normally-charged toner RT of the first color (indicated by the white circles in FIG. 19) has already been transferred onto the intermediate transferring element 70. Since the charge polarity of the normally-charged toner RT on the intermediate transferring element 70 is opposite to the charge polarity of the inversely-charged toner OT on the photoconductor 20, an electric force attracting the inversely-charged toner OT of the second color toward the intermediate transferring element 70 is generated in places where the normally-charged toner RT of the first color is present on the intermediate transferring element 70. This causes the inversely-charged toner OT to be transferred onto the intermediate transferring element 70.

This is how the phenomenon in which toner of one color inadvertently overlies toner T of another color having already been transferred onto the intermediate transferring element 70 occurs.

The processes described above are carried out for the third color (for example, magenta M in the present embodiment) and the fourth color (for example, black K in the present embodiment). The same phenomenon as described above occurs also during these processes.

That is, as for the third color, an electric force attracting the inversely-charged toner OT of the third color toward the intermediate transferring element 70 is generated in places where the normally-charged toner RT of the first or second color is present on the intermediate transferring element 70, and this causes the inversely-charged toner OT to be transferred onto the intermediate transferring element 70.

Further, as for the fourth color, an electric force attracting the inversely-charged toner OT of the fourth color toward the intermediate transferring element 70 is generated in places where the normally-charged toner RT of the first, second, or third color is present on the intermediate transferring element 70, and this causes the inversely-charged toner OT to be transferred onto the intermediate transferring element 70.

As apparent from the description above, the later the development is performed, the larger the amount of the normally-charged toner RT that has already been transferred onto and that is present on the intermediate transferring element 70 (or the area of the region in which the normally-charged toner RT resides on the intermediate transferring element 70) becomes. Therefore, the later the development is performed, the larger the amount of "fogging", i.e., the amount in which the toner of another color overlies the toner T having already been transferred onto the intermediate transferring element 70 becomes.

Consequently, the occurrence of "fogging" causes deterioration in the quality of the color image that is finally transferred onto the transferring material.

It should be noted that in FIG. 18 and FIG. 19, in order to make the figures easier to see, the photoconductor 20 and the intermediate transferring element 70 are depicted such that they are separated from each other. However, in the present embodiment, the photoconductor 20 and the intermediate transferring element 70 are placed in contact with each other, as described above.

===Characteristics of Toner in Each Developing Device ===

Figures 20, 21:
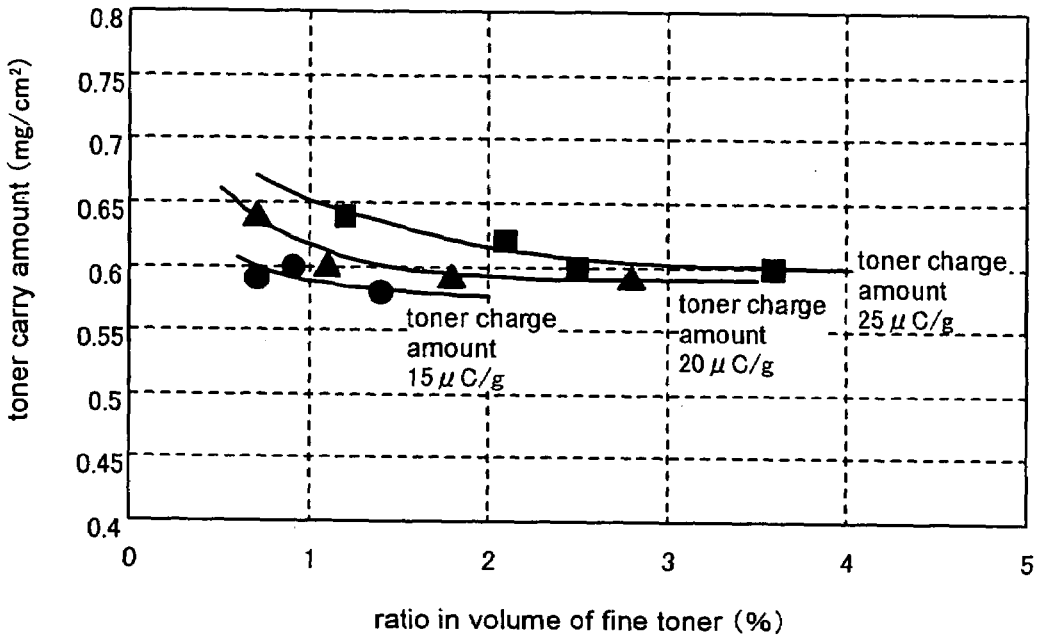
FIG. 20 is a diagram showing the characteristics of toner T for each developing device.
FIG. 21 is a diagram showing the amount of toner carried (toner carry amount) when the ratio in volume of fine toner and the toner charge amount have been changed.

Next, the characteristics of the toner T according to the present embodiment will be described. As described above, the printer 10 according to the present embodiment has four developing devices, and the color of the toner T in each developing device is different. In addition, some characteristics, other than color, are made to differ for each of the developing devices. The characteristics of the toner T contained in each developing device will be described with reference to FIG. 20. FIG. 20 is a diagram showing the characteristics of the toner T for each developing device.

The table in FIG. 20 shows, for each of the four developing devices, the color of toner in the developing device, the ratio in volume of toner particles having a diameter of 5 μm or less (in the present embodiment, such toner particles are referred to as "fine toner MT") with respect to the entire volume of the toner T, the volume average particle diameter of the toner T, and the charge amount of the toner T. The data for the four developing devices are described from left to right in FIG. 20 in the order of development.

As described above, in the present embodiment, the first color is yellow, the second color is cyan, the third color is magenta, and the fourth color is black.

The ratios in volume of fine toner MT with respect to the entire volume of the toner T are 2.5% for the first color, 1.5% for the second color, 1% for the third color, and 0.5% for the fourth color, as shown in FIG. 20. That is, the developing devices other than the developing device that performs development first, in other words, the developing devices for the second, third, and fourth colors perform development according to an order in which a developing device having a smaller ratio in volume performs development later in order. (In other words, in the present embodiment, development is performed in the order of cyan→magenta→black, since the ratio in volume of fine toner MT decreases in this order.) Further, the ratio in volume of fine toner MT for the developing device that performs development first among the four developing devices is larger than the ratio in volume of fine toner MT for each of the other developing devices.

Now, when paying attention to two of the developing devices among the developing devices other than the developing device that performs development first, it can be said that the printer 10 of the present embodiment has two developing devices, i.e., a first developing device, whose ratio in volume of fine toner MT is R1, and a second developing device, whose ratio in volume of fine toner MT is R2, that satisfy all of the following three conditions:

(1) The order in which the first developing device and the second developing device perform development is other than first in order;

(2) The second developing device performs development later than the first developing device; and (3) R1 is larger than R2.

As shown in FIG. 20, the volume average particle diameter of the toner T for each of the developing devices is 8.5 μm, i.e., the volume average particle diameter of the toner T is equal. In other words, it can be said that, when paying attention to the two developing devices (the above-mentioned first and second developing devices) among the developing devices other than the developing device that performs development first, the volume average particle diameter of the developer contained in the first developing device is equal to the volume average particle diameter of the developer contained in the second developing device. It should be noted that the phrase "the volume average particle diameter of the toner T is 'equal'" used herein means that the volume average particle diameter is equal within a range in consideration of manufacturing errors in the toner T, or within a range in which the effects brought about by the volume average particle diameter of the toner T being equal (described below) can be achieved. In other words, the above-mentioned phrase does not mean that the volume average particle diameter has to be strictly the same for all of the developing devices.

Further, as regards the particle diameter distribution of the toner T (also referred to as "particle diameter distribution (in volume)" below), in which volume is the standard of distribution, the ratio in volume of fine toner MT is smaller for developing devices that perform development later in order. On the other hand, the volume average particle diameter of the toner T is equal among all of the developing devices. Therefore, it can be said that the particle diameter distribution (in volume) of the toner T contained in developing devices that perform development later in order is sharper, whereas the particle diameter distribution (in volume) of the toner T contained in developing devices that perform development earlier in order is broader. It should be noted that the particle diameter distribution (in volume) and/or the ratio in volume of fine toner MT to the ratio in volume of fine toner MT with respect to the entire volume of the toner T can be analyzed according to, for example, the so-called Coulter Counter method. In the present embodiment, the analysis is made using a Multisizer (Beckman Coulter, Inc.) that uses the above-mentioned method. Further, the so-called sphere equivalent diameter is analyzed as the diameter of the toner particles using the above-mentioned equipment.

The charge amount of toner T is as shown in FIG. 20. That is, the charge amounts are set to 25 μC/g for the first color, 20 μC/g for the second color, 15 μC/g for the third color, and 14.8 μC/g for the fourth color. That is, the developing devices perform development according to an order in which a developing device that contains toner T having a smaller charge amount performs development later in order. Further, when paying attention to two of the developing devices among the developing devices other than the developing device that performs development first, it can be said that:

when assuming that the charge amount of the toner T contained in the above-mentioned first developing device is E1, and the charge amount of the toner T contained in the above-mentioned second developing device is E2, E1 is larger than E2.

It should be noted that the charge amount of the toner T can be measured according to various methods such as the Faraday cylinder method, the space potential method, and the Blow-off method. In the present embodiment, the Blow-off method is used for measurement.

As described above, the printer 10 has two developing devices, i.e., a first developing device, whose ratio in volume of fine toner MT is R1, and a second developing device, whose ratio in volume of fine toner MT is R2, that satisfy all of the following three conditions: (1) The order in which the first developing device and the second developing device perform development is other than first in order; (2) The second developing device performs development later than the first developing device; and (3) R1 is larger than R2. In this way, it becomes possible to reduce occurrence of "fogging" described above.

As described in the "Description of the Related Art", when forming a color image by superimposing toner of several colors onto an intermediate transferring element, a phenomenon in which toner of one color inadvertently overlies toner of another color that has already been transferred onto the intermediate transferring element sometimes occurs. (This phenomenon is called "fogging" herein.) "Fogging" causes deterioration in the quality of the color image that is finally transferred onto the transferring material.

Further, as described in the "Mechanism by which "Fogging" Occurs", the later the development is in order, the larger the amount of the normally-charged toner RT that has already been transferred onto and that is present on the intermediate transferring element 70 (or the area of the region in which the normally-charged toner RT resides on the intermediate transferring element 70) becomes. Therefore, the amount of "fogging", i.e., the amount in which the toner of another color overlies the toner T that has already been transferred onto the intermediate transferring element 70 becomes larger.

In view of the above, when paying attention to two-developing devices among the developing devices other than the developing device that performs development first, the ratio in volume of fine toner MT for the developing device that performs development later is set smaller than the ratio in volume of fine toner MT for the developing device that performs development earlier.

More specifically, toner T having a larger ratio in volume of fine toner MT has a broader distribution in charge amount. Therefore, the toner T having a larger ratio in volume of fine toner MT will contain more inversely-charged toner OT, which causes occurrence of "fogging". In view of this, toner T having a smaller ratio in volume of fine toner MT is used when performing development later in order where "fogging" is likely to occur because of the increase in the amount of normally-charged toner RT on the intermediate transferring element 70 as well as the increase in the area in which the normally-charged toner RT resides. In this way, it becomes possible to reduce occurrence of "fogging".

===Mechanism by which Hollow Defects Occur ===

Figure 22:
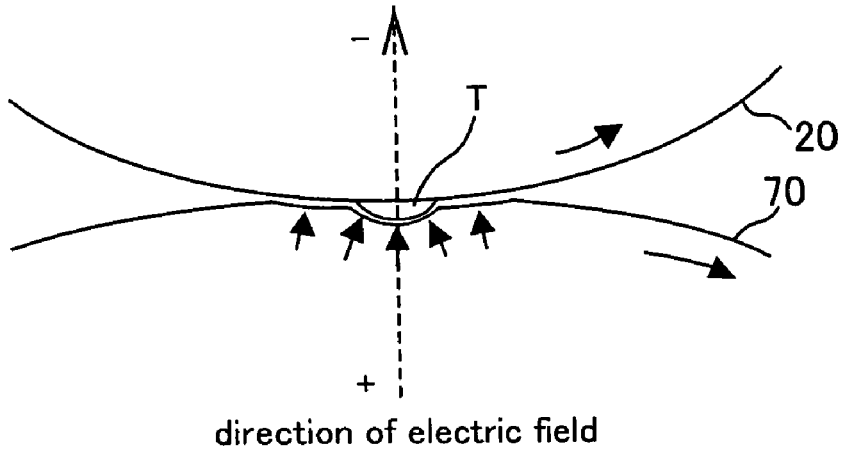
FIG. 22 is a conceptual diagram showing toner T positioned in the first transferring position.
Figure 23:
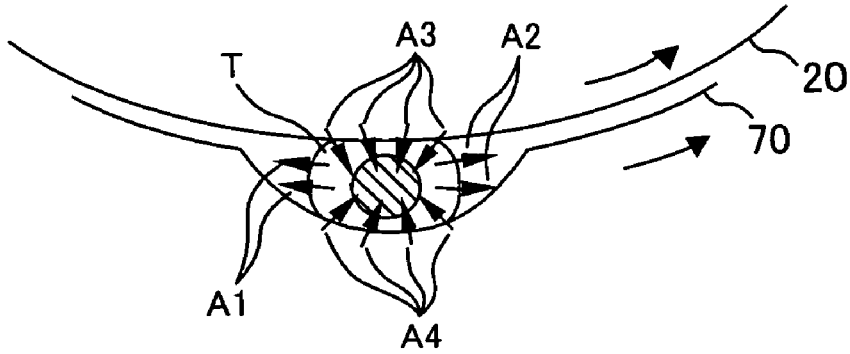
FIG. 23 is a conceptual diagram showing the toner T of FIG. 22 and its periphery in an enlarged manner.
Figure 24:
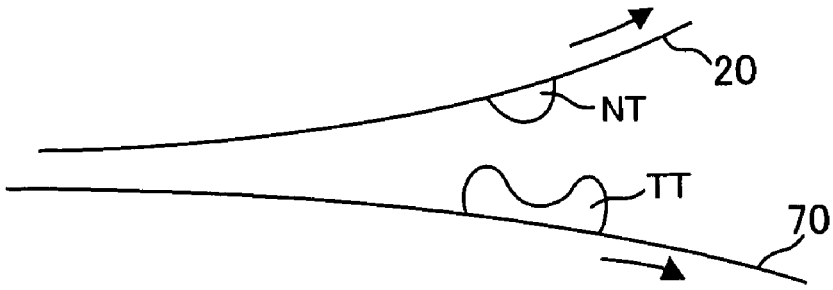
FIG. 24 is a conceptual diagram showing how the toner T is transferred onto the intermediate transferring element 70.
Figure 25:
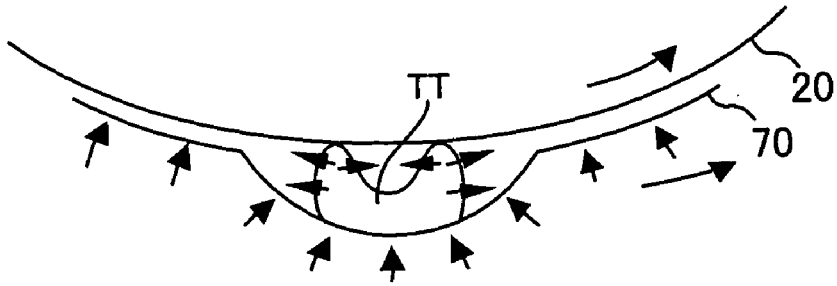
FIG. 25 is a conceptual diagram showing transferred toner TT that has made one revolution along with the rotation of the intermediate transferring element 70 and that has returned to the first transferring position.
Figure 26:
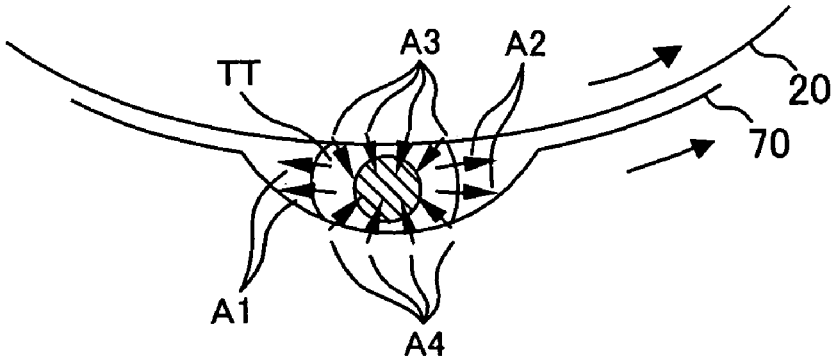
FIG. 26 is a conceptual diagram showing the force applied to the transferred toner TT.
Figure 27:
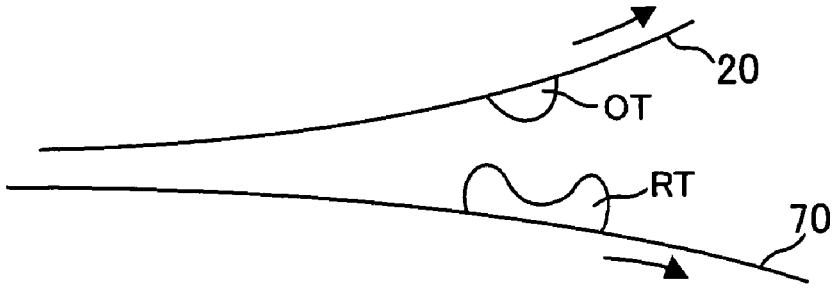
FIG. 27 is a conceptual diagram showing the inversely-transferred toner OT that is inversely transferred from the intermediate transferring element 70 to the photoconductor 20.
Figures 28, 29:
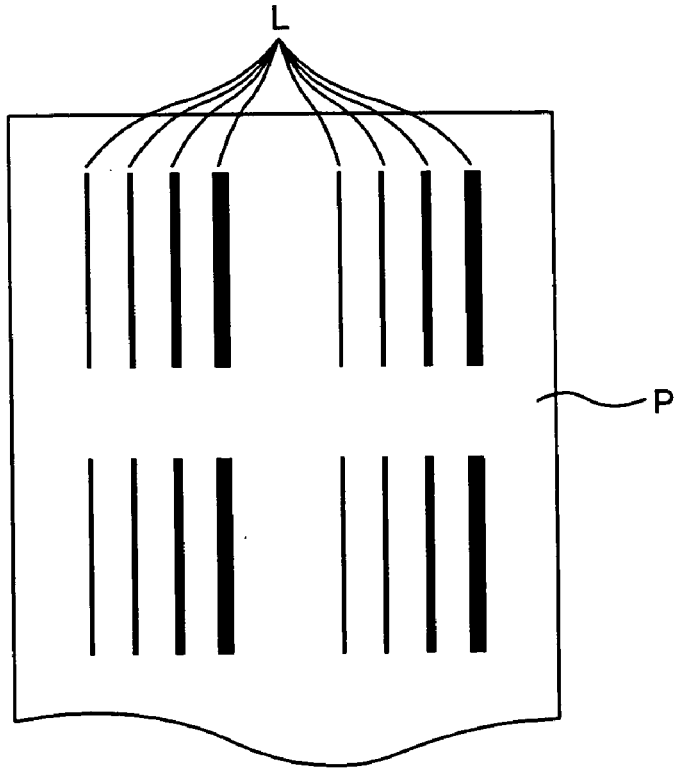
FIG. 28 is a diagram showing how the degree in which hollow defects occur differs according to the difference in the order of development.
FIG. 29 is a schematic diagram showing evaluation lines L formed on paper P, which serves as the transferring material.
Figures 30, 31, 32:
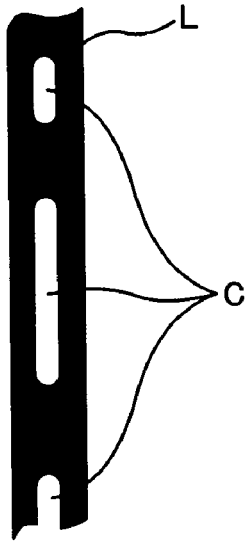
FIG. 30 is a schematic diagram showing the occurrence of hollow defect C in the evaluation line L.
FIG. 31 is a diagram showing how the degree in which hollow defects occur differs according to the difference in toner color.
FIG. 32 is a diagram showing the characteristics of the toner T for each developing device.

As described in the "Description of the Related Art", when transferring toner onto the intermediate transferring element, a phenomenon called "hollow defects" sometimes occurs. The mechanism by which hollow defects occur will be described below with reference to FIG. 22 through FIG. 31. FIG. 22 is a conceptual diagram showing toner T positioned in the first transferring position. FIG. 23 is a conceptual diagram showing the toner T of FIG. 22 and its periphery in an enlarged manner. FIG. 24 is a conceptual diagram showing how the toner T is transferred onto an intermediate transferring element 70. FIG. 25 is a conceptual diagram showing transferred toner TT that has made one revolution along with the rotation of the intermediate transferring element 70 and that has returned to the first transferring position. FIG. 26 is a conceptual diagram corresponding to FIG. 23 wherein the force applied to the transferred toner TT is shown. FIG. 27 is a conceptual diagram corresponding to FIG. 24 showing the inversely-transferred toner OT that is inversely transferred from the intermediate transferring element 70 to the photoconductor 20. FIG. 28 is a diagram showing how the degree in which hollow defects occur differs according to the difference in the order of development. FIG. 29 is a schematic diagram showing evaluation lines L formed on paper P, which serves as the transferring material. FIG. 30 is a schematic diagram showing the occurrence of hollow defect C in the evaluation line L. FIG. 31 is a diagram showing how the degree in which hollow defects occur differs according to the difference in toner color.

As described above, when image signals from a host computer are input to the main controller 101, the photoconductor 20, the developing roller, and the intermediate transferring element 70 rotate. While rotating, the photoconductor 20 is successively charged at the charging position.

With the rotation of the photoconductor 20, the area of the photoconductor 20 that has been charged (the charged area) reaches the exposure position, and a latent image according to image information for the first color (for example, yellow Y in the present embodiment) is formed in the charged area. With the rotation of the photoconductor 20, the latent image formed on the photoconductor 20 reaches the developing position and is developed by the yellow developing device 54 using yellow toner. Accordingly, a yellow toner image is formed on the photoconductor 20.

With the rotation of the photoconductor 20, the yellow toner image formed on the photoconductor 20 reaches the first transferring position and is transferred onto the intermediate transferring element 70 by the first transferring unit 60. As shown in FIG. 22, a first transferring voltage, which is in an opposite polarity to the charge polarity of the toner T, is applied to the first transferring unit 60. Further, as shown in FIG. 22, in order to make the photoconductor 20 and the intermediate transferring element 70 appropriately contact with each other, the intermediate transferring element 70 is pressed toward the photoconductor 20 by a roller provided in the first transferring unit 60.

When pressure toward the photoconductor 20 is applied to the intermediate transferring element 70, force will also be applied to the toner T that is present between the intermediate transferring element 70 and the photoconductor 20. The force applied to the toner T will be described with reference to FIG. 23.

First, attention should be paid to the peripheral section of the toner T. It can be seen that force toward the directions indicated by A1 and A2 is applied to the toner T on the left and the right in FIG. 23, respectively, among the entire toner T that is to be transferred. Therefore, the toner T on the left and right portions are movable toward the left and right in FIG. 23, respectively. On the other hand, it can be seen that force toward the directions indicated by A3 and A4 is applied to the toner T on the upper portion and the lower portion in FIG. 23, respectively, among the entire toner T that is to be transferred. The toner T on the upper and lower portions will move toward the center of the toner T. As a result, agglomeration of toner T will occur at the center of the toner T.

Next, with reference to FIG. 24, the behavior of the toner T when the first transferring voltage, which is in an opposite polarity to the charge polarity of the toner T, is applied to the first transferring unit 60 will be explained separately for the toner T in the peripheral section (described above) and for the toner T at the center (also described above). First, as for the toner T in the peripheral section, the toner T is transferred onto the intermediate transferring element 70 according to the effect of the electric field of the applied first transferring voltage. (The toner having been transferred is indicated as "transferred toner TT" in FIG. 24.) On the other hand, the toner T at the center is firmly agglomerated. Therefore, it is not so susceptible to the electric field of the first transferring voltage for reasons such as the decrease in the amount of electric charge per unit volume. Thus, the toner T at the center becomes difficult to transfer onto the intermediate transferring element 70 and tends to remain on the photoconductor 20 because of the static frictional force of the surface of the photoconductor 20. (The toner that has not been transferred is indicated as "not-transferred toner NT" in FIG. 24.)

In this way, hollow defects occur during transferring of the toner T onto the intermediate transferring element 70.

It should be noted that, in the present embodiment, the coefficient of static friction of the surface of the photoconductor 20 is set larger than that of the surface of the intermediate transferring element 70 for reasons such as the demand to make the coefficient of static friction of the surface of the intermediate transferring element 70 small in order for the secondary transferring of the toner T from the intermediate transferring element 70 onto the recording medium to be appropriately performed. In such cases, the above-mentioned not-transferred toner NT tends to be generated more easily, and this increases the occurrence of hollow defects.

Next, the processes described above are carried out for the second color (for example, cyan C in the present embodiment). That is, with the rotation of the photoconductor 20, the charged area of the photoconductor 20 reaches the exposure position, and a latent image according to image information for the second color is formed in the charged area. With the rotation of the photoconductor 20, the latent image formed on the photoconductor 20 reaches the developing position and is developed by the cyan developing device 53 using cyan toner. Accordingly, a cyan toner image is formed on the photoconductor 20.

With the rotation of the photoconductor 20, the cyan toner image formed on the photoconductor 20 reaches the first transferring position and is transferred onto the intermediate transferring element 70. Meanwhile, the yellow transferred toner TT that has already been transferred onto the intermediate transferring element 70 makes one revolution along with the rotation of the intermediate transferring element 70 and returns to the first transferring position. The yellow transferred toner TT that has returned to the first transferring position is positioned between the intermediate transferring element 70 and the photoconductor 20. Therefore, as shown in FIG. 25, the transferred toner TT receives force caused by the pressure applied to the intermediate transferring element 70 toward the photoconductor 20. Then, as shown by the arrows with respect to the toner TT in FIG. 25, the periphery of the transferred toner TT to which the force has been applied breaks, and the transferred toner TT is brought into a state as shown in FIG. 26. Then, as described above, the force toward the directions indicated by A1 through A4 is applied to the transferred toner TT, causing the toner TT to agglomerate at the center.

As shown in FIG. 27, the toner TT in the peripheral section remains on the intermediate transferring element 70. (The toner remaining on the intermediate transferring element 70 is indicated as "remaining toner RT" in FIG. 27.) On the other hand, the toner TT at the center is firmly agglomerated, and therefore, it tends to be inversely transferred (i.e., transferred back) onto the photoconductor 20 because of the static frictional force of the surface of the photoconductor 20. (The toner that has been inversely transferred back onto the photoconductor 20 is indicated as "inversely-transferred toner OT" in FIG. 27.)

In this way, hollow defects again occur at the first transferring position when the transferred toner TT, which has been transferred onto the intermediate transferring element 70, makes one revolution along with the rotation of the intermediate transferring element 70 and returns to the first transferring position.

The processes described above are carried out for the third color (for example, magenta M in the present embodiment) and the fourth color (for example, black K in the present embodiment). The same phenomenon as described above occurs also during these processes.

That is, as for the third color, when the remaining toner RT (described above) makes another revolution along with the rotation of the intermediate transferring element 70 and returns again to the first transferring position (that is, when the intermediate transferring element 70 approaches the first transferring position for the third time), hollow defects will again occur at the first transferring position.

Further, as for the fourth color, when the remaining toner RT makes a further revolution along with the rotation of the intermediate transferring element 70 and returns again to the first transferring position (that is, when the intermediate transferring element 70 approaches the first transferring position for the fourth time), hollow defects will again occur at the first transferring position.

As apparent from the description above, the earlier the development is performed, the larger the number of times in which hollow defects may occur becomes. More specifically, the number of times in which hollow defects may occur is four (4) for the toner T of the first color (that is, once when the toner T is transferred onto the intermediate transferring element 70, and the subsequent three approaches to the first transferring position), whereas the number of times decreases to three (3) for the toner T of the second color, since the number of times of subsequent approaches to the first transferring position decreases to two (2) for the toner T of the second color. Further, as for the toner T of the third color, the number of times in which hollow defects may occur is two (2), since the number of times of subsequent approaches to the first transferring position decreases to one (1). Further, as for the toner T of the fourth color, the number of times in which hollow defects may occur is one (1), since there are no subsequent approaches to the first transferring position.

Therefore, it can be said that the occurrence of hollow defects becomes significant for toner T that is used earlier in order of development. Further, the toner T becomes more susceptible to agglomeration every time it passes the first transferring position, because the toner T undergoes stress caused by frictional force, for example, of the photoconductor 20 and/or the intermediate transferring element 70. Also from this viewpoint, it can be said that the occurrence of hollow defects becomes more significant for toner T that is used earlier in order of development.

Consequently, the occurrence of hollow defects causes deterioration in the quality of the image that is finally transferred onto the transferring material.

Next, the test results that show the above-mentioned phenomenon is shown in FIG. 28. FIG. 28 is a diagram showing how the degree in which hollow defects occur differs according to the difference in the order of development. In this test, toner T of the same color was used in each of the four developing devices in order to make the test conditions the same for all developing devices.

The degree in which hollow defects occur was evaluated as follows. As shown in FIG. 29, a plurality of evaluation lines L, each of which differing in width, transfer bias, etc., were formed on paper P, which serves as the transferring material, and these lines were visually observed. The number of lines L in which hollow defects C (such as those shown in FIG. 30) were found were counted, and the obtained number was normalized into five grades. FIG. 28 shows the evaluation in five grades after normalization. The lowest point is 1 (in which case the occurrence of hollow defects is most significant), and the highest point is 5 (in which case the occurrence of hollow defects is least significant).

Further, the above-mentioned test was performed using both a printer 10 that is still in its initial state of usage and a printer 10 that has already been used for a while.

As apparent from the test results shown in FIG. 28, the occurrence of hollow defects became more significant for toner T that was used earlier in order of development. These results match the description above on the "Mechanism in which Hollow Defects Occur".

Although toner T of the same color was used in each of the four developing devices in this test in order to make the test conditions the same for all developing devices, it should be noted that, as the test results in FIG. 31 indicate, the difference in toner color causes almost no difference in the degree in which hollow defects occur.

===Characteristics of Toner in Each Developing Device ===

Next, the characteristics of the toner T according to the present embodiment will be described. As described above, the printer 10 according to the present embodiment has four developing devices, and the color of the toner T in each developing device is different. In addition, some characteristics, other than color, are made to differ for each of the developing devices. The characteristics of the toner T contained in each developing device will be described with reference to FIG. 32. FIG. 32 is a diagram showing the characteristics of the toner T for each developing device.

The table in FIG. 32 shows, for each of the four developing devices, the color of toner in the developing device, the ratio in volume of toner particles having a diameter of 5 μm or less (in the present embodiment, such toner particles are referred to as "fine toner MT") with respect to the entire volume of the toner T, and the volume average particle diameter of the toner T. The data for the four developing devices are described from left to right in FIG. 32 in the order of development.

As described above, in the present embodiment, the first color is yellow, the second color is cyan, the third color is magenta, and the fourth color is black.

The ratios in volume of fine toner MT with respect to the entire volume of the toner T are 2.5% for the first color, 0.5% for the second color, 1% for the third color, and 2% for the fourth color, as shown in FIG. 32. That is, except for the developing device for the first color, the developing devices perform development according to an order in which a developing device having a smaller ratio in volume performs development earlier in order.

Further, when paying attention to two of the developing devices, it can be said that the printer 10 of the present embodiment has two developing devices, i.e., a first developing device, whose ratio in volume of fine toner MT is R1, and a second developing device, whose ratio in volume of fine toner MT is R2, that satisfy both of the following two conditions:

(1) The second developing device performs development later than the first developing device; and (2) R2 is larger than R1.

As shown in FIG. 32, the volume average particle diameter of the toner T for each of the developing devices is 8.5 μm, i.e., the volume average particle diameter of the toner T is equal. In other words, it can be said that, when paying attention to the two developing devices (the above-mentioned first and second developing devices), the volume average particle diameter of the developer contained in the first developing device is equal to the volume average particle diameter of the developer contained in the second developing device. It should be noted that the phrase "the volume average particle diameter of the toner T is 'equal'" used herein means that the volume average particle diameter is equal within a range in consideration of manufacturing errors in the toner T, or within a range in which the effects brought about by the volume average particle diameter of the toner T being equal (described below) can be achieved. In other words, the above-mentioned phrase does not mean that the volume average particle diameter has to be strictly the same for all of the developing devices.

Further, as regards the particle diameter distribution of the toner T (also referred to as "particle diameter distribution (in volume)" below), in which volume is the standard of distribution, the ratio in volume of fine toner MT is smaller for developing devices that perform development earlier in order. On the other hand, the volume average particle diameter of the toner T is equal among all of the developing devices. Therefore, it can be said that the particle diameter distribution (in volume) of the toner T contained in developing devices that perform development earlier in order is sharper, whereas the particle diameter distribution (in volume) of the toner T contained in developing devices that perform development later in order is broader. It should be noted that the particle diameter distribution (in volume) and/or the ratio in volume of fine toner MT to the ratio in volume of fine toner MT with respect to the entire volume of the toner T can be analyzed according to, for example, the so-called Coulter Counter method. In the present embodiment, the analysis is made using a Multisizer (Beckman Coulter, Inc.) that uses the above-mentioned method. Further, the so-called sphere equivalent diameter is analyzed as the diameter of the toner particles using the above-mentioned equipment.

As described above, the printer 10 has two developing devices, i.e., a first developing device, whose ratio in volume of fine toner MT is R1, and a second developing device, whose ratio in volume of fine toner MT is R2, that satisfy both of the following two conditions: (1) The second developing device performs development later than the first developing device; and (2) R2 is larger than R1. In this way, it becomes possible to reduce occurrence of hollow defects described above.

As described in the "Description of the Related Art", when transferring toner onto the intermediate transferring element, a phenomenon called "hollow defects" sometimes occurs. Hollow defects cause deterioration in the quality of the color image that is finally transferred onto the transferring material.

Further, as described in the "Mechanism by which Hollow Defects Occur", the occurrence of hollow defects becomes significant the earlier the toner T is used for development.

In view of the above, when paying attention to two developing devices, the ratio in volume of fine toner MT for the developing device that performs development earlier is set smaller than the ratio in volume of fine toner MT for the developing device that performs development later.

More specifically, because of its small diameter, fine toner MT has a high packing density and thus tends to easily cause physical agglomeration compared to ordinary-size toner T. Therefore, as indicated by the test results shown in FIG. 33, toner T having a smaller ratio in volume of fine toner MT suppresses the occurrence of hollow defects. Further, because of its small diameter, fine toner MT tends to have a higher charge compared to ordinary-size toner T, and agglomeration of fine toner easily occurs because of the attraction between the normally-charged fine toner and the inversely-charged fine toner (which has an opposite polarity to the normally-charged fine toner). Therefore, it can be said that toner T having a smaller ratio in volume of fine toner MT suppresses the occurrence of hollow defects.

In view of this, toner T having a smaller ratio in volume of fine toner MT is used when performing development earlier in order, where hollow defects are likely to occur because of the increase in the number of times in which hollow defects may occur, for example. In this way, it becomes possible to reduce occurrence of hollow defects.

Figures 33, 34:
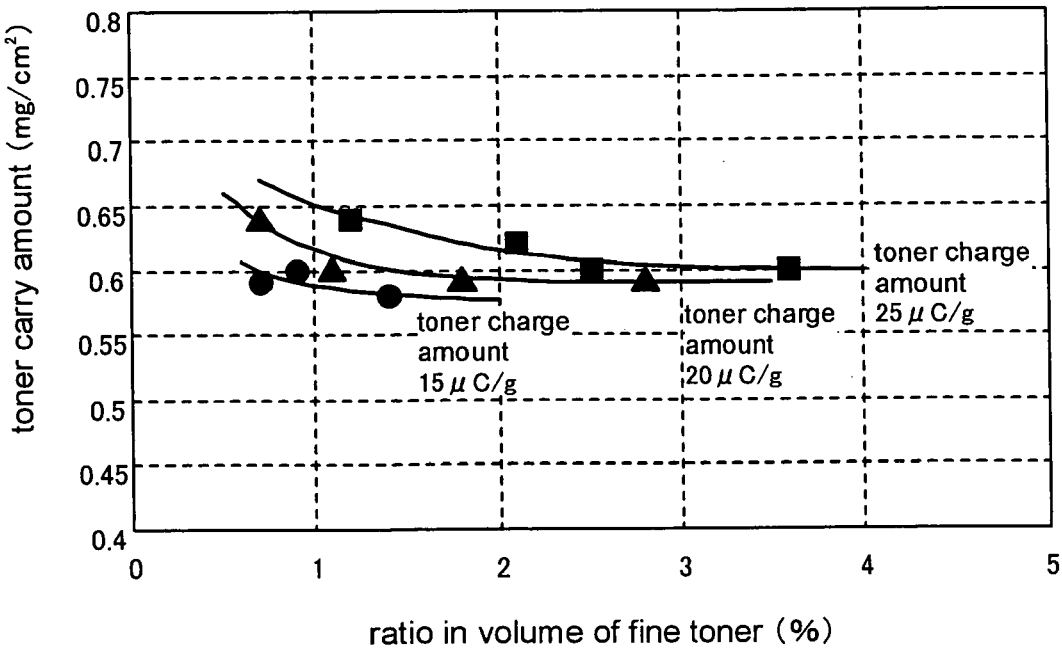
FIG. 33 is a diagram showing how the degree in which hollow defects occur differs according to the difference in the ratio in volume of fine toner MT.
FIG. 34 is a diagram showing the amount of toner carried (toner carry amount) when the ratio in volume of fine toner and the toner charge amount have been changed.

It should be noted that the difference in the degree in which hollow defects occur according to the difference in the ratio in volume of fine toner MT is shown in the diagram of FIG. 33.

Further, in the description above, the ratio in volume of fine toner MT for the first color (2.5%) was set exceptionally higher than that for the second, third, and fourth colors. This is because the first color was yellow, where the occurrence of hollow defects does not stand out so much even if it is significant. From the standpoint of reducing the occurrence of hollow defects, it is preferable to set the ratio in volume of fine toner MT for the first color smaller than that for the second, third, and fourth colors.

===Other Considerations ===

Above, a color image forming apparatus etc. according to the present invention was described based on an embodiment thereof. However, the above-mentioned embodiment of the invention is merely given for facilitating understanding of the present invention, and are not to limit the scope of the present invention. It is without saying that the present invention may be altered and/or modified without departing from the scope thereof, and that the present invention includes its equivalents.

In the embodiment described above, a color laser-beam printer is taken as an example of a color image forming apparatus. However, the present invention is applicable to various color image forming apparatuses such as photocopiers and facsimile machines.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

Further, in the embodiment described above, the color image forming apparatus has four developing devices containing four colors of toner T. However, the numbers of the developing devices and the colors can be more or less than four.

Further, in the embodiment described above, development and transferring are performed in the order of yellow Y→cyan C→magenta M→black K. However, the order in color is not limited to the above.

Further, in the embodiment described above, an example in which the color image forming apparatus comprises a rotary-type developing unit was described. However, this is not a limitation, and for example, a color image forming apparatus comprising a tandem-type developing unit may be adopted.

(A) As for Prevention of "Fogging"

In the embodiment described above, the developing devices, among the plurality of developing devices other than the developing device that performs development first, perform development according to an order in which a developing device having a smaller ratio in volume performs development later in order. However, this is not a limitation.

That is, when there are four developing devices, there are three types of combinations for selecting two developing devices from among the developing devices other than the developing device performing developing first. (The three combinations are: the developing devices that perform development second and third; the developing devices that perform development second and fourth; and the developing devices that perform development third and fourth.) In the embodiment described above, all of these combinations satisfy all of the conditions (1) through (3) that have been described above. However, the effect of enabling reduction in the occurrence of "fogging" can be achieved even when only one combination, among the three types of combinations, satisfies the conditions (1) through (3). Therefore, not all of the combinations have to satisfy the conditions (1) through (3).

However, the above-mentioned embodiment is preferable in order for the above-mentioned effect to be achieved more effectively.

Further, in the embodiment described above, toner particles having a diameter of 5 μm or less are defined as "fine toner". However, the value is not limited to 5 μm.

However, considering the high intensity in the charge characteristics of the fine toner described above, it is preferable to set the value to 5 μm.

Further, in the embodiment described above, the ratio in volume for the developing device that performs development first among the plurality of developing devices is larger than the ratio in volume for each of the other developing devices. However, this is not a limitation.

However, the above-mentioned embodiment is more reasonable because "fogging" according to the above-mentioned mechanism does not occur during the first development and transferring.

Further, in the embodiment described above, the toner includes conductive metal oxide as an external additive. However, this is not a limitation.

When the toner includes conductive metal oxide as an external additive, the electric charge of the normally-charged toner, which has already been transferred onto the intermediate transferring element and which resides thereon, tends to weaken with the lapse of time accompanying the rotation of the intermediate transferring element etc. Therefore, the electric force that attracts the inversely-charged toner toward the intermediate transferring element becomes weak, and the inversely-charged toner becomes difficult to be transferred onto the intermediate transferring element. As a result, the occurrence of "fogging" is reduced. From these reasons, the above-mentioned embodiment is preferred.

Further, in the embodiment described above, when assuming that a charge amount of the toner contained in the above-mentioned first developing device is E1, and a charge amount of the toner contained in the above-mentioned second developing device is E2, E1 is larger than E2. That is, the first and second developing devices further satisfy the condition "E2 (charge amount of the toner in the second developing device)<E1 (charge amount of the toner in the first developing device)", in addition to satisfying the three conditions: (1) the order in which the first developing device and the second developing device perform development is other than first in order; (2) the second developing device performs development later than the first developing device; and (3) "R2 (the ratio in volume for the second developing device)<R1 (the ratio in volume for the first developing device)".

By making the charge amount of the toner in the developing device having a smaller ratio in volume of fine toner smaller, an advantage in that carrying of toner on the developing roller is stabilized can be obtained.

This phenomenon will be explained below with reference to FIG. 21. FIG. 21 is a diagram showing the amount of toner carried (toner carry amount) when the ratio in volume of fine toner and the toner charge amount have been changed. In the figure, the abscissa is the ratio in volume of fine toner, and the ordinate is the toner carry amount. Further, three curves are shown in the figure. From below, the curves indicate the relationship between the ratio in volume and the toner carry amount when the toner charge amount is 15 μC/g, 20 μC/g, and 25 μC/g, respectively.

It should be noted that, the curve for when the toner charge amount is 15 μC/g is drawn through approximation of the plots shown by the circles. Similarly, the curve for when the toner charge amount is 20 μC/g is drawn through approximation of the plots shown by the triangles, and the curve for when the toner charge amount is 25 μC/g is drawn through approximation of the plots shown by the squares.

Through consideration of FIG. 21, it can be appreciated that the slope of the tangent of the curve increases as the ratio in volume of the fine toner becomes smaller. Increase in the slope signifies that the toner carry amount changes greatly even with a slight change in the ratio in volume. Therefore, it can be said that, as the ratio in volume of fine toner becomes smaller, the carrying of toner becomes unstable. In other words, although fine toner can be carried easily by the developing roller because of its small diameter, if the absolute ratio of fine toner, which has such a characteristic, is small, the toner carry amount will change easily.

On the other hand, it can be appreciated from the figure that the slope of the tangent of the curve becomes small when the toner charge amount becomes small, even in cases where the ratio in volume of fine toner is the same. This means that it becomes possible to stabilize carrying of toner by decreasing the charge amount of toner.

Accordingly, by making the charge amount of the toner in the developing device, among the first and second developing devices, having a smaller ratio in volume of fine toner smaller, it becomes possible to stabilize the carrying of toner on the developing roller.

It should be noted that, in the present embodiment, the charge amount of the toner in the developing device having a smaller ratio in volume of fine toner is made smaller, as described above. However, this is not a limitation. For example, the charge amount of the toner in the developing device having a smaller ratio in volume of fine toner may be made larger, or the charge amount of the developing devices may be the same. However, the embodiment described above is preferable because the above-mentioned effect, that is, the effect of stabilizing the carrying of toner is achieved.

Further, another way of making the charge amount of the toner in the developing device, among the first and second developing devices that satisfy R2<R1, having a smaller ratio in volume (i.e., the second developing device) smaller is to make the amount of external additive A2 of the toner in the second developing device smaller than the amount of external additive A1 of the toner in the first developing device. In this way, the charge amount of the toner in the developing device having a smaller ratio in volume can be made smaller most easily.

Further, another way is to make the charge amount M2 of the core particle of the toner in the second developing device smaller than the charge amount M1 of the core particle of the toner in the first developing device. In this way, it is possible to keep the charge amount of the toner in the developing device having a smaller ratio in volume small, even when the external additives get buried in the core particle or fall off therefrom and the charge-amount adjusting effect of the external additive decreases.

Both of the above-mentioned methods may be employed at the same time. It is needless to say that this is more preferable.

Further, in the embodiment described above, a volume average particle diameter of the toner in the first developing device is equal to a volume average particle diameter of the toner in the second developing device. However, this is not a limitation. For example, the volume average particle diameter of the toner in the first developing device may be set larger or smaller than the volume average particle diameter of the toner in the second developing device.

However, the above-mentioned embodiment is preferable because it becomes possible to enjoy various advantages achieved by making the volume average particle diameter of the toner equal, such as the effect of preventing unevenness in the toner carry amount and the effect of making the relationship between the amount of toner adhering to the transferring material and the appearance of darkness uniform.

Further, in the embodiment described above, the image forming apparatus forms a color image by performing an operation of: making the latent image bore on the photoconductor visible as a toner image using each of the developing devices; placing the photoconductor and the intermediate transferring element in contact with each other; and transferring the toner image onto the intermediate transferring element, successively with each of the plurality of developing devices to superimpose different kinds of toner onto the intermediate transferring element. However, this is not a limitation.

For example, a color image may be formed by performing the operation of making the latent image bore on the photoconductor visible as a toner image using the developing devices, successively with each of the plurality of developing devices to superimpose different kinds of toner onto the photoconductor.

Further, the toner image may be transferred onto the intermediate transferring element in a state in which the photoconductor and the intermediate transferring element are not placed in contact with each other. Further, when forming a color image by superimposing toner onto the photoconductor, the toner image may be transferred onto the photoconductor in a state in which the photoconductor and the developing device are not placed in contact with each other.

However, the embodiment described above is preferable because it is possible to prevent toner of other colors from getting mixed in the developing device when a color image is formed by superimposing toner not onto the photoconductor but onto the intermediate transferring element. Further, the embodiment described above is more effective also from a viewpoint that the above-mentioned effect of the present invention, that is, the effect of enabling reduction in the occurrence of "fogging" is achieved more advantageously because the photoconductor and the intermediate transferring element are closely arranged when they are placed in contact with each other for transferring the toner image onto the intermediate transferring element and thus the inversely-charged toner is attracted toward the intermediate transferring element more easily.

(B) As for Prevention of Hollow Defects

Further, in the embodiment described above, the developing devices perform development according to an order in which a developing device having a smaller ratio in volume performs development earlier in order. However, this is not a limitation.

That is, when there are four developing devices, there are six types of combinations for selecting two developing devices from among them. In the embodiment described above, all of these combinations satisfy both conditions (1) and (2) that have been described above. However, the effect of enabling reduction in the occurrence of hollow defects can be achieved even when only one combination, among the six types of combinations, satisfies both conditions (1) and (2). Therefore, not all of the combinations have to satisfy the conditions (1) and (2).

However, the above-mentioned embodiment is preferable in order for the above-mentioned effect to be achieved more effectively.

Although the order of development is not limited to yellow Y→cyan C→magenta M→black K, since yellow is a color that does not stand out so much, it is preferable to use yellow for the first development and transferring process in which occurrence of hollow defects tends to be most significant. Further, since black is a color that stands out and that is frequently used, it is preferable to use black for the last development and transferring process in which occurrence of hollow defects tends to be least significant.

Further, in the embodiment described above, toner particles having a diameter of 5 μm or less are defined as "fine toner". However, the value is not limited to 5 μm.

However, considering the high packing density and the high intensity in the charge characteristics of the fine toner described above, it is preferable to set the value to 5 μm.

Further, in the embodiment described above, the coefficient of static friction of the surface of the photoconductor is larger than the coefficient of static friction of the surface of the intermediate transferring element. However, this is not a limitation. For example, the coefficient of static friction of the surface of the photoconductor may be smaller than or equal to the coefficient of static friction of the surface of the intermediate transferring element.

However, the above-mentioned embodiment is more effective from the viewpoint that the above-mentioned effect of the present invention, that is, the effect of enabling reduction in the occurrence of hollow defects is achieved more advantageously in cases where the coefficient of static friction of the surface of the photoconductor is larger than the coefficient of static friction of the surface of the intermediate transferring element because in such cases the not-transferred toner and the inversely-charged toner are generated more easily.

Further, in the embodiment described above, the toner includes conductive metal oxide as an external additive. However, this is not a limitation.

When the toner includes conductive metal oxide as an external additive, the electric charge of the toner that has already been transferred onto the intermediate transferring element and that resides thereon tends to weaken with the lapse of time accompanying the rotation of the intermediate transferring element etc. Therefore, agglomeration of fine toner caused by the attraction between the normally-charged fine toner and the inversely-charged fine toner becomes difficult to occur. As a result, the occurrence of hollow defects is reduced. From these reasons, the above-mentioned embodiment is preferred.

Further, when assuming that a charge amount of the toner contained in the above-mentioned first developing device is E1, and a charge amount of the toner contained in the above-mentioned second developing device is E2, E2 may be larger than E1. That is, the first and second developing devices may further satisfy the condition "E1 (charge amount of the toner in the first developing device)<E2 (charge amount of the toner in the second developing device)", in addition to satisfying the two conditions: (1) the second developing device performs development later than the first developing device; and (2) "R1 (the ratio in volume for the first developing device)<R2 (the ratio in volume for the second developing device)".

By making the charge amount of the toner in the developing device having a smaller ratio in volume of fine toner smaller, an advantage in that carrying of toner on the developing roller is stabilized can be obtained.

This phenomenon will be explained below with reference to FIG. 34. FIG. 34 is a diagram showing the amount of toner carried (toner carry amount) when the ratio in volume of fine toner and the toner charge amount have been changed. In the figure, the abscissa is the ratio in volume of fine toner, and the ordinate is the toner carry amount. Further, three curves are shown in the figure. From below, the curves indicate the relationship between the ratio in volume and the toner carry amount when the toner charge amount is 15 μC/g, 20 μC/g, and 25 μC/g, respectively.

It should be noted that, the curve for when the toner charge amount is 15 μC/g is drawn through approximation of the plots shown by the circles. Similarly, the curve for when the toner charge amount is 20 μC/g is drawn through approximation of the plots shown by the triangles, and the curve for when the toner charge amount is 25 μC/g is drawn through approximation of the plots shown by the squares.

Through consideration of FIG. 34, it can be appreciated that the slope of the tangent of the curve increases as the ratio in volume of the fine toner becomes smaller. Increase in the slope signifies that the toner carry amount changes greatly even with a slight change in the ratio in volume. Therefore, it can be said that, as the ratio in volume of fine toner becomes smaller, the carrying of toner becomes unstable. In other words, although fine toner can be carried easily by the developing roller because of its small diameter, if the absolute ratio of fine toner, which has such a characteristic, is small, the toner carry amount will change easily.

On the other hand, it can be appreciated from the figure that the slope of the tangent of the curve becomes small when the toner charge amount becomes small, even in cases where the ratio in volume of fine toner is the same. This means that it becomes possible to stabilize carrying of toner by decreasing the charge amount of toner.

Accordingly, by making the charge amount of the toner in the developing device, among the first and second developing devices, having a smaller ratio in volume of fine toner smaller, it becomes possible to stabilize the carrying of toner on the developing roller.

It should be noted that, the charge amount of the toner in the developing device having a smaller ratio in volume of fine toner does not have to be made smaller. For example, the charge amount of the toner in the developing device having a smaller ratio in volume of fine toner may be made larger, or the charge amount of the developing devices may be the same. However, the embodiment described above is preferable because the above-mentioned effect, that is, the effect of stabilizing the carrying of toner is achieved.

Further, another way of further making the charge amount of the toner in the developing device, among the first and second developing devices that satisfy R1<R2, having a smaller ratio in volume (i.e., the first developing device) smaller is to make the amount of external additive A1 of the toner in the first developing device smaller than the amount of external additive A2 of the toner in the second developing device. In this way, the charge amount of the toner in the developing device having a smaller ratio in volume can be made smaller most easily.

Further, another way is to make the charge amount M1 of the core particle of the toner in the first developing device smaller than the charge amount M2 of the core particle of the toner in the second developing device. In this way, it is possible to keep the charge amount of the toner in the developing device having a smaller ratio in volume small, even when the external additives get buried in the core particle or fall off therefrom and the charge-amount adjusting effect of the external additive decreases.

Both of the above-mentioned methods may be employed at the same time. It is needless to say that this is more preferable.

It should be noted that the charge amount of the toner can be measured according to various methods such as the Faraday cylinder method, the space potential method, and the Blow-off method. The "charge amount" of toner described above is measured by the Blow-off method.

Further, in the embodiment described above, a volume average particle diameter of the toner in the first developing device is equal to a volume average particle diameter of the toner in the second developing device. However, this is not a limitation. For example, the volume average particle diameter of the toner in the first developing device may be set larger or smaller than the volume average particle diameter of the toner in the second developing device.

However, the above-mentioned embodiment is preferable because it becomes possible to enjoy various advantages achieved by making the volume average particle diameter of the toner equal, such as the effect of preventing unevenness in the toner carry amount and the effect of making the relationship between the amount of toner adhering to the transferring material and the appearance of darkness uniform.

===Configuration of Computer System Etc. ===

Next, an embodiment of a computer system, which is an example of an embodiment of the present invention, will be described with reference to the drawings.

Figure 35:
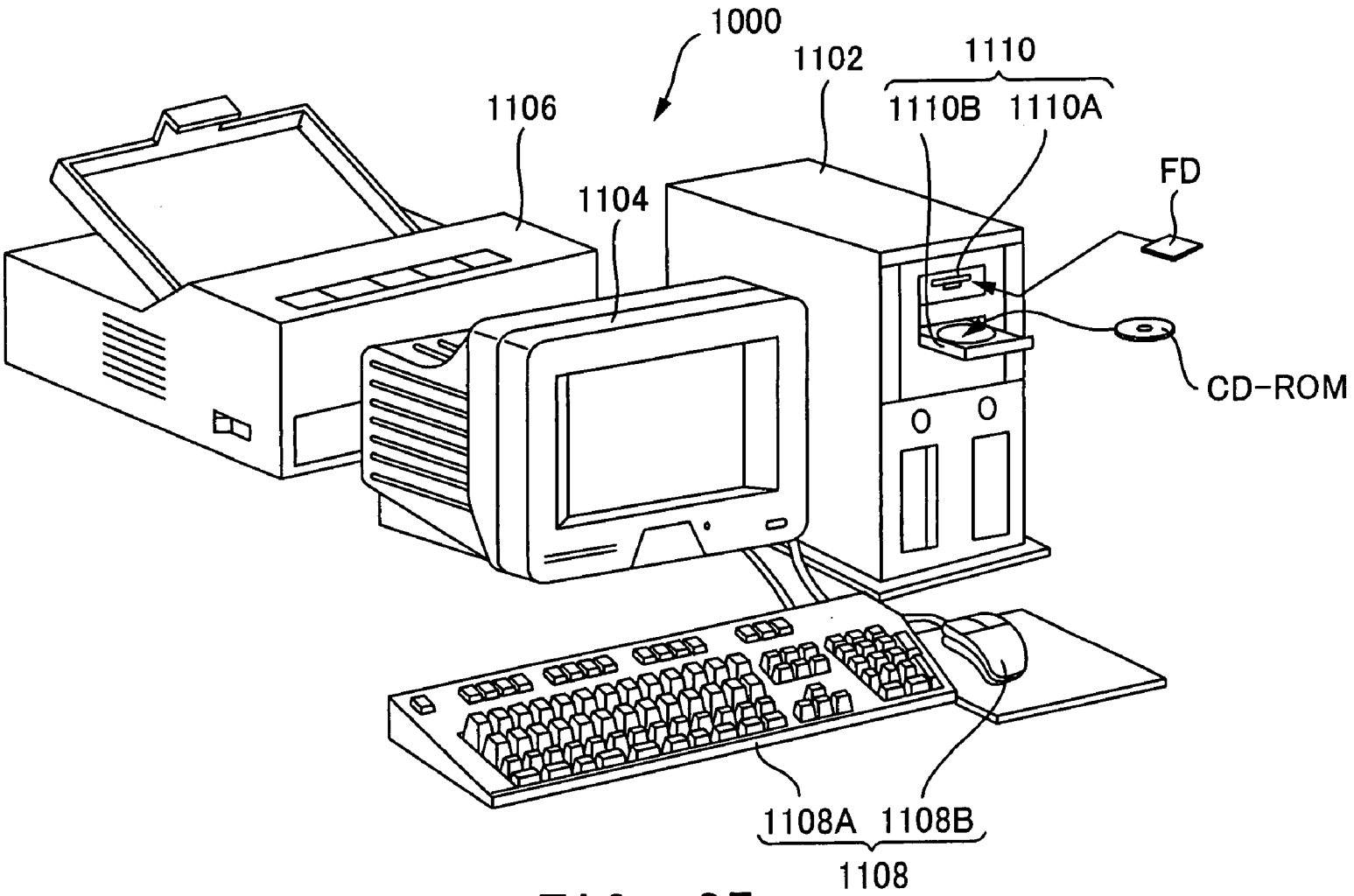
FIG. 35 is an explanatory diagram showing the external configuration of a computer system.

FIG. 35 is an explanatory diagram showing the external configuration of a computer system. The computer system 1000 includes: a computer unit 1102; a display device 1104; a printer 1106; an input device 1108; and a reading device 1110. In the present embodiment, the computer unit 1102 is housed in a mini-tower casing; however the structure is not limited to this example. Although a CRT (cathode ray tube), a plasma display, or a liquid crystal display device is generally used as the display device 1104, any other kinds of devices can be used. The printer described above is used as the printer 1106. In the present embodiment, a keyboard 1108A and a mouse 1108B are used as the input device 1108; however, any other kinds of devices can be used. In the present embodiment, a flexible disk drive device 1110A and a CD-ROM drive device 1110B are used as the reading device 1110; however, it is also possible to use an MO (magneto-optical) disk drive device, a DVD (digital versatile disk) drive, or any other kinds of devices.

Figure 36:
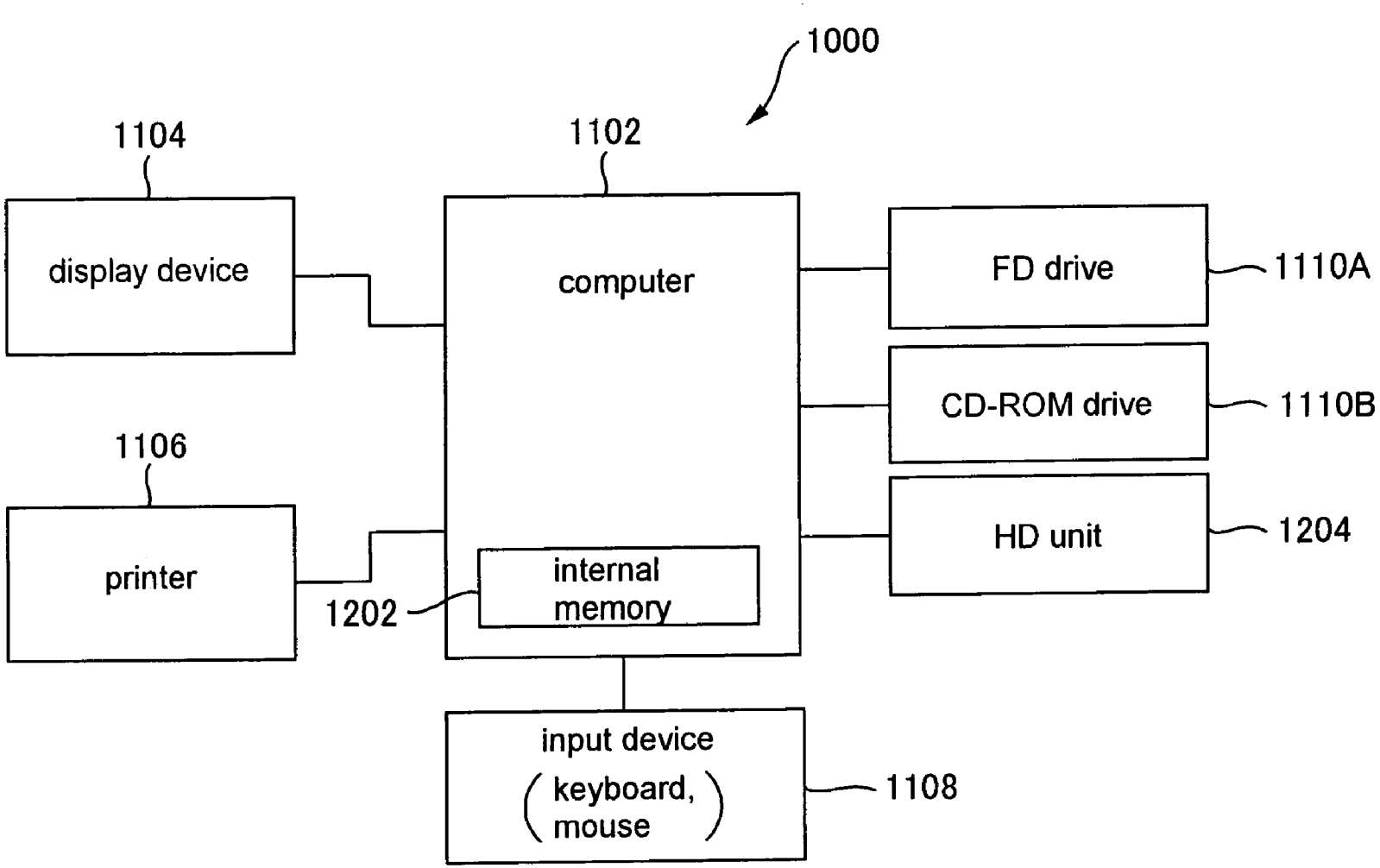
FIG. 36 is a block diagram showing the configuration of the computer system shown in FIG. 35.

FIG. 36 is a block diagram showing the configuration of the computer system shown in FIG. 35. FIG. 36 shows that an internal memory 1202, such as a RAM, provided inside the casing in which the computer unit 1102 is housed, and an external memory, such as a hard-disk drive unit 1204, are also provided.

In the above, description was made of an example in which the printer 1106 is connected to the computer unit 1102, the display device 1104, the input device 1108, and the reading device 1110 to configure the computer system. However, the configuration is not limited to the above. For example, the computer system may be configured comprising only the computer unit 1102 and the printer 1106, and it does not have to comprise any one of the display device 1104, the input device 1108, and the reading device 1110.

Further, for example, it is also possible for the printer 1106 to have some of the functions or mechanisms of each of the computer unit 1102, the display device 1104, the input devices 1108, and the reading device 1110. For example, it is possible to structure the printer 1106 so that it comprises an image processor for processing images, a display section for performing various kinds of displaying, and a recording media mounting section for detachably mounting a recording medium on which image data captured with a digital camera or the like is stored.

A computer system configured as above will be superior to existing computer systems as a whole.

Although the preferred embodiment of the present invention has been described in detail, it should be understood that various changes, substitutions, and alterations can be made therein without departing from spirit and scope of the inventions as defined by the appended claims.

What is claimed is:

1. An image forming apparatus comprising:

an image bearing member on which a latent image is formed;

a plurality of developing devices for developing said latent image, each of said developing devices containing developer;

a turnable turning member on which said plurality of developing devices are mounted, wherein said turning member is caused to turn based on a turn history of said turning member;

an image formed by developing said latent image is output by being transferred onto a medium;

said turn history is a history value according to a number of said medium that has been output, and a number of times of turns of said turning member;

a detector for detecting the turn of said turning member; a counter for counting the output of said detector; and the number of times of turns of said turning member is a number counted by said counter.

2. An image forming apparatus comprising:

an image bearing member on which a latent image is formed;

a plurality of developing devices for developing said latent image, each of said developing devices containing developer;

a turnable turning member on which said plurality of developing devices are mounted, wherein said turning member is caused to turn based on a turn history of said turning member;

an image formed by developing said latent image is output by being transferred onto a medium;

said turn history is a history value according to a number of said medium that has been output, and a number of times of turns of said turning member;

output of said image on said medium is executed according to an output command; and the number of times of turns of said turning member is estimated according to said output command.

3. An image forming apparatus according to claim 2, wherein:

the estimation is executed every time said medium is output.

4. An image forming apparatus according to claim 2, wherein:

the estimation is executed every time a predetermined number of said medium is output.

5. An image forming apparatus according to claim 2, wherein:

the estimation is executed for every output job by which said medium is output.

6. An image forming apparatus according to claim 5, wherein:

said estimation is executed every time a predetermined number of said medium is output according to said output job using a certain one of said developing devices without said turning member being turned.

7. An image forming apparatus according to claim 6, wherein:

said plurality of developing devices each contains developer of a different color including black; and said certain one of developing devices is the developing device containing the black developer.

8. An image forming apparatus comprising:

an image bearing member on which a latent image is formed;

a plurality of developing devices for developing said latent image, each of said developing devices containing developer;

a turnable turning member on which said plurality of developing devices are mounted, wherein said turning member is caused to turn based on a turn history of said turning member;

an image formed by developing said latent image is output by being transferred onto a medium;

said turn history is a history value according to a number of said medium that has been output, and a number of times of turns of said turning member;

said history value is a turn value that indicates a ratio between said number of said medium that has been output, and said number of times of turns of said turning member.

9. An image forming apparatus according to claim 8, wherein:

said turning member is caused to turn when said turn value is smaller than a preset reference value as a result of comparison between said turn value and said reference value.

10. An image forming apparatus according to claim 9, wherein:

said image forming apparatus comprises a storage element capable of storing various kinds of information; and said reference value is changeable according to said information in said storage element.

11. An image forming apparatus according to claim 10, wherein:

said information is about a remaining amount of said developer contained in a container provided in each of said developing devices.

12. An image forming apparatus according to claim 10, wherein:

said information is about an amount of said medium that is output using each of said developing devices.

13. An image forming apparatus according to claim 10, wherein:

said storage element is provided in/on each of said developing devices.

14. An image forming apparatus comprising:

an image bearing member on which a latent image is formed;

a plurality of developing devices for developing said latent image, each of said developing devices containing developer;

a turnable turning member on which said plurality of developing devices are mounted, wherein said turning member is caused to turn based on a turn history of said turning member;

an image formed by developing said latent image is output by being transferred onto a medium;

said turn history is a history value according to a number of said medium that has been output, and a number of times of turns of said turning member;

said turning member is caused to turn every time a predetermined number of said medium is output.

15. An image forming apparatus comprising:

an image bearing member on which a latent image is formed;

a plurality of developing devices for developing said latent image, each of said developing devices containing developer; and a turnable turning member on which said plurality of developing devices are mounted, wherein:

each of said developing devices has two developer containers that contain said developer when the developing device is positioned in a developing position for developing said latent image;

one of said two developer containers has a developer supplying section for supplying said developer to said image bearing member;

said developer supplying section of each said developing device is at a lower portion of that developing device when that developing device is positioned in said developing position;

said developing device has a storage element capable of storing information about a remaining amount of said developer contained in said container, and information about an amount of medium that is output using each of said developing devices;

each of said developing devices does not have a stirring member for stirring said developer;

an image formed by developing said latent image is output by being transferred onto said medium;

said turning member is caused to turn every time a predetermined number of said medium is output;

said image forming apparatus further comprises a detector for detecting the turn of said turning member, and a counter for counting the output of said detector; and said turning member is caused to turn to mix said developer contained in each of said two developer containers when a turn value that indicates a ratio between the number of said medium that has been output, and said number counted by said counter is smaller than a preset reference value that is changeable according to said information in said storage element as a result of comparison between said turn value and said reference value.

16. An image forming apparatus according to any one of claims 1, 2, 8, 14, or 15, wherein, according to an output command, said image forming apparatus outputs an image formed by developing said latent image by transferring said image onto a medium, and wherein said turning member is caused to turn at least either at the beginning or the end of an output job for outputting said medium.

* * * * *